US012310455B2

(12) United States Patent
Schickling

(10) Patent No.: US 12,310,455 B2
(45) Date of Patent: May 27, 2025

(54) CUSTOMIZABLE FOOTWEAR SYSTEM

(71) Applicant: Evelyn Ford, Inc., Phoenix, AZ (US)

(72) Inventor: Evelyn Schickling, Phoenix, AZ (US)

( * ) Notice: Subject to any disclaimer, the term of this patent is extended or adjusted under 35 U.S.C. 154(b) by 0 days.

(21) Appl. No.: 16/599,105

(22) Filed: Oct. 10, 2019

(65) Prior Publication Data

US 2020/0107612 A1 Apr. 9, 2020

Related U.S. Application Data

(63) Continuation-in-part of application No. 15/250,517, filed on Aug. 29, 2016, now abandoned.

(60) Provisional application No. 62/744,123, filed on Oct. 10, 2018, provisional application No. 62/211,695, filed on Aug. 28, 2015.

(51) Int. Cl.

| | |
|---|---|
| ***A43B 7/142*** | (2022.01) |
| ***A43B 7/1463*** | (2022.01) |
| ***A43B 17/00*** | (2006.01) |
| ***A43B 17/04*** | (2006.01) |

(52) U.S. Cl.

CPC ..... *A43B 7/142* (2013.01); *A43B 7/1463* (2022.01); *A43B 17/006* (2013.01); *A43B 17/04* (2013.01)

(58) Field of Classification Search

CPC ..... A43B 7/142; A43B 7/1465; A43B 7/14; A43B 7/28; A43B 7/1405; A43B 7/141; A43B 7/1415; A43B 7/1425; A43B 7/144; A43B 7/149; A43B 17/00; A43B 17/04; A43B 17/003

USPC ..... 36/43–44

See application file for complete search history.

(56) References Cited

U.S. PATENT DOCUMENTS

| | | | | |
|---|---|---|---|---|
| 2,698,490 | A | 1/1955 | Goldman | |
| 3,861,399 | A | 1/1975 | Huff | |
| 3,985,853 | A | 10/1976 | Weisberg | |
| 4,727,661 | A * | 3/1988 | Kuhn | A43B 17/00 36/43 |
| 4,942,679 | A * | 7/1990 | Brandon | A43B 3/10 36/102 |
| 6,301,754 | B1 * | 10/2001 | Grunberger | A41F 1/002 24/303 |
| 6,481,120 | B1 * | 11/2002 | Xia | A43B 17/003 36/44 |

(Continued)

FOREIGN PATENT DOCUMENTS

| | | |
|---|---|---|
| KR | 20130103972 | 9/2013 |
| WO | 2005039340 | 5/2005 |
| WO | 2010143877 | 12/2010 |

OTHER PUBLICATIONS

Invitation to Pay Additional Fees and Where Applicable, Protest Fee dated Feb. 3, 2020 (Feb. 3, 2020) issued by the International Searching Authority/European Patent Office on related international patent application PCT/US2019/055746.

(Continued)

*Primary Examiner* — F Griffin Hall

(74) *Attorney, Agent, or Firm* — DICKINSON WRIGHT PLLC

(57) ABSTRACT

A customizable arch support system for use in fashionable high heeled shoes, designed to provide superior configurability and comfort for the wearer. More particularly, the system provides configurability so that it will provide superior support and comfort for the wearer, while maintaining minimal cross section profile which causes less limitations for the shoe designer.

20 Claims, 44 Drawing Sheets

(56) References Cited

U.S. PATENT DOCUMENTS

| | | | | |
|---|---|---|---|---|
| 6,647,597 | B2 * | 11/2003 | Reiter | A41F 1/002 24/303 |
| 7,373,696 | B2 * | 5/2008 | Schoening | A41D 25/003 24/66.1 |
| 7,526,880 | B2 * | 5/2009 | Polcek | A43B 17/02 36/43 |
| 8,453,346 | B2 * | 6/2013 | Steszyn | A43B 7/1445 36/146 |
| 8,453,356 | B2 * | 6/2013 | Mian | A43B 1/0054 2/69 |
| 9,392,829 | B2 * | 7/2016 | Manuello | A41F 1/002 |
| 9,609,903 | B2 * | 4/2017 | Chavez | A43B 3/246 |
| 9,721,712 | B2 * | 8/2017 | Provencher | A45C 13/1069 |
| 10,779,592 | B2 * | 9/2020 | Horton | A41D 3/02 |
| 2002/0092203 | A1 | 7/2002 | Hardt | |
| 2002/0178551 | A1 * | 12/2002 | Hsu | A41F 1/002 24/303 |
| 2003/0019008 | A1 * | 1/2003 | Prather | A41F 1/002 2/69 |
| 2007/0180632 | A1 * | 8/2007 | Gallegos | A43B 3/246 12/146 B |
| 2009/0178245 | A1 * | 7/2009 | Albert | A41F 1/002 2/243.1 |
| 2010/0263237 | A1 * | 10/2010 | Cuellar | A43B 3/24 132/73 |
| 2012/0174346 | A1 * | 7/2012 | Fildan | A41F 1/006 24/303 |
| 2013/0219744 | A1 | 8/2013 | Case et al. | |
| 2015/0027002 | A1 | 1/2015 | Elliott | |
| 2015/0040434 | A1 * | 2/2015 | Perkins | A43B 3/12 12/142 R |
| 2016/0003269 | A1 * | 1/2016 | Russell-Clarke | A44B 99/00 24/303 |
| 2016/0242504 | A1 * | 8/2016 | Cowley | A43B 3/24 |
| 2016/0270481 | A1 * | 9/2016 | Harden | A43C 9/00 |
| 2017/0055629 | A1 * | 3/2017 | Schickling | A43B 7/1445 |
| 2017/0295884 | A1 | 10/2017 | Hung | |
| 2018/0325208 | A1 * | 11/2018 | Delaney | A43B 3/122 |

OTHER PUBLICATIONS

Notification of Transmittal of the International Search Report and the Written Opinion of the International Searching Authority or the Declaration dated Mar. 25, 2020 (Mar. 25, 2020) issued by the International Searching Authority/ European Patent Office on related international patent application PCT/US2019/055746.

The First Office Action issued Jun. 14, 2022, on related Chinese patent application 201980081391.5, issued by The State Intellectual Property Office of People's Republic of China.

* cited by examiner

602

Fig. 12A
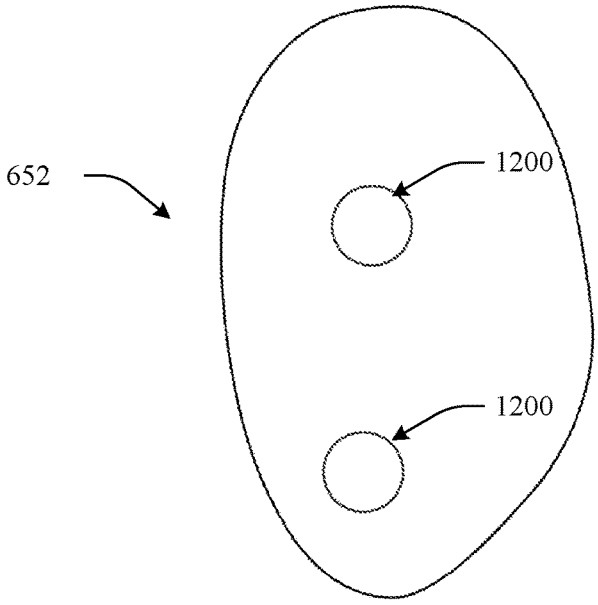
Fig. 12B
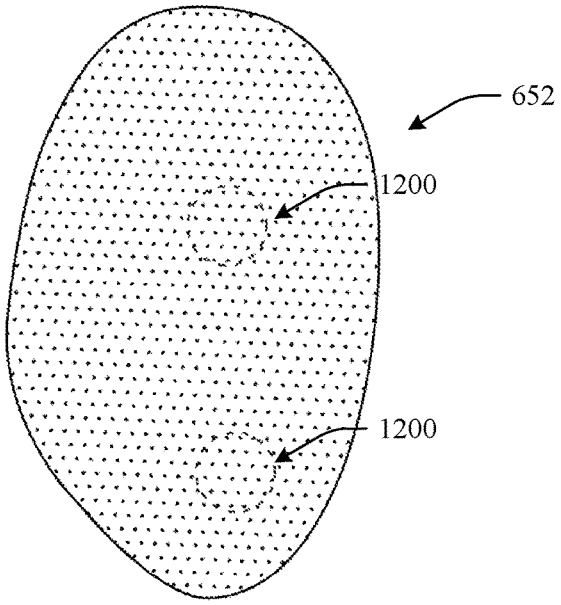
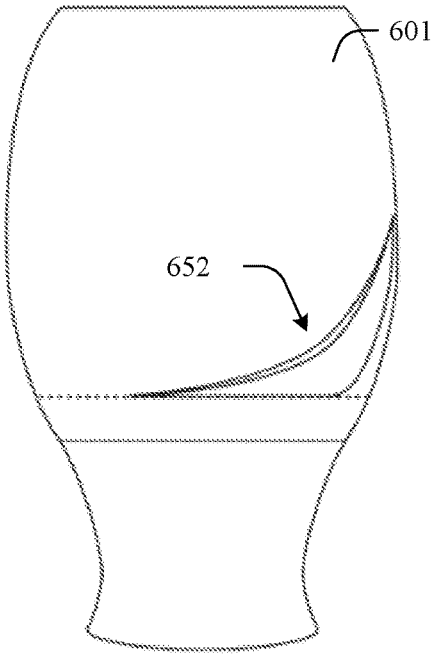
Fig. 12C

652

652

652

652

652

652

652

Fig. 13A
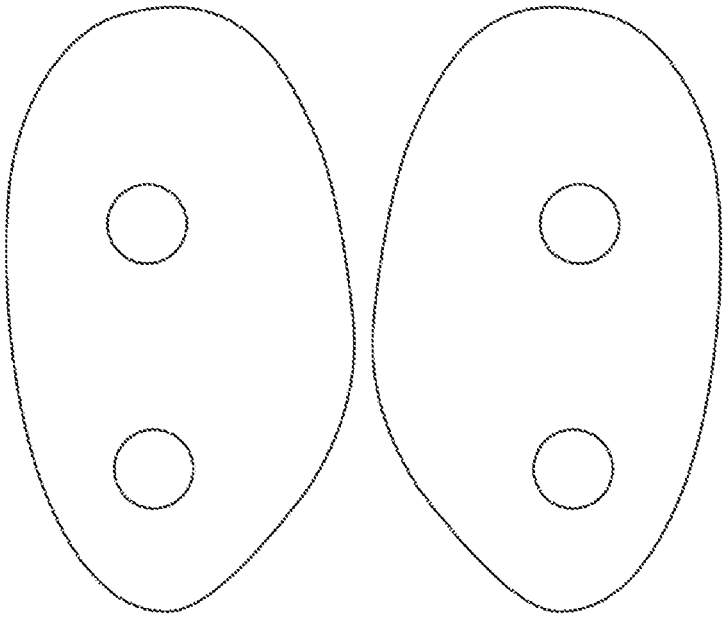
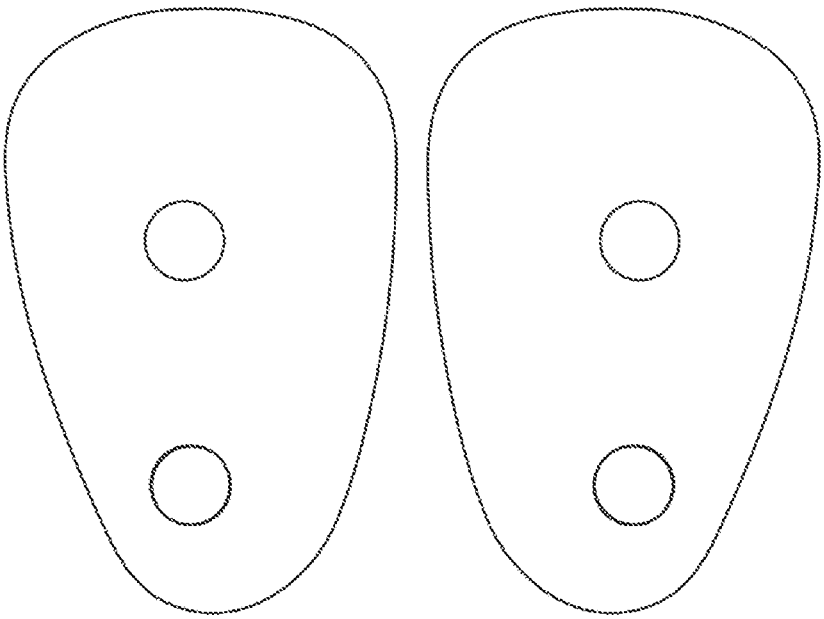
Fig. 13B

Fig. 14B1

Fig. 16A
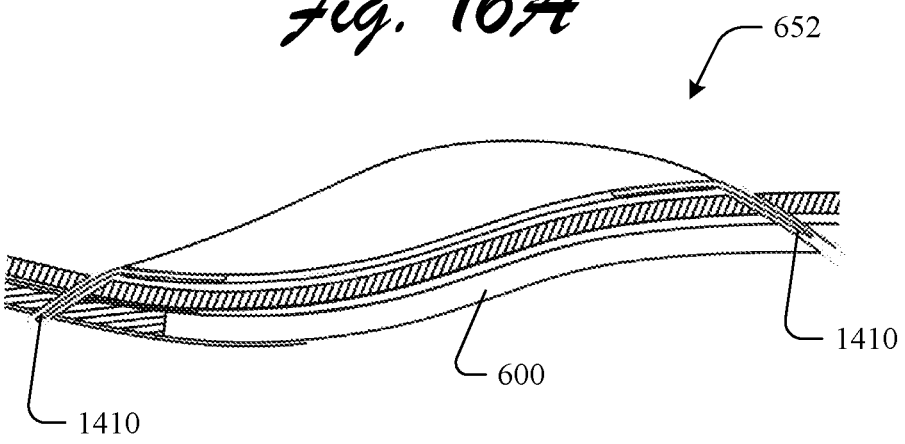
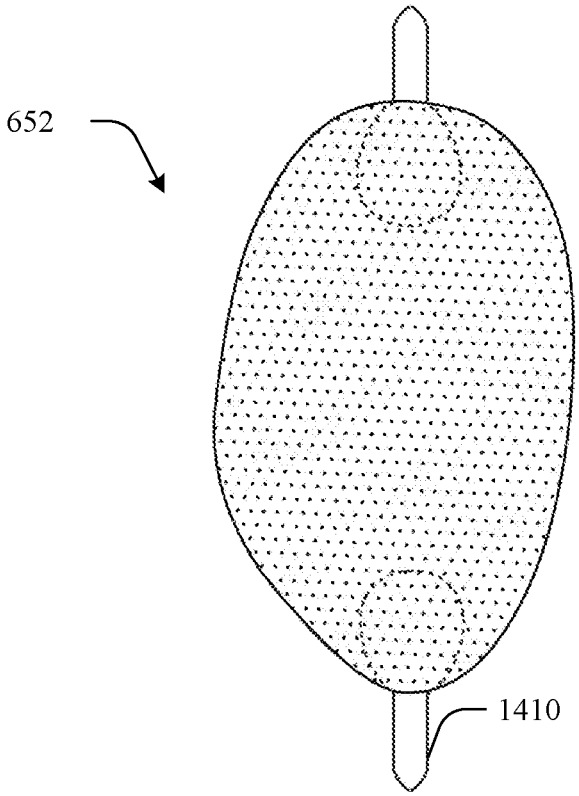
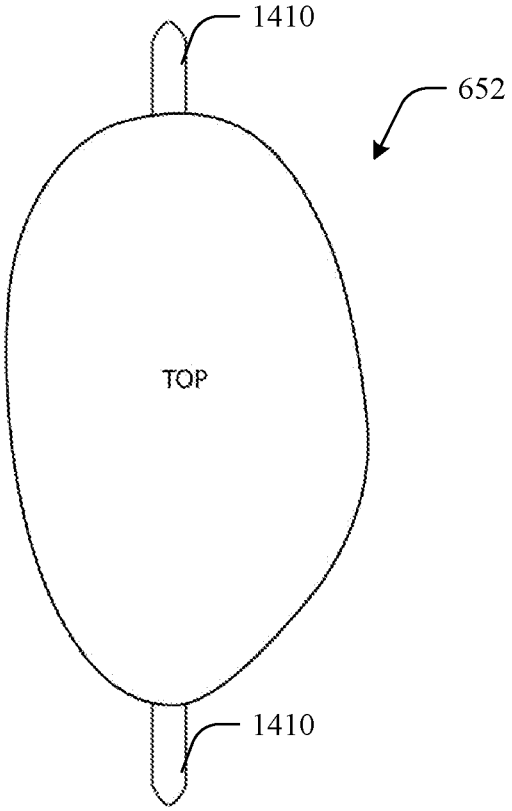
Fig. 16B Fig. 16C

Fig. 18A
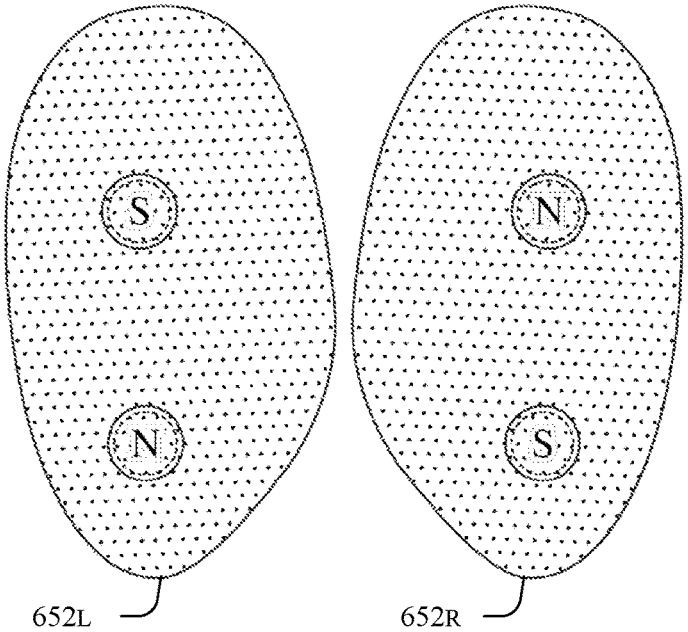
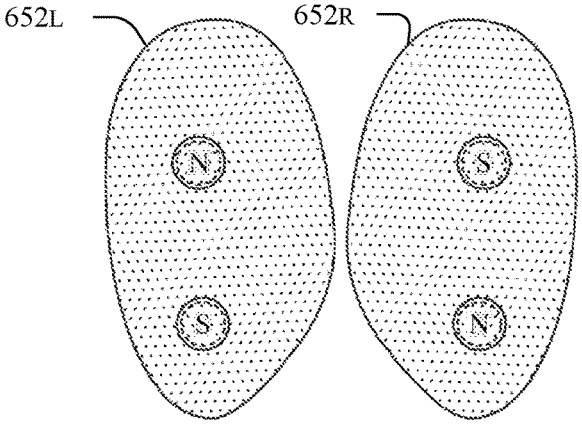
Fig. 18B
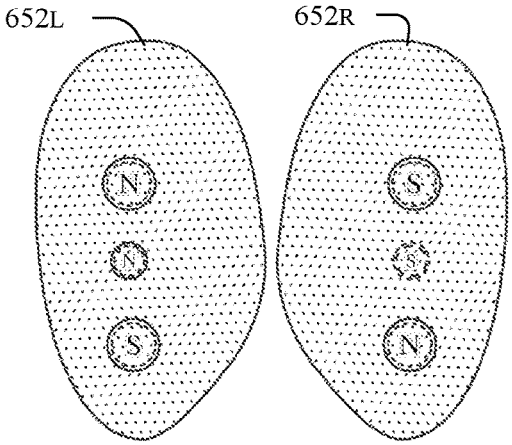
Fig. 18C

CUSTOMIZABLE FOOTWEAR SYSTEM

CROSS REFERENCE TO RELATED APPLICATIONS

This application is a continuation-in-part of U.S. patent application Ser. No. 15/250,517 filed Aug. 29, 2016, and titled, "Customizable Arch Support System, which claims the full benefit of and priority to U.S. provisional patent application No. 62/211,695 filed Aug. 28, 2015, and titled, "Adjustable Arch Support System," and claims the full benefit of and priority to U.S. provisional patent application No. 62/744,123 filed Oct. 10, 2018, and titled, "Customizable Footwear System," the disclosures of which are fully incorporated herein by reference for all purposes.

DESCRIPTION OF THE INVENTION

Field of the Invention

The present invention relates generally to an insole arch support system for use in female designer shoes, but can also be used in men's and children's shoes. More specifically, the present invention relates to a customizable arch support system allowing the wearer to personally tailor the arch support to their specific foot arch height by selecting a molded arch support insert that best conforms to the wearer's unique foot arch.

Background of the Invention

Orthotic devices are typically contoured, plate-like structures which fit in a shoe so as to correct or control the position and function of the foot. These orthotic devices are of a fixed design once manufactured, and are no longer configurable once they are made. Since the most critical functions of the foot generally involve the heel and mid-foot portions, a degree of rigidity is required in these areas in order for the device to carry out its biomechanical purposes. Hence, many devices of this type have a rigid, inflexible plate or cap which extends from the heel of the foot through the mid-foot, and sometimes generally extending to the metatarsal heads, known as the ball of the foot. Thus, they are typically only useful in flat or mostly flat-soled shoes.

The construction of these devices often presents a problem from the standpoint that this makes the device too thick for use in many types of shoes. Particularly in the area of women's high-heeled shoes where the interior volume is extremely limited and the rigidity does not allow these devices to fit over the steeply contoured shape of women's high-heeled shoes. A custom, rigid orthotic device may become problematic when fitting into shoes having an elongated shaft or throat, such as boots. The additional thickness of the insole when using a custom orthotic device may limit the footwear designer's ability to maintain a sleek, thin, fashionable look.

Further, any additional thickness applied to the interior volume of the shoe may result in discomfort or injury. A custom device may be too wide or too narrow to fit the wearer's foot comfortably when inserted in the shoe. In particular, tightness of the vamp of the shoe may lead to nerve damage, injuring the wearer. To go without support of the arch of the foot can result in severe cramping of the abductor hallucis, which will draw in the adjacent flexor muscles, resulting in pain and inability to perambulate.

If the arch of the foot is not properly supported, a wearer may exhibit none of the traditional symptoms of overpronation (foot posture) until presenting with pain, which may be in the knees or lower back. The source of discomfort may be hidden within the foot, leading to misdiagnosis and potential further injury. Of particular concern is a wearer with an existing injury that seems to resolve until using a high-heeled shoe, exacerbating the injury and prolonging length of treatment for relief.

A fixed design, un-configurable custom orthotic would be prescribed; however, the needs of a recovering injury can change minutely or drastically, rendering the cost of a custom orthotic prohibitive to resolution if frequent changes are needed by the wearer. Further, conditions such as pregnancy may change the size and shape of a woman's foot daily, making a fixed design, un-configurable custom orthotic impractical, and potentially harmful to the wearer.

Fashionable shoes may also be designed to have a narrow toe. If the load of the body weight is not distributed appropriately, with the aid of an appropriately sized arch, the toes may be compressed into the shoes by the weight of the body, which may lead to permanent deformation of the toes as they conform to their environment.

Further, many shoe owners complain about issues with conventional arch supports (or other cushioning) in that they are inherently difficult to place properly in the shoe. Correct placement ideally locates the arch support or cushioning to match the person's particular anatomy and shoe shape. During prior processes, the customer's foot has to be removed from the shoe for the support to be adhered—often the support is removed and repositioned, then re-attached to get the placement to be comfortable. Prior processes can be messy, time consuming, and weakens the adhesion; further, inserts or other supports can shift from the ideal position by forces caused by removal of the foot from the shoe.

Accordingly, there exists the need for an orthotic insole having minimal thickness and still provides a solution for the variability of the arch in the foot among different wearers, or the changing need of a single wearer, while remaining fashionable in the field of heeled shoes. There also exists a need for a retrofit kit that allows shoe owners to effectively deploy an orthotic, arch support, pad, or other type of insert within an existing shoe without requiring redesign of the shoe and with less difficulty placing the insert in a reliable position.

SUMMARY OF THE INVENTION

Both the foregoing summary and the following detailed description are exemplary and explanatory only and are not restrictive of the invention as claimed.

The present invention overcomes the problems cited above by providing an insole, which may be integral to the shoe or may be separate, and is configured to removably attach an arch support insert into a fastening system in the mid-foot arch portion of the insole. A plurality of arch support inserts are available such that the wearer may choose to use the insole without an arch support insert or fasten the appropriate sized and shaped arch support insert to the insole. Current additive manufacturing and 3D scanning technology makes it possible to provide affordable, completely customizable arch support inserts. An arch support insert cover is provided to protect the arch support insert from the wearer's bare feet. Because the insole and arch support contain a fastening means, the arch support insert remains correctly positioned on the mid-foot arch of the insole during use in any type of footwear, including women's high-heeled shoes. A properly fitted insole with the insert attached will disperse the weight equally upon the bones and ligaments of the foot, giving balance to the wearer along with improved spinal health; hence, an overall positive impact on the body as a whole.

The customizable arch support system comprises a shoe insole that is configured to allow the addition of a removably attached arch support insert. A plurality of differently sized and shaped arch supports are provided to fit the specific arch in the wearer's foot. A fastening means is used to attach said arch support inserts to said insole of the shoe. Covers are provided that will be positioned above the insole and arch support insert in the shoe. The arch support insert is removably attached to the insole via a fastening means, preferably a snap-type fastening system. However, other fastening means may be used, such as hook and loop fasteners, double-sided adhesive tape, or other fastening means. The arch support insert is available in a plurality of arch configurations ranging from a low arch to a high arch, or individually customized, so that it may accommodate the specific wearer's arch.

The insole is thin when compared to other arch support systems while remaining configurable and still applicable to the steeply down-curved platform found in women's fashionable high-heeled shoes. A shank conforms to the curve of the shoe under the heel and arch of the foot, and provides structural integrity to aid in supporting and distributing the wearer's body weight from ball of the foot, through the arch, to the heel of the foot. By selecting an appropriate insert, this arch support system will result in a shoe insole that inherently provides greater body stability and balance to the wearer by distributing body weight over the entire foot, thereby lessening the pressure on the metatarsal heads, the ball of the foot and the heel cup within the shoe.

The following preferred embodiment of the present invention describes the position and configuration and construction of the elements of the invention, which are an insole, a snap-type fastening system, an arch support insert and a cover. The insole is comprised of several layers of material and at least one female snap-type fastener to construct an insole that conforms to the curvature of a steeply down-curved arch typical in women's high-heeled shoes. A shank is located on a first layer of fiberboard and synthetic adhesive along the centerline of the mid-foot area. A preferably flexible cellulose board layer is then placed on top of the first insole layer with a synthetic adhesive layer, with at least one female snap-type fasteners set into the material. The layers are crimped and shaped to conform to the inside of the shoe. Then, a layer of the synthetic adhesive material is placed on the flexible cellulose board layer and a microcellular urethane cushioning layer(s) is placed on the synthetic adhesive layer that has been configured and adapted by cut-outs to reveal the female snap-type fasteners. The insole layers may be made of a variety of shock absorbing materials. U-shaped gel or polymer material pads are adhered in the heel portion of the insole and formed to cup the heel of the foot. The heel cup may extend upward into the shoe to reduce and customize the heel volume for narrower heel widths. Finally, after the shoe is constructed, a cover or sock liner of leather or synthetic material, with circular cut-outs to leave the at least one snap-type fastener exposed, is adhered to the top of the insole layers. This creates a cushioning insole that will accept attachment of the arch support insert while not taking up too much space within the tight confines of typical women's fashion high-heeled shoes.

The fastening means that attach the arch support insert to the insole is preferably comprised of a typical snap-type fastener system, further comprising an at least one male snap-type fastener fitting into an at least one female snap-type fastener. Alternately preferably, other types of fastening systems may be used such as hook and loop fastening system, among others.

The arch support insert is comprised of a compressible, cushioning material molded to conform to the arch of the mid-foot and at least one male snap-type fastener permanently attached to the bottom of the arch support insert. The compressible, cushioning material is preferably covered with a leather or lightweight synthetic fabric, possibly with a layer of gel or urethane foam between the cushioning material and the cover. Alternately preferably, a leather, or mesh material may be used to protect the compressible, cushioning material from body oils and other contaminants.

The arch support insert is preferably formed from ethylene-vinyl acetate (EVA). Alternately preferably, the arch support insert may be formed from polyurethane (PU) foams, silicone, nylon or SANTOPRENE®-brand thermoplastic vulcanizates (a thermoplastic elastomer), or similar materials. The arch support insert is molded to generally conform to a human being's foot arch in various arch heights and lengths. At least one male snap-type fastener corresponds to at least one female snap-type fastener located in the insole to removably attach the arch support insert to the insole of the shoe.

A cover is comprised of a durable material is structured and arranged to cover or envelope the arch support insert to protect the arch support insert from the wearer's foot. The material of the cover may be comprised of leather, canvas or other durable material on top of the arch support insert, and a flexible fabric, leather, or mesh-type material to wrap around the arch support insert and hold the cover in place. Alternatively, the cover may be multiple pieces of a durable material with the at least one male snap-type fastener located to correspond to the matching at least one female snap-type fastener. The arch support insert may be covered with a top layer of durable material with no cover on the underside or sandwiched between two layers of durable material with the cover preferably stitched around the perimeter.

The arch support insert is available in many different sizes to match a wearer's mid-foot arch size. Among the many different sizes available, the insert will function to support a low arch, medium arch, high-arch, or be customizable to the wearer's specific foot. A wearer will simply select the arch support insert size that best fits their individual foot, place the cover around the arch support insert, and fasten the covered arch support insert to the insole of the shoe. Alternatively, the wearer will select the appropriate arch support insert with the cover already attached and fasten it to the insole of the shoe.

In an alternate embodiment, the insole is further comprised of additional gel inserts, or similar-type cushioning materials, that are located at the ball of the foot and in the heel cup areas for further cushioning within the insole of the shoe. Due to the nature of women's high-heeled shoes, more pressure is placed on the ball of the foot because of the steeply-arched downward curvature of the shoe from heel to toe. This causes the ball of the foot to bear greater pressure because of the intimate contact of the ball of the foot and the heel within the shoe. By providing a gel insert in the area of the ball of the foot and the heel cup combined with the arch support insert, less pressure will be applied to these areas while wearing a high-heeled shoe, and such pressure that is applied will be dispersed by the gel inserts.

A method of providing customizable arch support in fashionable women's high-heeled shoes comprising the steps of: selecting an arch support insert based on wearer's particular arch in the mid-foot region, and attaching said arch support insert to an insole using a snap-type fastening system.

There is also provide a customizable arch support system integrated into a shoe comprising: at least one shoe insole, at least one arch support insert, wherein said arch support insert is removably attached to said shoe insole using a plurality of magnets in the arch support insert that are disposed to magnetically couple to a plurality of magnets in the insole. The customizable arch support system may further comprise a hook and loop fastening system. The customizable arch support system may also further comprise: at least one shank, wherein said shank is encompassed within said shoe insole, and the shank may be comprised of a rectangular metal bar. The customizable arch support system may also further comprise at least one cover, wherein said cover is placed over said arch support insert, and the cover may be comprised of a sheet of leather or a sheet of synthetic fabric. Various embodiments also include at least one cupped portion located under a wearer's heel, and the cupped portion may be comprised of a polymer material. Further, the cupped portion may be comprised of a gel material. Additionally, a customizable arch support system may further comprise at least one cushioning section disposed under a ball of a wearer's foot, and in one aspect, the cushioning section may be comprised of a gel material, of a urethane foam material, or, alternatively, a combination of a gel material and a urethane foam material. There is also provided a method of customizing the arch support in a shoe comprises the steps of: selecting an arch support insert closely matching a wearer's midfoot arch, fastening said arch support insert into the wearer's shoe, and placing a cover over the arch support insert.

Various embodiments also include a system for retrofitting a shoe comprising: a template insole comprising a marking section and one or more magnet voids; a magnet cover including: at least one adhered magnet within at least one magnet cavity, the magnet cavity located to align with the magnet voids, allowing the cavity to pass therethrough; and an adhesive affixed to a bottom surface of the magnet cover, the adhesive covered with a removable adhesive cover; a sock liner with one or more voids disposed to align with the magnet voids; and wherein: the magnet cover is placed within the shoe; the temporary insole is placed over the magnet cover so as to allow the magnet cavities to pass within the voids in the temporary insole; the magnet cover is moved within the shoe, using the temporary insole as a guide to align the magnet cover within the shoe; when aligning the magnet cover is complete, drawing a pattern on a surface of the shoe through the marking section; removing the temporary insole and magnet cover; removing the removable adhesive cover from the magnet cover, affixing the magnet cover in an area within the drawing pattern; and placing the sock cover over the affixed magnet cover. Further, the system of the present invention may further comprise affixing the sock cover to a surface of the shoe, and inserting an arch support or insert into the shoe to couple to the magnet cover.

Other aspects of the inventions are shown in the attached drawing appendix and described in the detailed description below.

BRIEF DESCRIPTION OF THE DRAWINGS

The particular objects and features of the invention as well as the advantages will become apparent from the following description taken in connection with the accompanying drawings in which:

FIGS. 12A and 12B respectively show inserts 652 from a bottom and top plan view.

FIG. 12C illustrates a cross section of a left shoe from the rear.

FIGS. 13A and 13B respectively show top plan views of pairs of inserts of different lengths and shapes.

FIG. 14 M illustrates an embodiment of an insert of the present invention that accommodates ultra-high heels.

FIGS. 16A-16C illustrate embodiments where alternative hardware attachment mechanisms may also be used to attach the inserts.

FIGS. 18A-C illustrate the use of polarity of magnets to properly align and insert the arch supports/inserts in the correct orientation.

DETAILED DESCRIPTION OF EXEMPLARY EMBODIMENTS

The foregoing and other objectives, features, and advantages of the invention will be more readily understood upon consideration of the following description of the invention taken in conjunction with the accompanying drawings.

Figure 1:
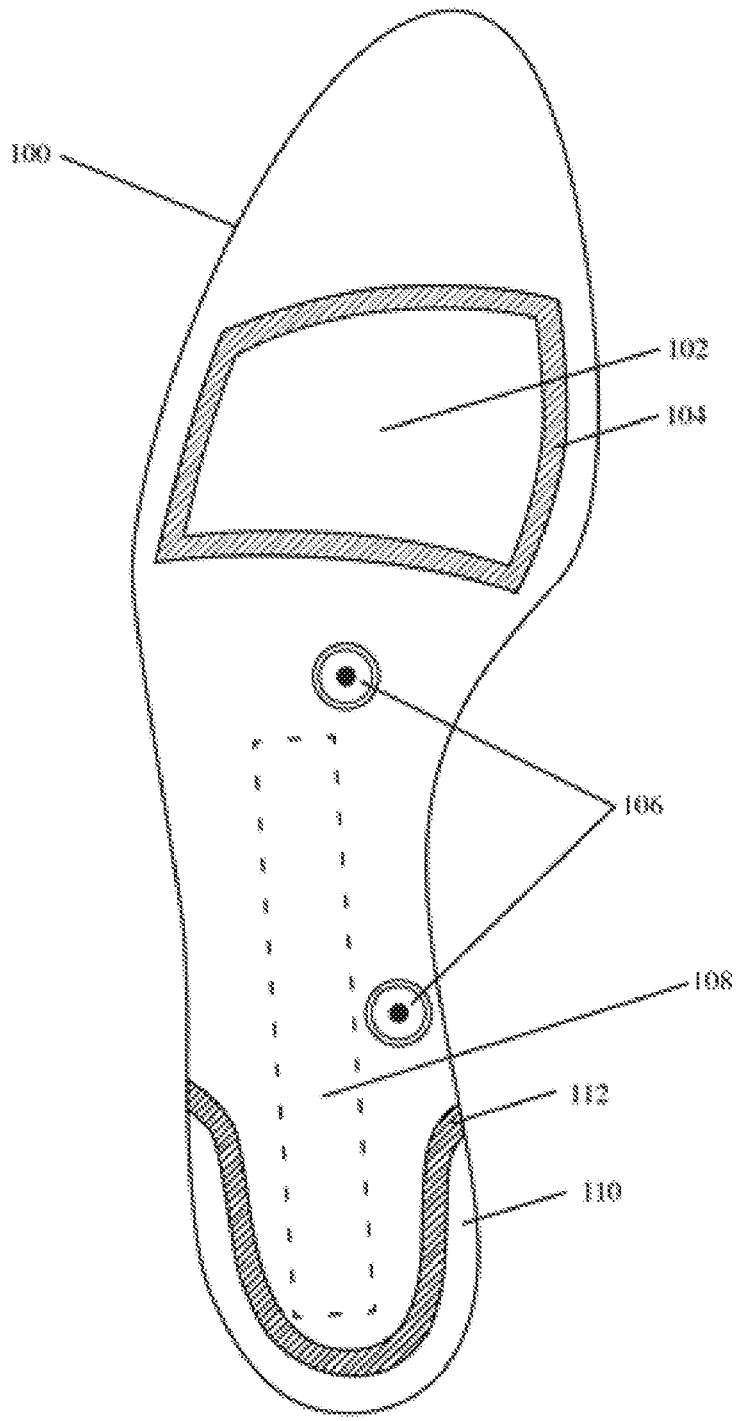
FIG. 1 shows a top view of the shoe insole of a customizable arch support system.

Now referring to the drawings, FIG. 1 shows a top view of one preferred embodiment of the shoe insole 100 of the customizable arch support system without an arch support insert attached, where the shoe insole 100 comprises at least one shank 108, where the shank 108 is encompassed within the shoe insole 100. The shank 108 is preferably configured and arranged so that it is imbedded and sandwiched between the layers of the shoe insole 100 of the customizable arch support system. Preferably the shank 108 is constructed from a metallic material, such as steel. Alternately preferably, the shank 108 may be constructed from aluminum. Alternately preferably, the shank 108 may be constructed form carbon fiber. Alternately preferably, the shank 108 may be constructed from reinforced fiberglass. Alternately preferably, the shank 108 may be constructed from injected molded plastic. Alternate material choices for the shank will be obvious to those skilled in the art.

The shoe insole 100 preferably has a cushioning material 102 affixed at the cushioning material's edges with beveled foam and adhesive 104 to the upper surface and positioned and configured so that it will be located under the ball of the wearer's foot when the shoe is on the wearer. Alternately preferably, the cushioning material 102 may be integrated into the customizable arch support system by sandwiching the cushioning material 102 between the layers that make up the shoe insole 100 of the customizable arch support system. Alternate cushioning materials will be obvious to those skilled in the art.

As further shown in FIG. 1, the shoe insole 100 of the customizable arch support system preferably further comprises an attachment means, preferably female half of snap fasteners 106 configured and arranged such that they are located under the arch area of the wearer's foot. Alternately preferably, the attachment means may be the male half of snap fasteners. Alternately preferably, the attachment means may be the loop half of a hook and loop fastener system, such as VELCRO® hook and loop material. Alternately preferably, the attachment means may be the hook half of a hook and loop fastener system, such as VELCRO® hook and loop material. Alternate attachment means will be obvious to those skilled in the art.

As further shown in FIG. 1, the shoe insole 100 of the customizable arch support system preferably further comprises at least one cupped portion 110 located under a wearer's heel. In this preferred embodiment said cupped portion 110 is comprised of a cushioning plastic or polymer material. In this preferred embodiment, said customizable arch support system further comprises at least one cushioning means 102 under a ball of a wearer's foot. In this preferred embodiment, said cushioning means 102 is comprised of a gel material. The cupped portion 110 preferably comprises a cupped heel segment having an upper area and a contoured section 112, which transitions between the upper area and the upper surface located under the wearer's heel. Preferably, the cupped portion 110 is constructed using gel or urethane foam. Alternately preferably, the cupped portion 110 is constructed using injection molded plastic material. Alternate material choices for the cupped portion 110 will be obvious to those skilled in the art.

Figure 2:
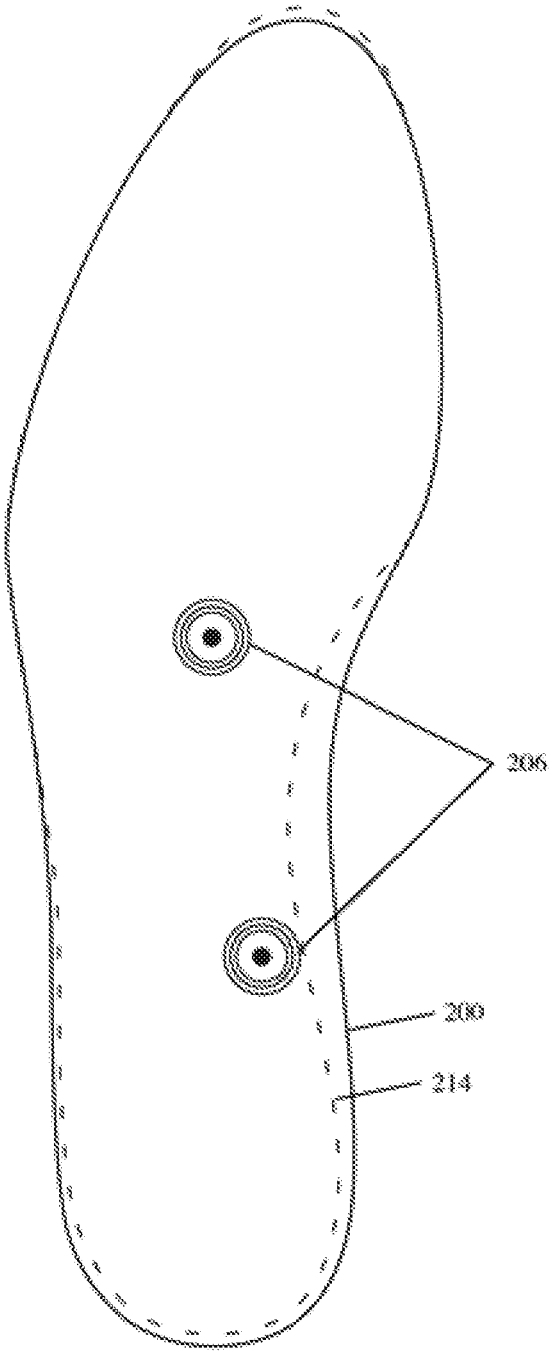
FIG. 2 shows a top view of the cover or sock lining exposing the female snap-type fasteners attached to the insole of the customizable arch support system.

As shown in FIG. 2, the shoe insole 200 of the customizable arch support system comprises a sock lining cover cut to expose the female half of the snap fasteners, but without an arch support insert attached. In this preferred embodiment, the lower surface of the female half of snap fasteners 206 are configured and arranged such that they are located under the arch area of the wearer's foot, and further extend from the upper surface to the lower surface of the shoe insole 200 of the customizable arch support system. Alternately preferably, the arch support insert can also be attached directly to the insole with the sock lining covering the arch support insert.

As further shown in FIG. 2, a shaped and contoured edge portion 214 is configured and arranged so that the shoe insole 200 of the customizable arch support system may have a tight fit, with low tolerances, within the wearer's shoe, so that the shoe insole 200 of the customizable arch support system does not easily slide or move within the wearer's shoe.

As shown in FIG. 3A through FIG. 3D, four different views of the arch support insert 352 which attaches to the shoe insole 100 of the customizable arch support system.

The arch support insert 352 has an upper surface 354 preferably contoured to match the arch of the wearer's foot. The preferable curve of the upper surface 354 of the arch support insert 352 can be observed more clearly from either side, as in FIG. 3C and FIG. 3D. The lower surface 356 of the arch support insert 352 is preferably contoured to match the inner shape of the wearer's shoe and the upper surface of the shoe insole 100 of the customizable arch support system.

Figure 3A:
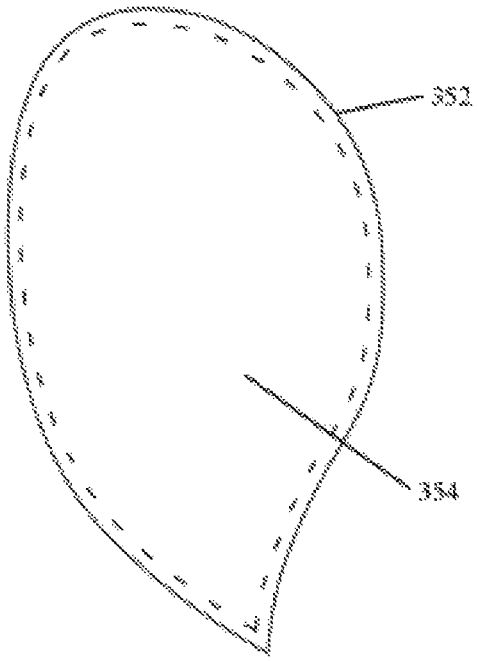
FIG. 3A is a top view of the arch support insert of the customizable arch support system.
Figure 3B:
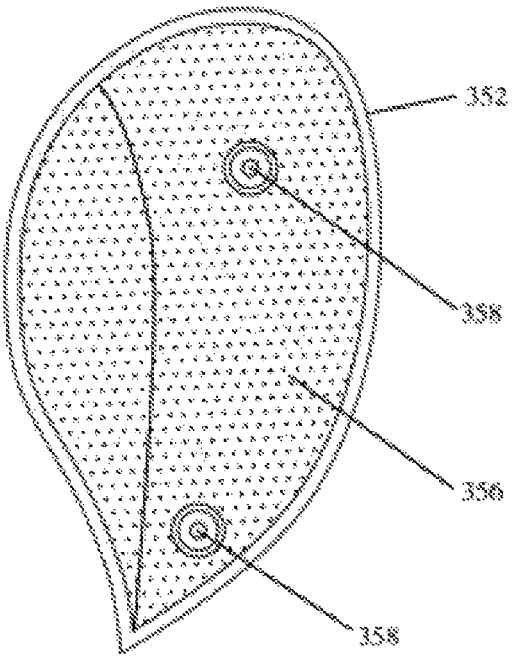
FIG. 3B is a bottom view of the arch support insert of the customizable arch support system.
Figure 3C:
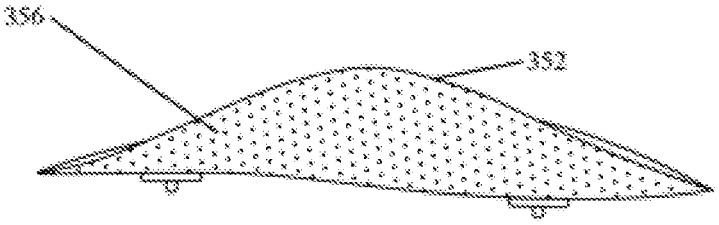
FIG. 3C is a side view of the arch support insert of the customizable arch support system.
Figure 3D:
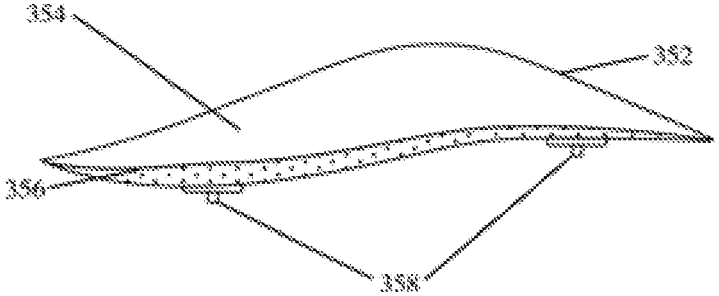
FIG. 3D is an alternate side view of the arch support insert of the customizable arch support system.

The male half of snap fasteners 358 are shown in FIG. 3B configured and arranged on the lower surface 356 of the arch support insert 352 so that they can be removably attached to the female half of snap fasteners 106 on the upper surface of the shoe insole 100 of the customizable arch support system.

Figure 4:
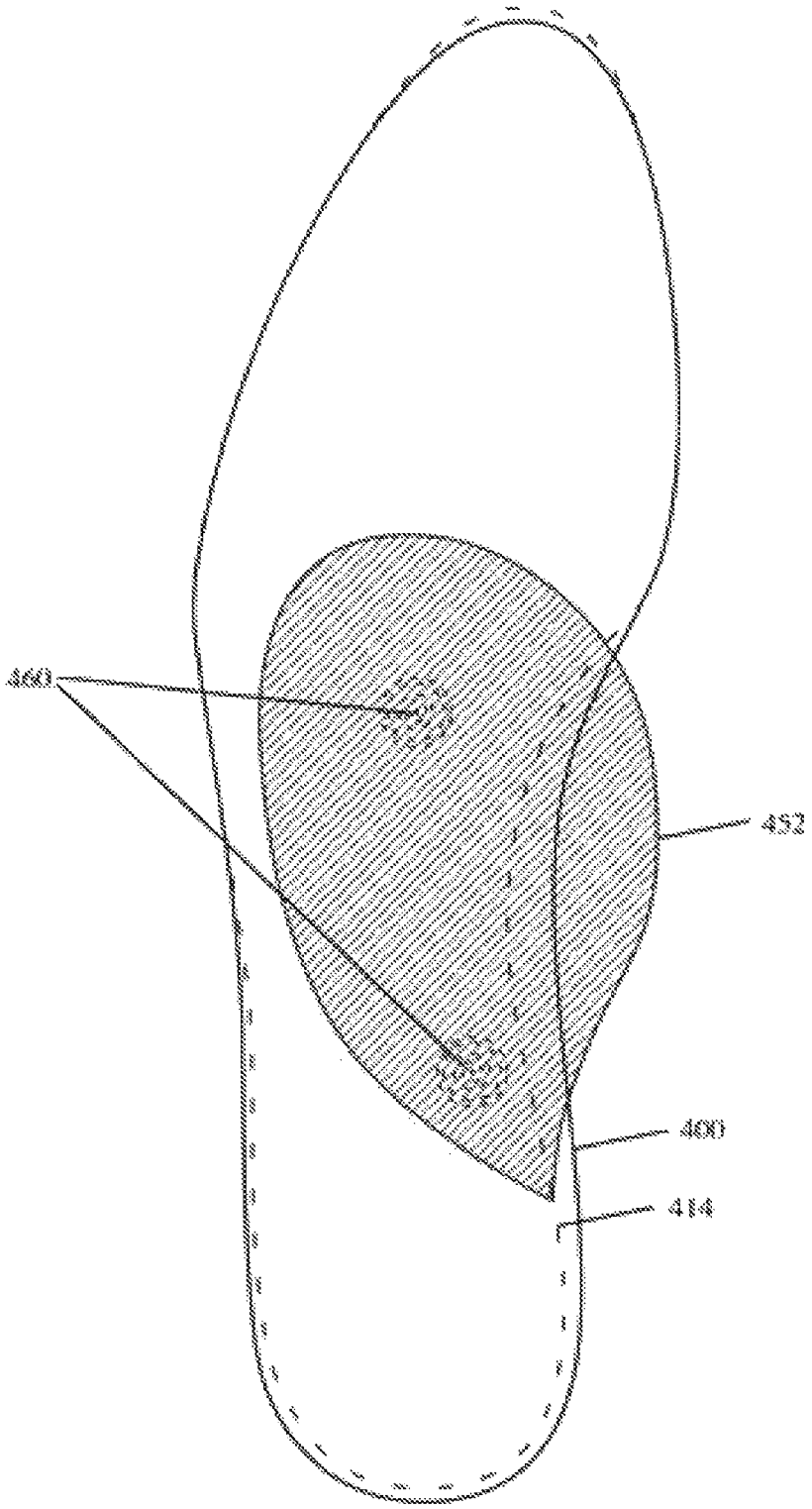
FIG. 4 is a top view of the customizable arch support insert system with the arch support insert fastened to the shoe insole.

As shown in FIG. 4, the customizable arch support system comprises at least one shoe insole 400, an arch support insert 452, where the arch support insert 452 is removably attached to the shoe insole 400 using at least one fastening means. In this preferred embodiment, the fastening means is preferably comprised of at least one connected snap 460. The connected snaps 460 shown in FIG. 4 are comprised of the fastened pair of snaps, being the male half of snap fasteners 358 as shown in FIG. 3B and the female half of snap fasteners 106 shown in FIG. 1. FIG. 4 further illustrates the shaped and contoured edge portion 414 which is configured and arranged on the lower surface of the shoe insole 400. Alternately preferably, the fastening means is comprised of a hook and loop fastening system.

Figure 5:
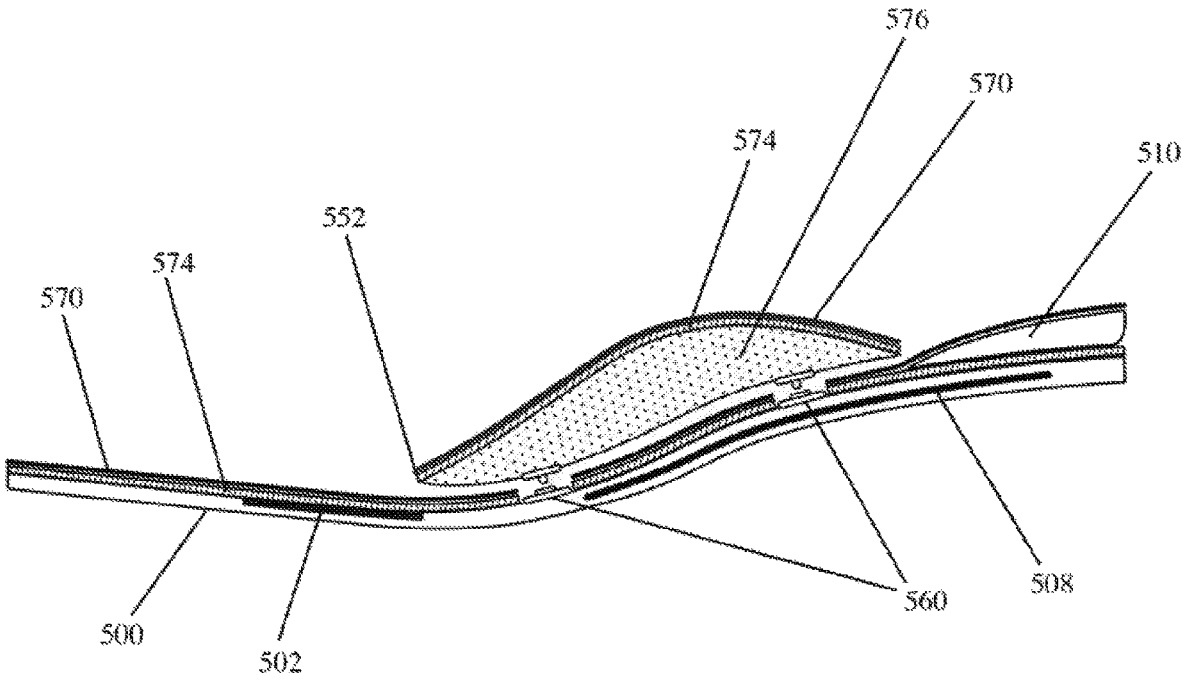
FIG. 5 is a cross section of the customizable arch support system.

As shown in FIG. 5, the customizable arch support system further comprises at least one cover 570, where the cover 570 is placed over the arch support insert 552. Alternately preferably, the cover 570 envelopes the arch support insert 552. In this preferred embodiment, the cover 570 is preferably comprised of a sheet of leather. Alternately preferably, the cover 570 may be made of a sheet of light weight synthetic material. Alternate material choices for the cover 570 will be obvious to those skilled in the art.

As further shown in FIG. 5, the lower layer is comprised of the shoe insole 500, further comprising a shank 508, a cupped heel portion 510, and a cushioning portion 502. The arch support insert 552 is removably attached to the shoe insole 500 by a fastening means. The fastening means used to removably attach the shoe insole 500 to the arch support insert 552 is preferably comprised of a snap mechanism 560. The arch support insert 552 is preferably comprised of two bonded layers, a lower layer 576 made from a compressible material with high density and low compressibility, and an upper layer 574 made from a compressible material with low density and high compressibility. Alternately preferably, the arch support insert 552 can also made of one layer of compressible material. Alternately preferably, the arch support insert 552 can be fabricated using additive manufacturing and 3D scanning technology to customize an arch support insert 552 to exactly match a wearer's mid-foot arch.

In other preferred embodiments, the compressibility of the upper and lower layers of the arch support insert 552 may be reversed, wherein the upper layer 574 is less compressible than the lower layer 576. In another preferred embodiment, the arch support insert 552 may have an upper layer 574 made from urethane foam and a lower layer 576 made from a polymer material. In another preferred embodiment, the shoe insole 500 may be made from fiberboard. In another preferred embodiment, the shoe insole 500 may be constructed using an additive manufacturing process, commonly referred to as 3D printing, using a combination of shock-absorbing materials. In another preferred embodiment, the snap mechanism 560 may be affixed to the arch support insert 552 using synthetic tape. Alternate material choices for components of the customizable arch support insole system will be obvious to those skilled in the art.

Further, the present invention relates to a method of customizing the arch support in a heeled shoe preferably comprising the steps of: selecting an arch support insert closely matching a wearer's mid-foot arch 352, fastening the arch support insert into the wearer's shoe, and placing a cover 570 over the arch support insert. Alternately preferably, the arch support insert is positioned inside the cover prior to fastening the arch support insert into the wearer's shoe.

Additional Embodiments

In one embodiment, aspects of the present invention add removable arch supports or other orthotic on top of the sock liner cover to customize the shoe to the wearer and improve the appearance of supportive shoes. In some iterations, the arch support or heel appliance fits under the sock liner and the sock liner functions as the cover of the inserts. The user can choose from many heights of arch supports, a custom-made arch support, orthotic, footbed or none at all. The shoe appears and functions like any other shoe and can be worn without the inserts, but comfort is enhanced when adding an arch support or orthotic to a shoe.

The shoe can be further customized by the addition of a heel cup, heel pad or sizing aid which attaches to the inside of the shoe on the sock liner through embedded magnets or hardware in the insole and corresponding magnets or hardware in the heel cup, heel pad or sizing aid.

The lateral arch supports could be used alone or a standard full length footbed or orthotic or ¾ orthotic could be used. The heel cup could be used alone or with the lateral arch supports. The shoes can be made with or without magnets or hardware in the heel area or under the arch.

The construction of the insole, midsole or outsole of the shoe is adapted to accommodate a variety of inserts (or no insert). This system can be used in any type or shoe.

The insole refers to the formed structure which an integral part the shoe of a crimped shank and cellulose which conforms to the bottom of the shoe last, on which the upper of the shoe and outsole is attached. The insole is part of the shoe, forms the structure of bottom and interior of the shoe to which the footbed and outsole is attached. The shank gives strength to hold the weight of the body and prevents the shoe from twisting. It is made of metal, fiberglass, plastic, carbon or other materials The term "insole" is sometimes used to describe a removable footbed the covers the bottom of the interior of the shoe. For purposes of the current application, "foot bed" will be used to describe this cushioned addition to the shoe.

The materials used for the arch supports, orthotics, heel appliances, footbeds, midsole or outsoles can be manufactured and customized in any combination or materials that achieves the hardness, softness or durability desired for the application. The materials used, but are not limited to: gels, foam, polymers used in additive printing technology (3D Printing), polyurethanes, TPU, EVA, silicone, rubber, vulcanized rubber, light curing polymers, two-part epoxies or resin or silicone or other state of the art materials. As of this writing, polymers of different levels of softness and metal can be printed together.

The undersides of the arch supports are made to conform to a particular last's pitch and "footprint" but can be altered to fit other lasts through casting or digital comparison of two different styles of the lasts with the same heel height.

Material can be removed or added to both the top and bottom profiles of the inserts for a signature fit of the brand.

Different lengths and widths of the insert can be made, depending on the type of shoe the insert is made for. The hardware or magnets can be in any configuration or number.

The variations in last shapes and foot shapes make it difficult to create a one size fits all solution for adding an arch support for shoes. Shoes are made for the volume of the foot, not the volume of the foot, plus an orthotic. The space in the thickness of the insole and/or outsole is limited for attachment methods of an orthotic insole.

The sheer force of the foot pressing forward in the shoe cause adhesives on a flat surface to fail and attract debris to the adhesive residue. Hook and loop methods also attract debris and are usually attached to the insert by adhesives, which also typically fail. (Hook and loop material such as VELCRO® has thickness that is not accounted for in the Hung reference as shown in U.S. Patent Application Publication Number 2017/0295884. The VELCRO® hook and loop material is attached to the sock liner and can lift from the sheer force of the foot.)

The placement of the insert in the shoe needs to be precise to fit properly. European half sizes are graduated by 3.3 mm per half size, so placement needs to be precise. Hook and loop and adhesive attachment of the arch support are difficult to position and difficult to maintain the position without some kid of barrier or firm attachment means like hardware, to prevent forward movement.

Neodymium magnets are very strong and are the preferred method of attachment because of their small size and precise axial pull force. Moving the magnet into a "cup" which protrudes at the bottom of the insert, lets the magnet sit in a corresponding or registering void in the insert. The void in the insert helps keep the insert from moving or shifting forward. The recessed magnets in the insole (or the insert) also keeps the magnets or hardware from being felt by the foot. A larger protuberance on the underside of the insert can fit in a deeper void in the insole and vice versa. Magnets, adhesives, hook and loop, can be used in the holes/protuberances after fitting the arch support or heel insert to the foot. The voids will then be sealed from debris.

This system is designed for all methods of manufacturing. A standard insole or ¾ orthotic can be adapted by adding hardware or magnets or the insole specially made to accommodate the attachment method. Inserts and other parts can be made by injection molding, poured molding, two-part epoxies, silicone or resin, silicone, polyurethane or other urethanes, custom 3D printing of inserts/orthotics, light curing polymers. The system can be adapted to the lasts of other manufacturers through digital scanning and addition or reduction of the bottom of the insert to conform to their lasts without re-tooling.

The top of the insert can be covered with leather or fabric or left unfinished. An insert or heel pad can be slid into a pocket covering, like a pillow cover, or into a pocket in the in the insole.

For the elastic pocket in the insole variation, the ideal attachment method is magnets to firmly attach the insert to the insole inside the pocket. The opening of the pocket in the insole could be a simple slit, flap or separate piece, patch pocket, relying on the elasticity of the stretch leather, mesh, polymers or fabric sock covering to keep the pocket partially closed. The edge of the opening may have elastic stitched at the opening edge to keep the pocket shut or a small snap with recessed parts or recessed piece of hook and loop.

Another adaptation is a side opening pocket or "lean to". The stretch lining or sock liner is attached to the lateral side of the insole and open on the medial side. The arch support or heel pad can be slipped under the sock liner and secured to the medial side of the shoe with hook and loop or other flat profiled hardware. The insert can be secure by magnets or the other attachment methods shown. In this iteration, hook and loop or adhesives can be used also.

The space for the insert could be further confined by gluing the area not holding the insert or using a flat stud pattern on the periphery of insert to keep it from moving around under the covering without an attachment means.

For purposes of the present application, embodiments of the present invention apply to various items of footwear, including, but not limited to shoes, sandals, boots, flip-flops, sneakers, running shoes, athletic shoes, aqua socks, water shoes, snowshoes, ski boots, climbing shoes, and any other footwear that may be amenable to being customized to improve comfort and fit. Where the word "shoe" is utilized, it is envisioned to include such diverse items as footwear as well.

Figure 6:
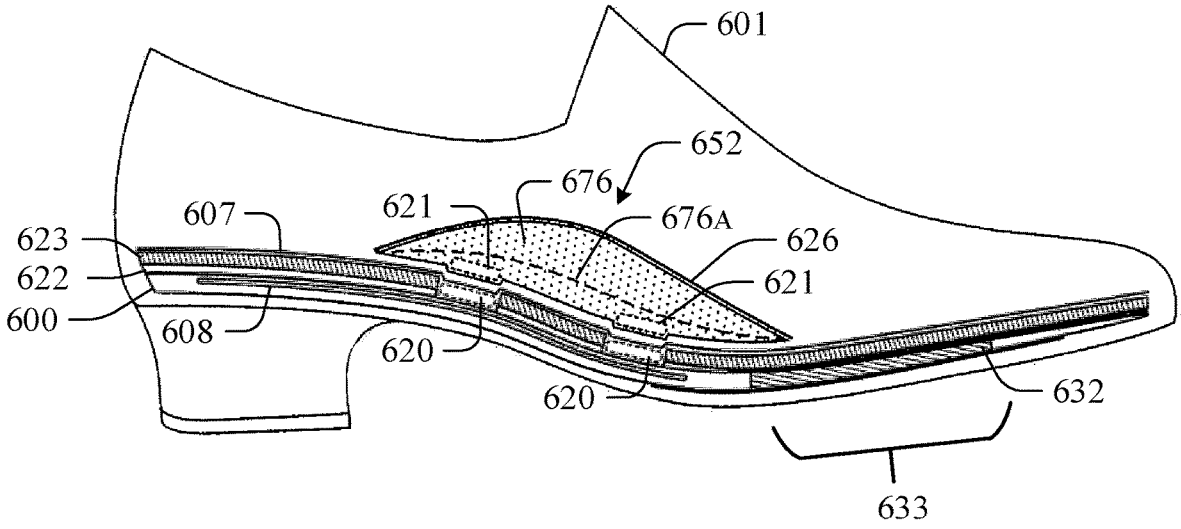
FIG. 6 shows a side view, in cross section of a footwear item as viewed from the lateral side.

FIG. 6 illustrates a cross-section of a shoe 601 medial insole construction, showing with an insert 652 placed in the shoe 601. In this illustration, to ease interpretation, while the shoe 601 is shown in cross section, the insert 652 is shown with a portion that rises up in to the shoe against the foot, not in true cross section. Further, the figure illustrates a dotted line 676A that may represent an area of the arch support/insert that goes against the foot into the upper of the shoe. An insole 600, such as may be comprised of any appropriate material, and preferably cellulose, includes a supporting shank 608 that is shaped to a bottom profile of a last that was selected for manufacture of the shoe 600. The insole 600 includes one or more insole magnets 620 (such as those constructed neodymium or other appropriate material) attached to a sub-layer of the insole material. The insole magnets 620 may be attached by any desired means, such as by gluing into respective cavities in the insole 600, or attaching directly or indirectly to the shank 608 (such as by gluing or by magnetic attraction). Insole magnets 620 are respectively installed with a magnetic polarity respectively opposite to insert magnets 621, and are also disposed in such a pattern to substantially align with insert magnets 621 in a similar pattern to the insert magnets 621 disposed on or within the insert 652.

Figure 7A:
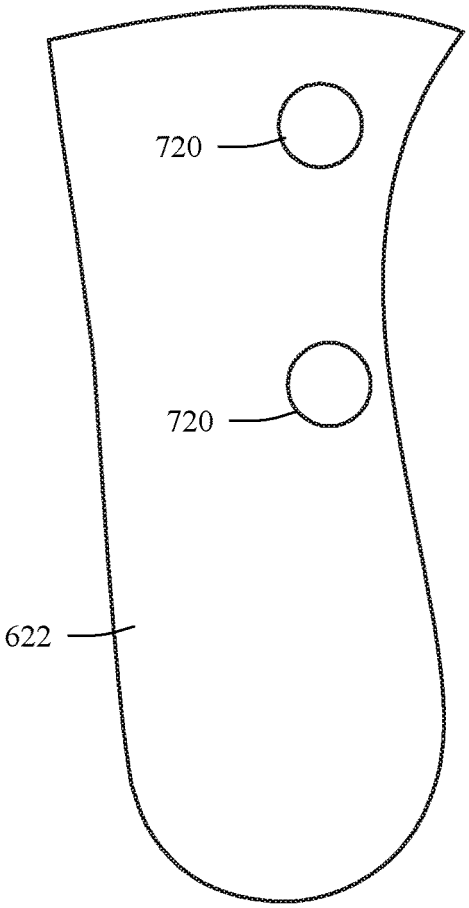
FIGS. 7A and 7B illustrates a patterned material 622 (such as cellulose) for magnet placement and spacing.
Figure 7B:
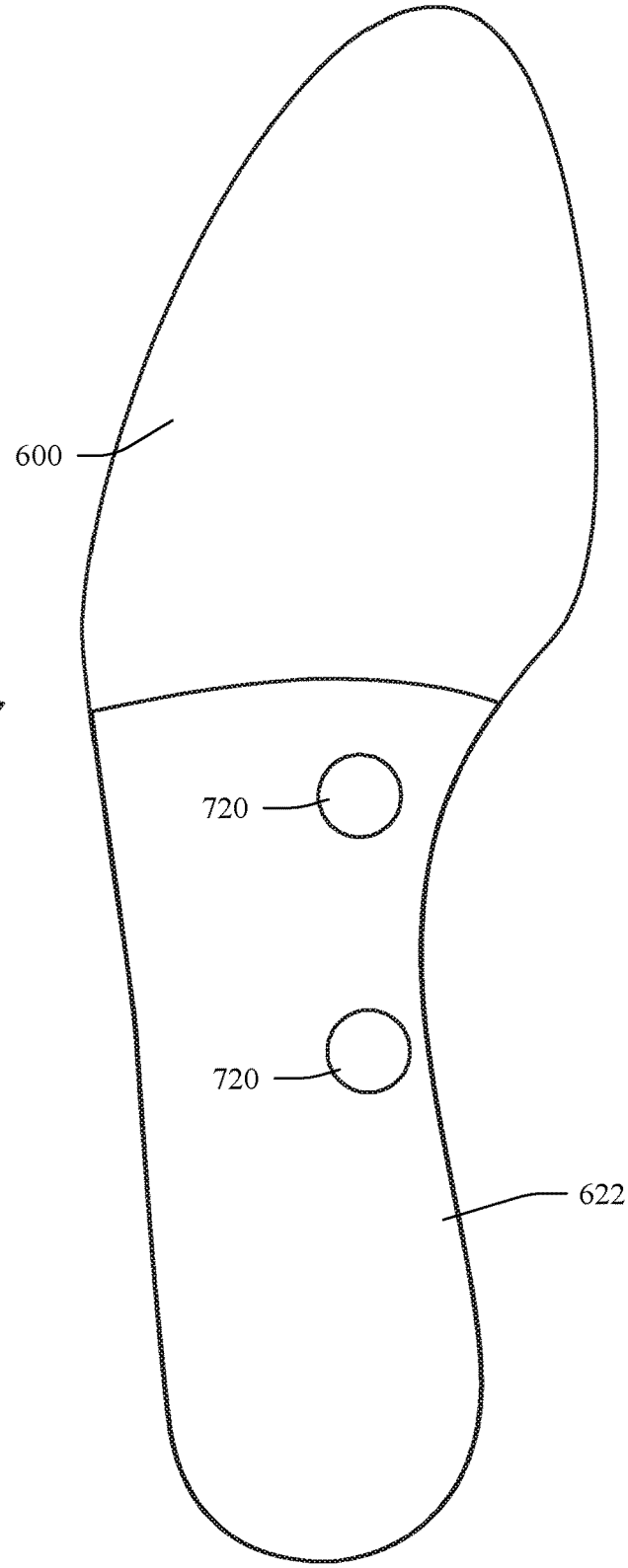

In one embodiment, a method of manufacture includes preparing a patterned material 622 (such as one formed from cellulose) with voids to align the insole magnets 620 in position. FIGS. 7A and 7B illustrate a plan view of the patterned material 622, to be bonded to the insole 600 to form a top layer. Insole magnets 620 are attached by glue or magnetic force in the voids 720 to the new sublayer. Voids are similarly cut in the cushioning layer 623 (which may be comprised of any desired cushioning material such as foam or gel) in substantially the same pattern as selected for installation of the insole magnets 620 (an exemplary void pattern is shown in plan view on FIGS. 7A and 7B). A sock liner (or cover) 607 covers the cushion 623 and insole magnets 620, keeping the insole magnets 620 from being exposed or pulling out of the shoe 601, especially when placed in proximity to the respective insert magnets 621 in the underside of the insert 652.

Figure 14A:
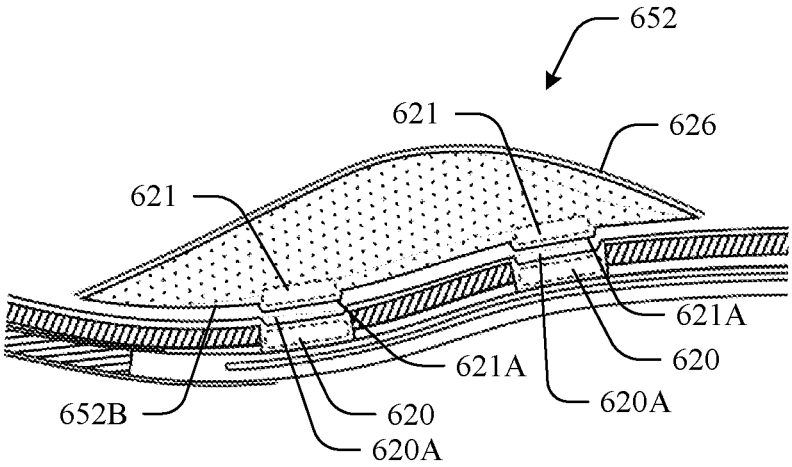
FIGS. 14A-14H illustrate variations to attach or insert magnets in inserts of the present invention.

In certain embodiments, the insert 652 includes a thin flexible cover 626 of leather or other flexible material attached to a top surface of the insert 626, which in turn will be placed proximate the sole of the foot of a wearer when the wearer's shoe is inserted. In one embodiment shown, the insert 652 will be disposed approximately near the wearer's lateral foot arch. In an alternate embodiment, there may be a layer of a padded material such as gel or foam (not shown) disposed between the insert lower layer 676 and cover 626. In other embodiments, the insert 652 may be formed without a cover 626, and in some instances, such as may be the case for a submersible shoe, it would be desirable for the insert 652 to be uncovered. For further example, FIGS. 1 and 14A show the insert 652 with a cover 626, other illustrations (such as those in FIGS. 14B-14H) illustrate the insert 652 without a cover 626.

The insert 652 is preferably constructed from a soft polymer, silicone, or other moldable material or combination of padding and foam to equal the hardness or performance of Shore A 40 to 50. The angle of the medial curve of the insert 676 is variable and can be changed to match an interior curve of the last and the foot of the wearer as desired during the molding process.

Protrusions (see, e.g. FIG. 14A, 621A) formed on an underside (see, e.g., FIG. 14A, 652B) of the insert 652 contain magnets 621 inserted at a depth which can firmly attach to the insert magnets 621 in the shoe/insole. The protrusions 621A with respectively included insert magnets 621 are respectively registered with and engage within recesses 620A, and the insert 652 is held in place by respective magnetic attraction between insert magnets 621 and insole magnets 620, bolstered by additional mechanical friction between the surfaces of the respective protrusions 621A and recesses 620A; in such a manner, the engagement between the protrusions 621A and recesses 620A help keep the insert 652 and the foot from shifting forward toward the toes in normal wear.

A foam layer 623 under the sock liner 607 adds resiliency in the shoe 601 and the insert 652 when walking. In various embodiments, gel and/or foam is injected into the forefoot area 633 creating a forefoot pad 632 of the insole 600 to cushion the wearer's forefoot.

As mentioned above, FIGS. 7A and 7B illustrates a patterned material 622 (such as cellulose) for magnet placement and spacing. More particularly, FIG. 7B illustrates the attachment of the patterned material 622 to the top of an insole 600 after adhesion. In one embodiment, the material 622 has a thickness of about 2 mm, or any appropriate depth chosen to assist with preventing the insole magnets 620 from shifting when located within the openings/voids 720. The selected pattern of the openings/voids 720 places insole magnets 620, and therefore the insert magnets 621, in correct alignment to position the insert 652 correctly within the shoe 601; further, material 622 along with the patterns of the openings/voids 720 is graded and scaled for the size of the shoe. Although two openings/voids and insole magnets 620 are shown for each of the exemplary embodiments, fewer or more voids/magnets may be used as desired to achieve improved adhesion.

Figure 8A:
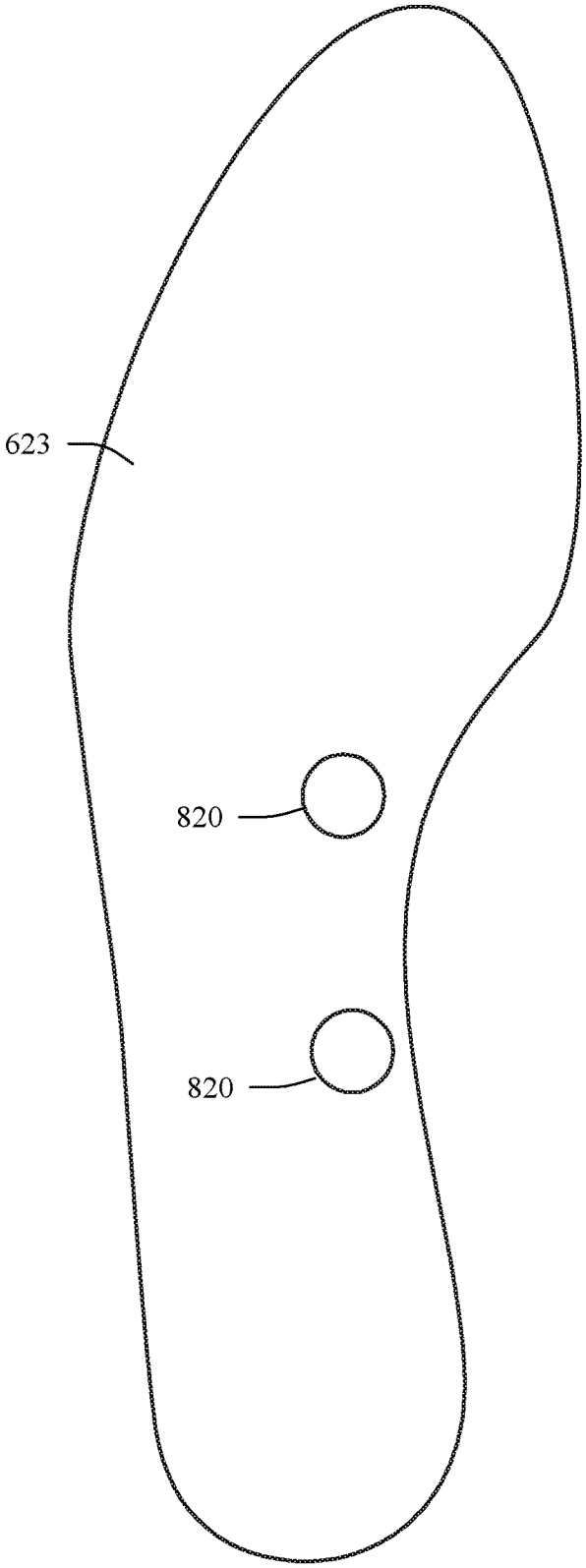
FIG. 8A shows in plan view the cushioning layer 623 shown in FIG. 6.
Figure 8B:
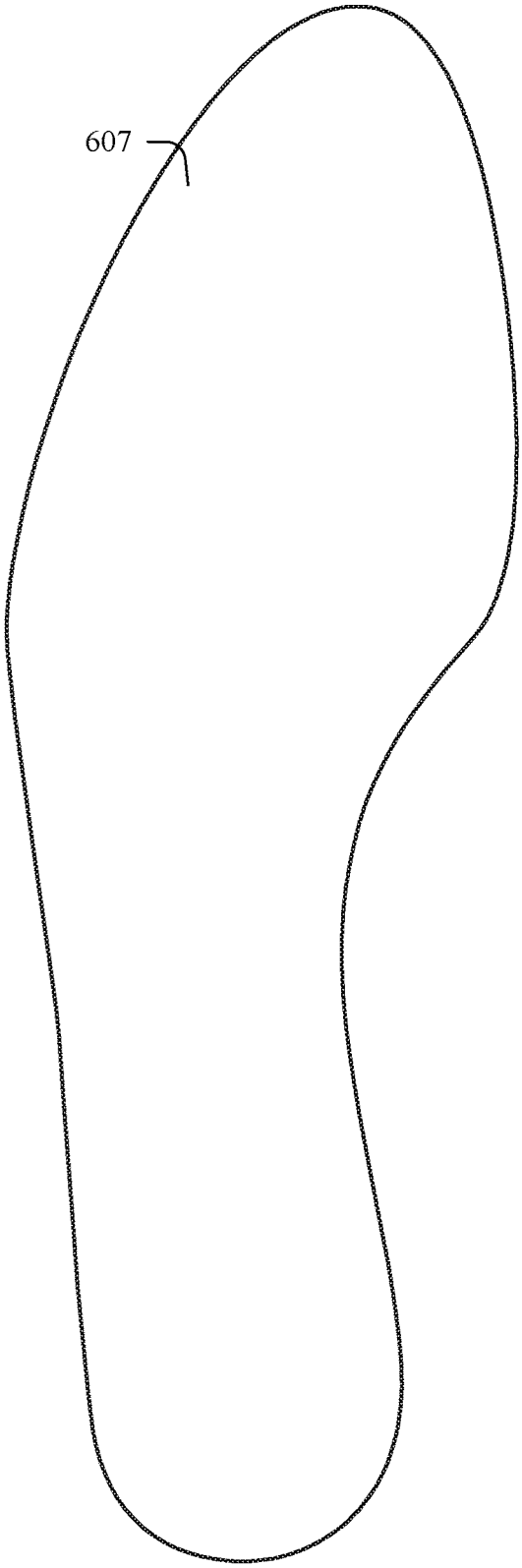
FIG. 8B shows in plan view the sock liner/cover 607 shown in FIG. 6.

FIG. 8A shows in plan view the cushioning layer 623 shown in FIG. 6. Likewise, FIG. 8B shows in plan view the sock liner/cover 607 shown in FIG. 6. As shown in FIG. 6, the cushioning layer 623 would be placed on top of the patterned material 622 and registered so that openings/voids 820 are respectively registered with openings/voids 720 in FIG. 7, and correspondingly to insole magnets 620. As shown in cross section in FIG. 6, the sock liner 607 is placed on top of the cushion layer 623, enclosing the insole magnets 620 as discussed above. In alternate embodiments, the sock liner/cover 607 may be integral to the cushion layer 623, or may be otherwise omitted.

Figure 9A:
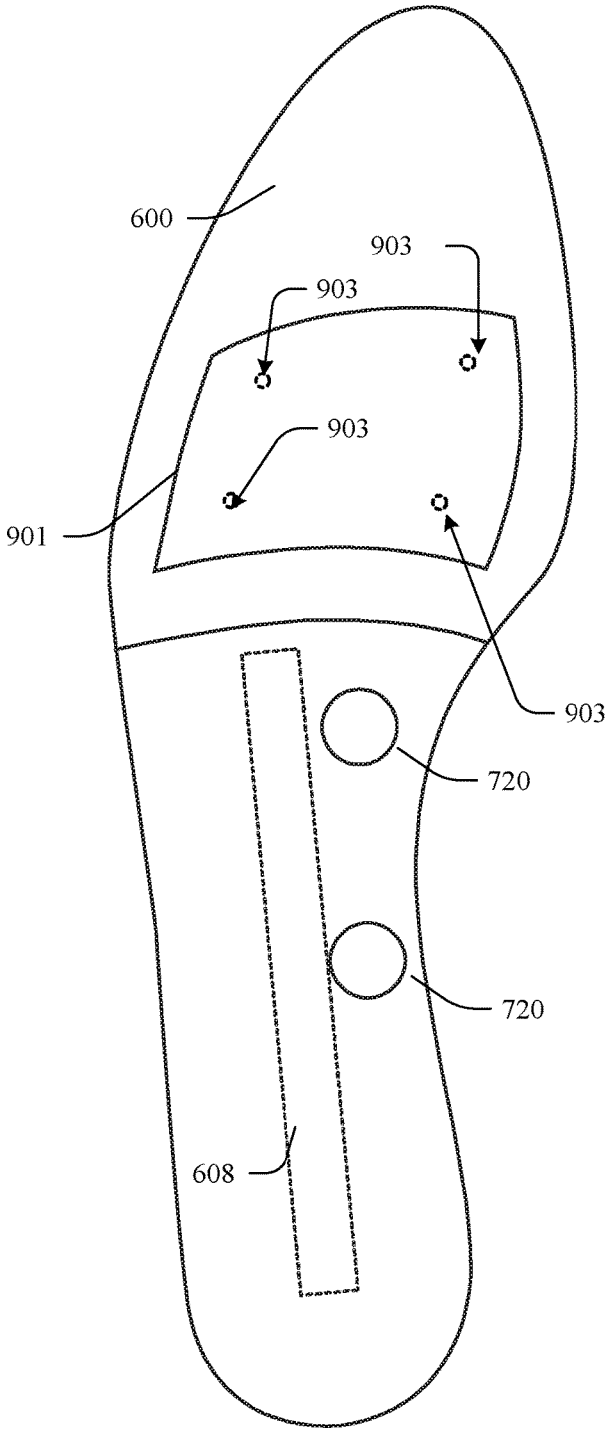
FIGS. 9A and 9B illustrate plan views (from top) of partially assembled insoles 600 in plan view respectively indicating two shapes of gel injection
Figure 9B:
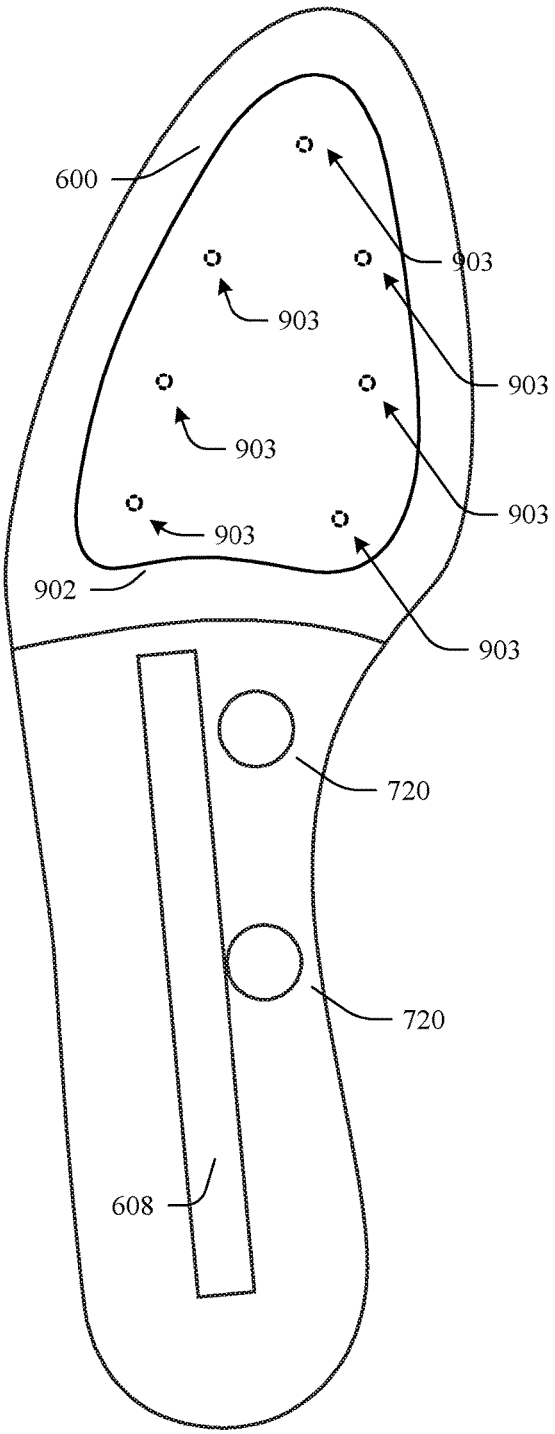

FIGS. 9A and 9B illustrate plan views (from top) of partially assembled insoles 600 in plan view respectively indicating two shapes of gel injection (901, 902) under pliable covers. A gel/foam is injected between a pliable top cover and a harder cover (e.g. cellulose) on the underside area proximate the insole 600 (see, e.g., FIG. 10) forming a void to hold the gel. A smooth and even surface is created on the top surface (proximate location of the wearer's foot) and the foam and gel material bonds with the insole 600 material (e.g. cellulose) and bottom cover to prevent shifting during insertion/retraction of the foot into the shoe 601 and during normal use. The injection points 903 in the underside are indicated by dotted lines in FIGS. 9A, 9B. In various embodiments, Different Shore A hardnesses for injection material in the region under the ball of the foot, toe, metatarsal heads, etc. A shank 608 is indicated for reference in plan view. In various embodiments, the shank 608 can comprise different widths, which creates an additional inventive feature as discussed in regards to FIG. 10. Openings/voids 720 for the insole magnets 620 are also shown with an exemplary placement pattern.

Figure 10:
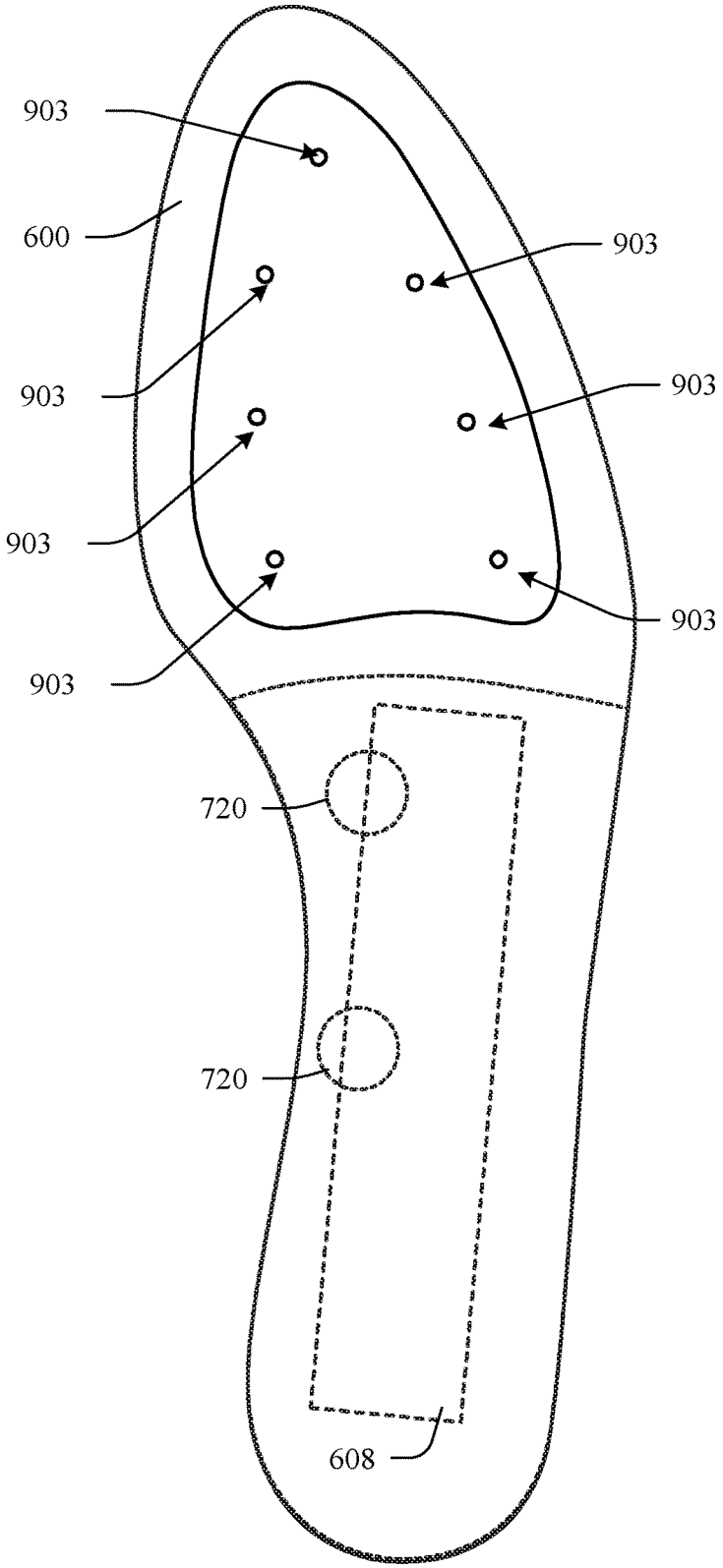
FIG. 10 shows another aspect of an insole of the present invention.

FIG. 10 shows another aspect of an insole of the present invention, depicting a plan view of an underside of the insole 600, indicating a cover (e.g. cellulose) and injection points 903 through the insole cover. A slightly larger cover forms a ledge that the gel/foam adheres to the insole. Further, FIG. 10 depicts a wider shank 608 than those shown in regards to FIGS. 9A and 9B. Openings/voids 720 for the insole magnets 620 are also shown with an exemplary placement pattern.

Figure 11:
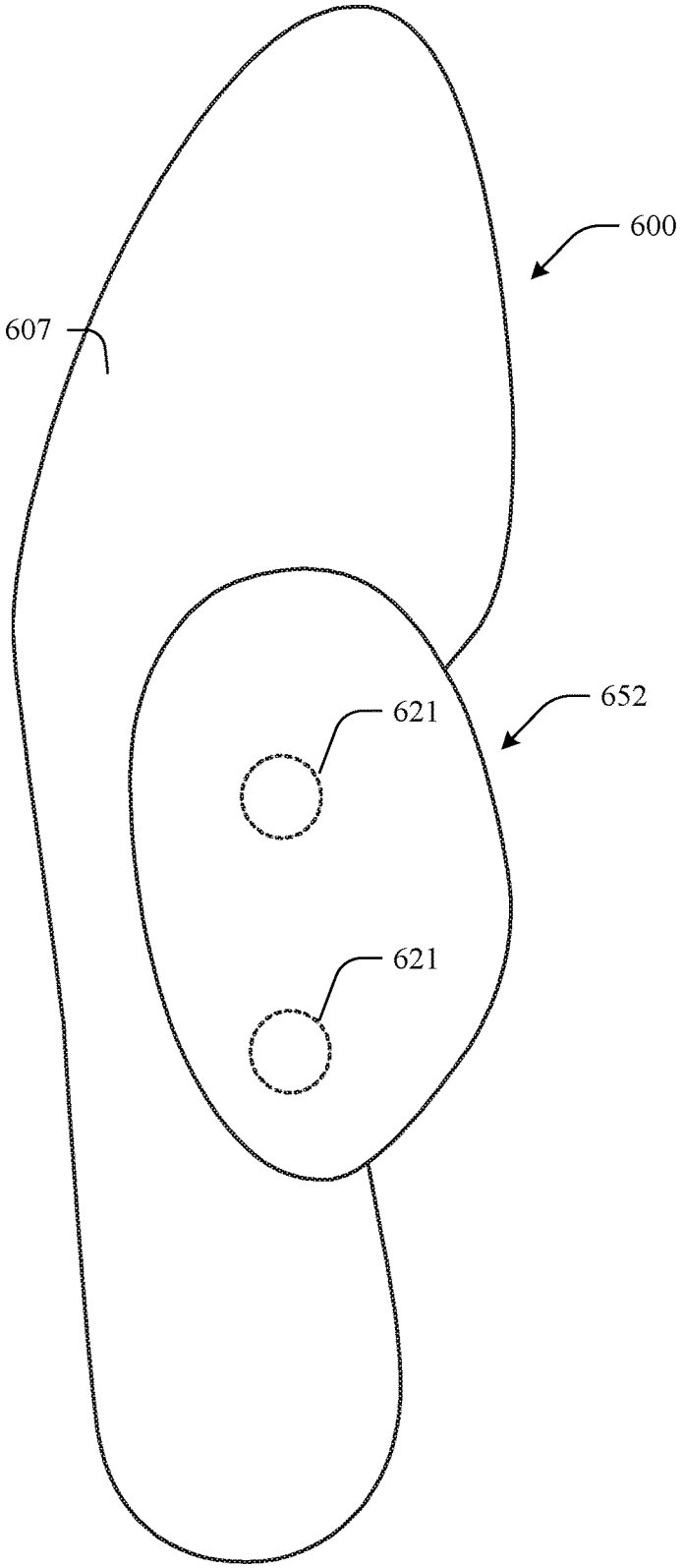
FIG. 11 illustrates a top plan view of covered insert on an insole.

FIG. 11 illustrates a top plan view of covered insert 652 on the insole (with sock liner/cover 607 installed) as the insert 652 would be placed in a shoe. Dotted lines indicate the top view of the insert magnets 621 (or alternative mounting hardware) in an exemplary placement. Although shown as roughly cylindrical in shape with a circular outline, the magnets 621 or mounting hardware could be any desired shapes (in horizontal section): circle, triangle, square, oval, rectangular, etc. The attachment arrangement of the hardware or magnets can be any shape or pattern as desired to maintain attachment of the insert 652 within the shoe. While two attachment areas for magnets 621 are shown, in an additional embodiment, the insert 652 and insole 600 registrations could be achieved through use of small magnets placed in the outline or perimeter of the insert 652 or a completely arbitrary pattern.

The insert 652 is made of a firm, but flexible, polymer or other cushioning material in approximately Shore A 40-50. The softness can also depend on whether a foam layer of other padding is added is added to the top of the insert. In various embodiments, all surfaces are curved to fit the arch of the foot and the shoe.

FIGS. 12A and 12B respectively show inserts 652 from a bottom and top plan view. Further, FIGS. 12A and 12B respectively depict left insert top and bottom views with cylindrical openings for magnet insertion.

FIG. 12C illustrates a cross section of a left shoe 601 from the rear to show the placement of the insert 652 in a shoe.

In various embodiments, some methods of manufacture include, but are not limited to, poured molding, 3D printing, light curing polymers, injection molding methods and other techniques, depending on materials used. Some of these techniques require a cylindrical opening on the top (area closest to the sole of the foot) to insert the magnets. The opening is later over molded or filled in some way to not be felt under the foot.

Figure 12D:
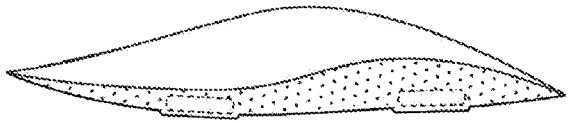
FIGS. 12D-E, illustrate different isometric views of inserts of the present invention.
Figure 12E:
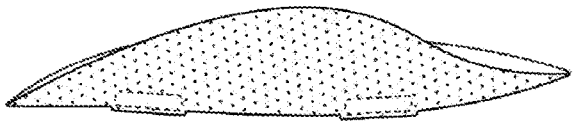
Figure 12F:
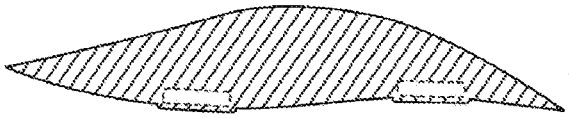
FIGS. 12F-J, illustrate alternative views of inserts of the present invention.
Figure 12G:
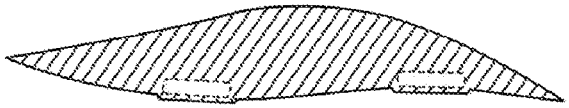
Figure 12H:
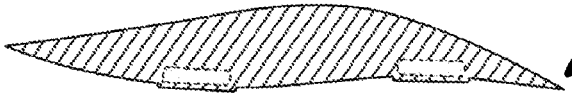
Figure 12I:
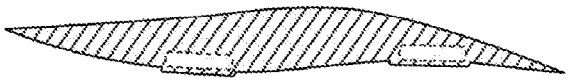
Figure 12J:
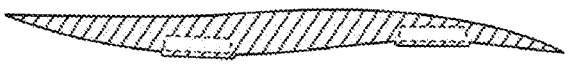

In FIGS. 12D-E, different isometric views of inserts 652 are presented, along with cross sections of various shapes of inserts with magnets or metal discs in the inserts in FIGS. 12F-12J. Other embodiments, discussed later, illustrate alternate methods of attachment. In FIGS. 12D and 12E, the bottom, or underside of the insert 652 which is disposed in the sock liner and lining of the shoe, is indicated by dotted shading. The cross sections of the inserts 652 shown in FIGS. 12F-12-J have diagonal lines. The cross section shows some examples of different arch heights and configurations, but inserts of the present invention are not limited to these shapes and heights. The shapes illustrate embodiments that address an element of foot physiology and geometry of the shoe, that is, a person's arch becomes higher and shorter in length as the heel height increases. Further, the exact arch height might change slightly because of a shoe brand's last configurations.

Further, FIG. 12D illustrates a lateral side view of the insert; due to the thinness of the insert at the lateral edges, the insert magnets protrude below the insert to have enough of the soft material above it to not be felt under the foot. The shape of the insert has concave and convex planes which conform to both the inside of the shoe and the arch of the foot. FIG. 12E illustrates a medial side view of the insert.

Figures 13C, 13D:
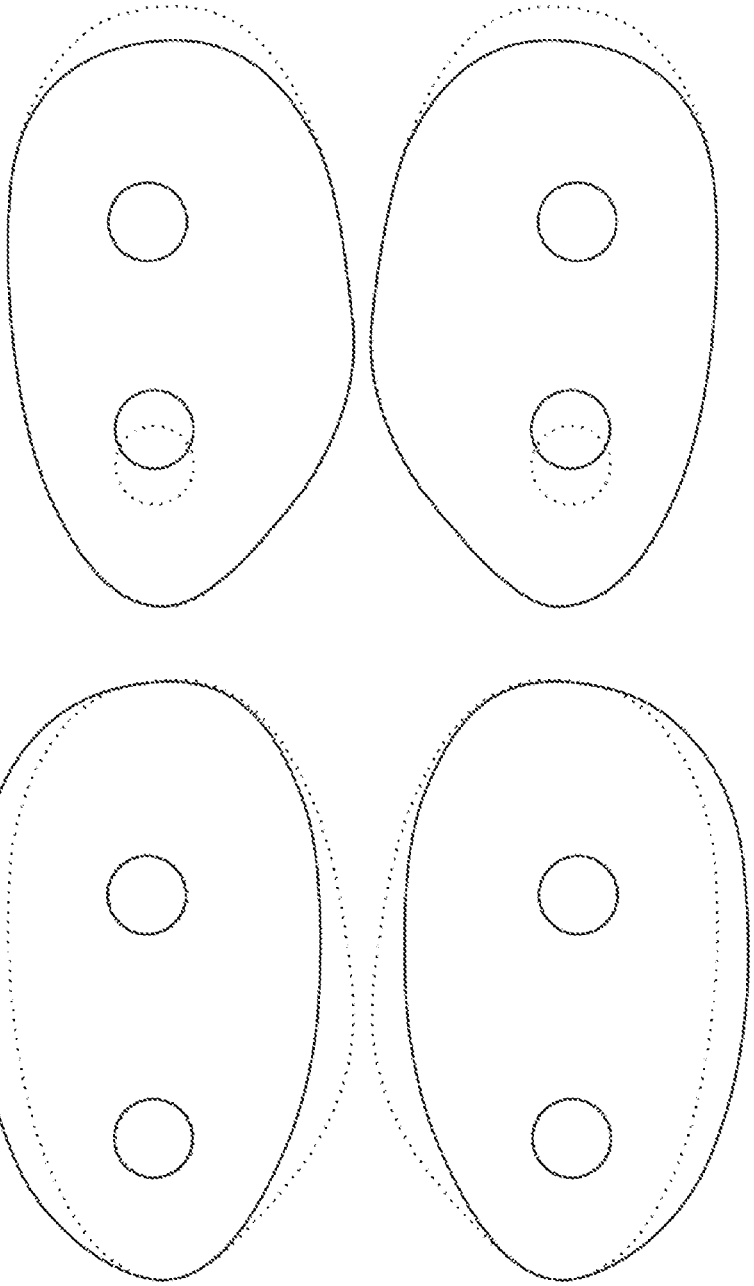
FIGS. 13C and 13D respectively show top plan views of pairs of inserts of different lengths and shapes.

FIGS. 13A and 13B respectively show top plan views of pairs of inserts of different lengths and shapes with circular hardware with cylindrical openings indicated. Further, FIGS. 13C and 13D show respective left and right inserts, and how the inserts 652 can be changed in several ways: magnets moved, metatarsal support reduced, insert widened. Inserts can be shortened at the bottom magnet, a cut out for the big toe joint (ballerina pad), lengthened to include a metatarsal pad, etc., depending on the type of shoe. For comparison, the dotted lines in FIGS. 13C and 13D indicate the shape of the other inserts in comparison.

FIGS. 14A-14H illustrate variations to attach or insert magnets 621 in inserts 652.

FIG. 14A illustrates a similar cross-section to that shown in FIG. 6. The insert 652 is shown with a cover 626 and the medial underside is showing. FIGS. 14B-14G are shown without a cover and in a cross section to simplify the drawings except for 14H. The inserts 652 can be made with a poured mold, 3D printing, injection molding, light cured polymer, or other methods.

Figure 14B:
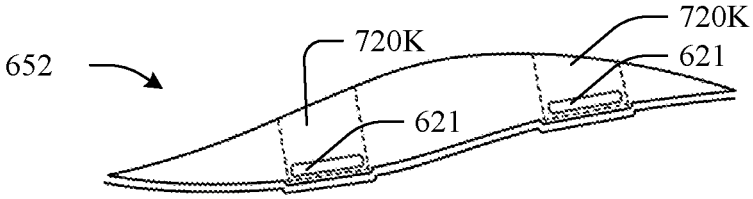

FIG. 14B shows cylindrical openings 720K (that could be any shape depending on the magnet or hardware shape) on the top of insert 652 to insert magnet 621 in the mold or part. The cylindrical opening is closed by over-molding, injection molding, a 3 D printed plug or other means. In the case of injection molding, a pin in the injection mold can hold the magnet or disc in the best position or distance from the underside to adhere to the magnet at the bottom of the shoe. The insert material covers the underside of the magnet. The mold may be constructed in any number of ways that may use a different method other that an opening at the top of the insert. In another embodiment shown in FIG. 14B1, another way to enclose and secure the magnet is by molding another piece to be fused to the top of the bottom insert piece, with cylindrical protuberances filling the holes in the bottom piece with the magnet or disc enclosed between the pieces in the cylinder. This top piece could be a lower Shore A value for additional softness against the foot.

Figure 14C:
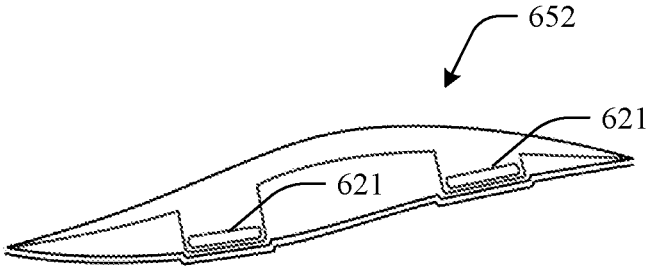
Figure 14C:
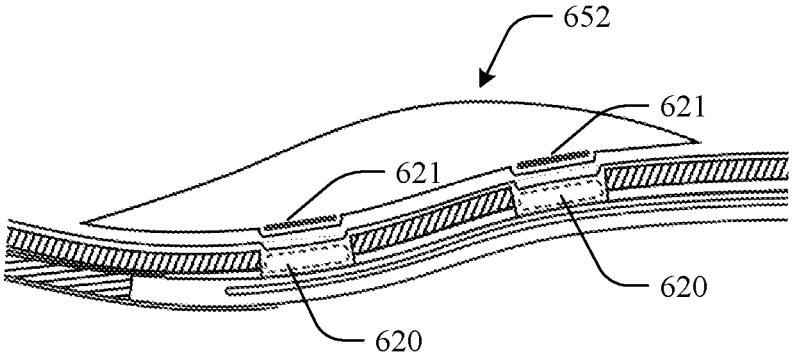

FIG. 14C shows that in some variations, a metal disc or washer can be inserted as illustrated in the arch support insert instead of a magnet. The inverse could be made also: magnet in the arch support and metallic disc in the insert.

Figure 14D:
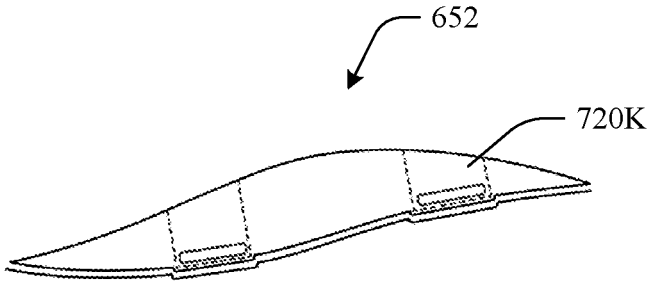

FIG. 14D shows cylindrical openings 720K formed in an in injection mold with fabric or other thin materials placed in the bottom of mold under the magnets to reinforce the magnet area in the bottom of the insert. (Fabric or other thin materials can also be placed over the magnets in the molds with insert material flowing underneath the magnets.) A molded piece, vacuum formed to the magnets, or thermoplastic material with protuberances to hold the magnets, could be inserted in the mold, as well.

To add traction, reinforcement or decoration, fabric, thin polymers or other materials can be adhered after the part is released from the mold. Molds and molding process are numerous, and many variations can yield similar results.

Figure 14E:
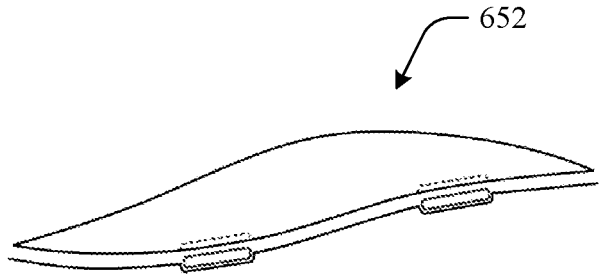

FIG. 14E illustrates an insert 652 made with indentations on the underside to seat the magnets. The magnet and bottom cover could be added in the mold or adhered after the part is released from the mold. The bottom cover can be a pliable, bondable material: fabric, a molded part, vacuum formed or embossed with indentations to hold the magnet.

Figure 14F:
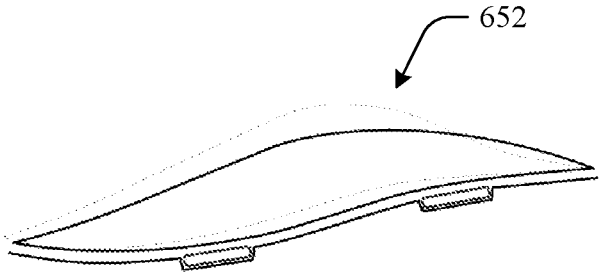

FIG. 14F illustrates the insert 652 with a smooth bottom, with a deeper indentation in the bottom cover to hold the magnets. In a custom, molded 3D printed insert, the formed bottom cover with the magnet could be attached to the arch support to fully customize a shoe with the magnets manufactured or added to the insole. The formed part can be the base to attach a self-mixing silicone or other two part epoxy pouch to be mixed by the wearer, attached to magnets the shoe and worn to cure the shape of the arch while walking or standing.

Figure 14G:
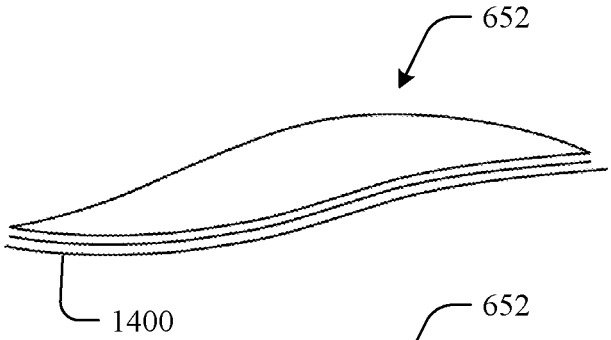

FIG. 14G illustrates a magnetic sheet 1400, or magnetic particles or metallic mesh that can be applied to the bottom of the insert 652 at points corresponding and registering to the magnet pattern or magnet sheet in the shoes.

Figure 14H:
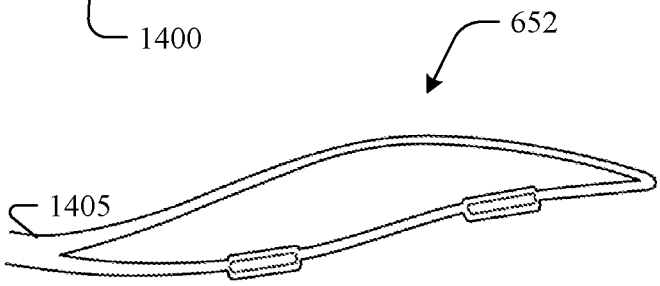
Figure 14I:
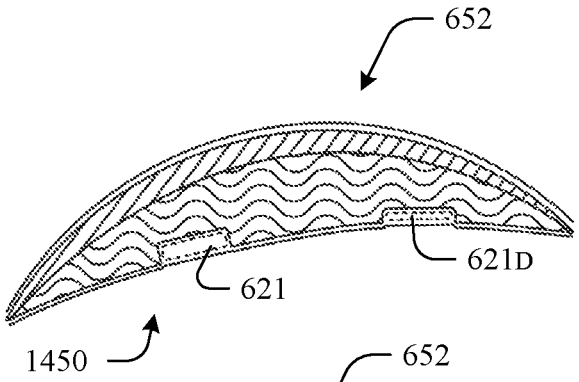
FIGS. 14 I-L illustrate additional cross-sectional views of embodiments of the present invention.
Figure 14J:
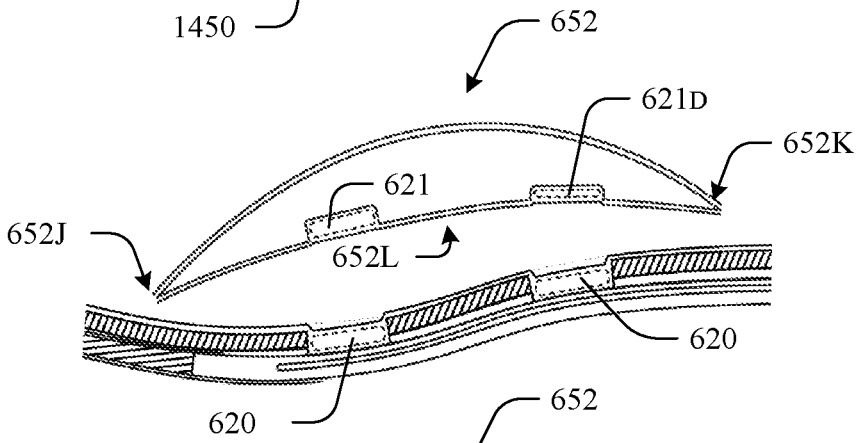
Figure 14K:
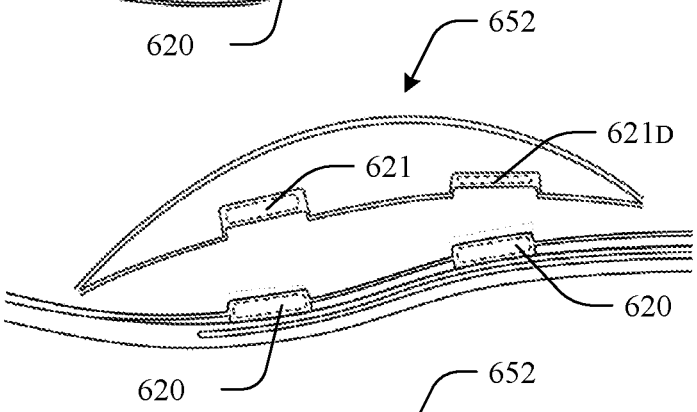
Figure 14L:
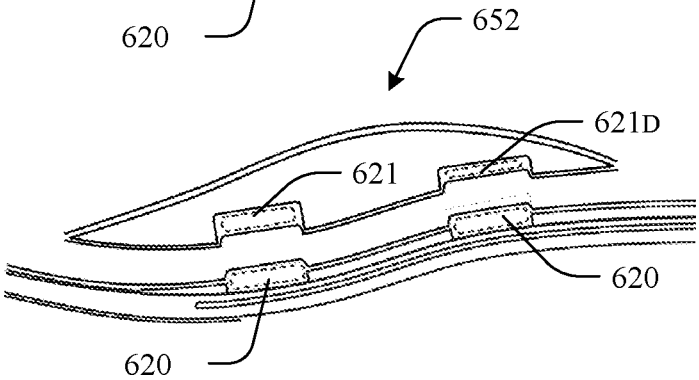
Figure 14M:
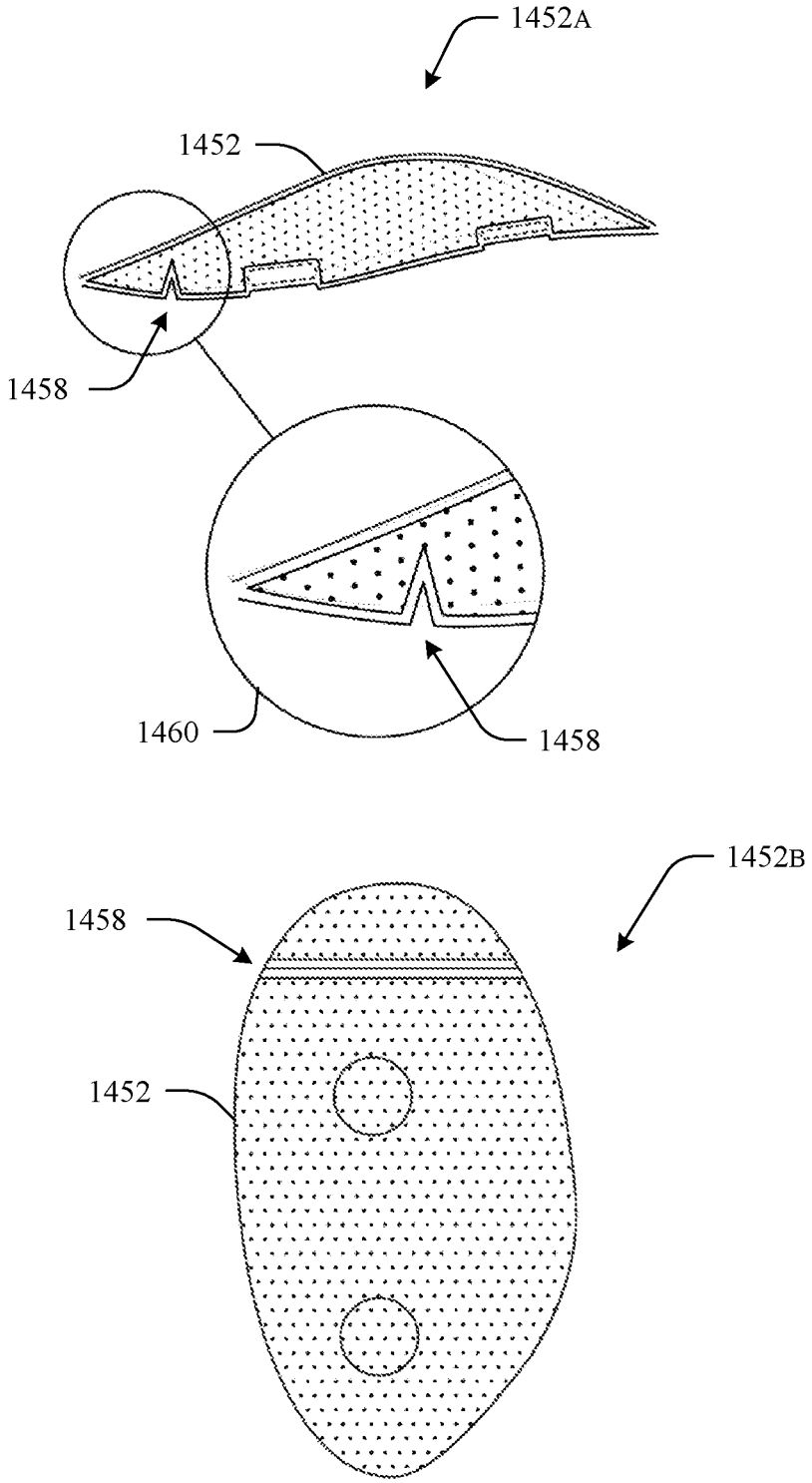

FIG. 14H shows a top and bottom cover 1405 that can be sewn, glued, heat sealed or attached together by some means with an opening at one end to form a pouch in which to insert the arch support. The arch support can be molded, as in variations above, or made of padding, resilient fibers, gel, foam or some other materials in combination to approximate the support of the other materials previously named for the insert. The end would need to be closed by the above means of making the pouch, or glue, hook and loop, snap or overlapping pieces to keep the insert from falling out of the covering. Magnets or other hardware could be attached to the bottom piece by glue or poking a hold in the material small enough to keep hardware from pulling through or a pocket made between two thin bottom layers of material.

FIGS. 14 I-L illustrate additional cross-sectional views of embodiments of the present invention, each view employing attachment mechanisms similar to those shown in FIG. 14A, but with distinct differences. Insert magnets 621, 621D may be of different relative heights (621D is shown as having a lower relative height dimension than 621), and such changes in magnet sizes in the insert 652 may be beneficial for a variety of reasons. For example, the magnet 621D, being located proximally or closer to the heel, may be easier to "feel" when foot pressure is applied to the insert 652, thus a thinner vertical dimension may be helpful to minimize discomfort. Further, the magnet 621 which is disposed closer to the distal, or toe section of the shoe, may be of larger dimension to generate additional magnetic force to better oppose sheer forces applied by walking/running that may attempt to displace the insert 652. Any combination of magnet sizes may be used for any desired approach, and in one embodiment, magnet 621D may be 1/16 inch in height, while magnet 621 is 1/8 inch in height.

Also of note in regards to FIGS. 14 I-L are variations on a shape of the bottom surface 1450 of the inserts 652. In FIGS. 14 I-K, the bottom surfaces 1450 are generally concave in shape, which, in some embodiments, provides a way to allow the insert 652, once installed, to lay flatter, as the compression forces applied by the magnets 621, 620, 621D (as well as the pressure of the wearer's foot) may cause the areas 652J, 652K to experience increased contact force over a central region 652L, thus helping to ensure the edges 652*k*, 652J of the insert 652 more closely approximate the surface of the insole/midsole of the shoe (put another way, they lay "flatter" once the concave curve is compressed).

Further, additional aspects may include the following: FIG. 14 I may comprise cotton, wool, other fiber with foam, or other cushioning material on top; FIG. 14 J may comprise a smooth finish on a bottom surface proximate 652 L to assist with easier sliding of the insert 652 over the insole/midsole of the shoe to assist with conformance to the shoe's insole/midsole surface; FIG. 14 K may also depict an indented bottom, and optionally includes a vacuum-formed cover; and FIG. 14 L includes a curved bottom surface that more closely approximates a fitted contour of the insole/midsole of the shoe in which it is installed.

FIG. 14 M illustrates an embodiment of an insert of the present invention that accommodates ultra-high heels. The cross sectional view 1452A illustrates that the insert 1452 accommodates an ultra-high heel (for example 110 mm to 120 mm), where a hinge element 1458 in the front of the insert 1452 may assist with allowing the insert 1452 to lay flat and better conform to the insole of the ultra-high heel shoe. The cross section of the hinge element 1458 is enlarged in inset 1460. Also shown is a plan view 1452A of the insert with the hinge element 1458 bisecting a front area of the insert 1452.

FIGS. 15A-D show illustrations of possible modifications and/or adaptations of the insole and insert in the invention. The protuberances are much longer and the corresponding hole in insole is deeper than in the previous illustrations. These protuberances could be any shape. It is likely that the sock liner would need to be cut to accommodate the protuberance. The deeper hole and longer protuberance reduce the effect of the forward movement of the insert from the forward movement of the foot in the shoe.

Figure 15A:
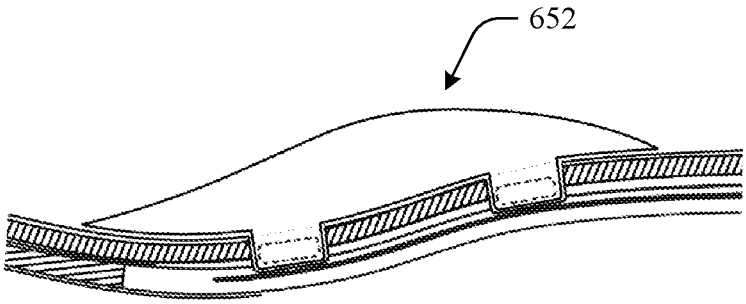
FIGS. 15A-D show illustrations of possible modifications and/or adaptations of the insole and insert in the invention.

FIG. 15A shows that a thicker stronger magnet could be attached or molded into the longer protuberances and the insole could be made to expose enough of the embedded metal shank to magnetically adhere the insert to the shoe. Different shapes of the protuberances like circles, squares, rectangles, cones, stars, etc. to tell the user how to put the insert in the shoe Different shapes of the shank can be used to get more contact with the magnets in the insert, like a y-shape or r-shaped (or reverse for right shoe) shank.

Figure 15B:
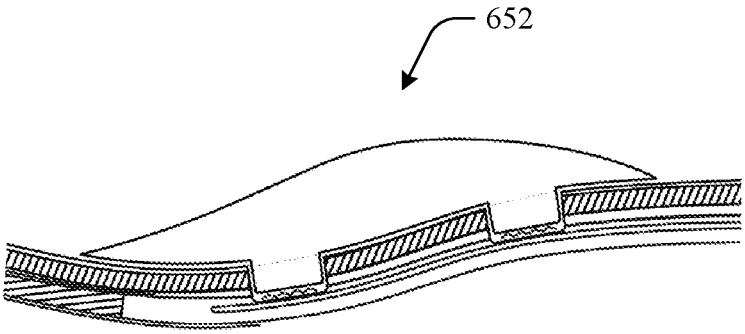
Figure 15C:
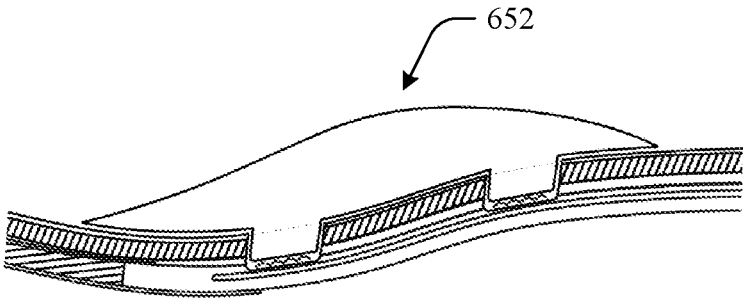
Figure 15D:
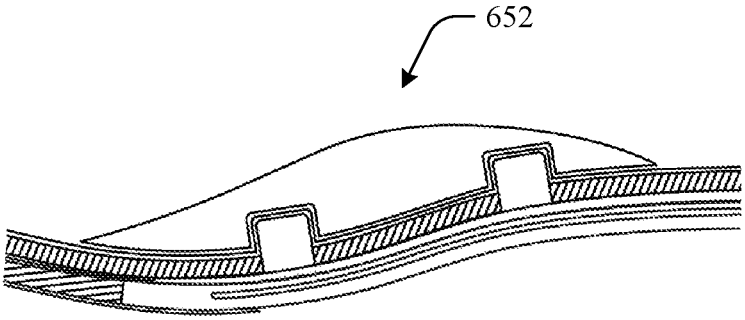

FIG. 15B illustrates hook and loop discs, glue, thin magnet, magnet and disc, a raised area in the hole with corresponding depression in the protrusion in the insert (or the opposite) or registration of irregular shapes for more contact between the insole and the insert. FIG. 15C shows embodiments where the protuberances could be angled toward the toes (or conversely toward the heel) and use any of the attachment methods described above. Further, FIG. 15D shows that the magnets could sit above the footbed and sock liner and connect into a void the insert, straight or at an angle, by all the attachment means previously described, such as magnet to disc, magnet to magnet, hook and loop, glue, different shapes like a like circles, squares, rectangles, cones, stars, etc., discussed in more detail in regards to FIG. 23.

FIGS. 16A-16C show where alternative hardware embodiments may also be used to attach the inserts. Clips 1410 can be molded into the insert or attached to a bottom cover. The clip 1410 toward the toes of the insert could be inserted into the slot. The insert is pliable and can bend, the heel end could be squeezed toward the inserted clip and the second clip inserted in the slot. The opposite arrangement of the clips facing inward or facing the same direction can be used.

Figure 17A:
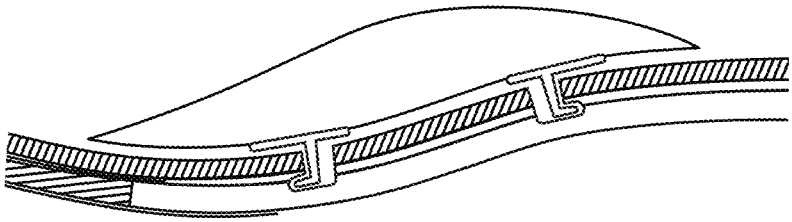
FIG. 17A illustrates an additional embodiment where a sliding keyhole shaped hardware could be used to attach or detach an insert.

FIG. 17A: In an additional embodiment, a sliding keyhole shaped hardware could be used in the same manner.

Figure 17B:
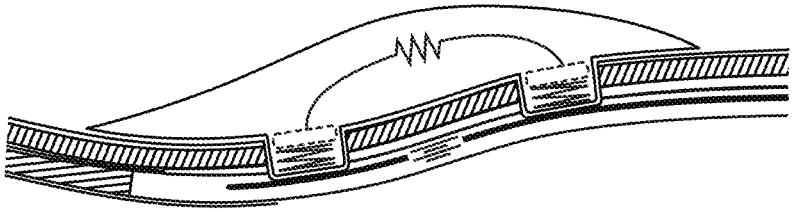
FIGS. 17B and 17C illustrates an additional embodiment where a sliding keyhole shaped hardware could be used to attach or detach an insert.

In FIG. 17B, magnets can be used to conduct electricity to massage, heat or cool the shoe or generate other data useful to the wearer.

Figure 17C:
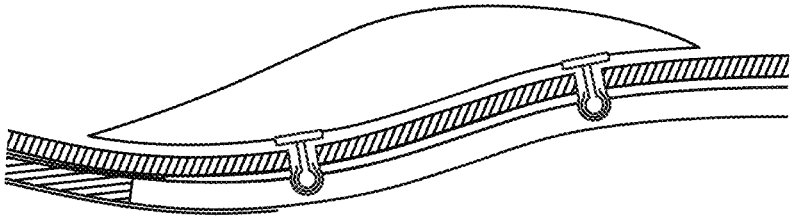
Figure 17D:
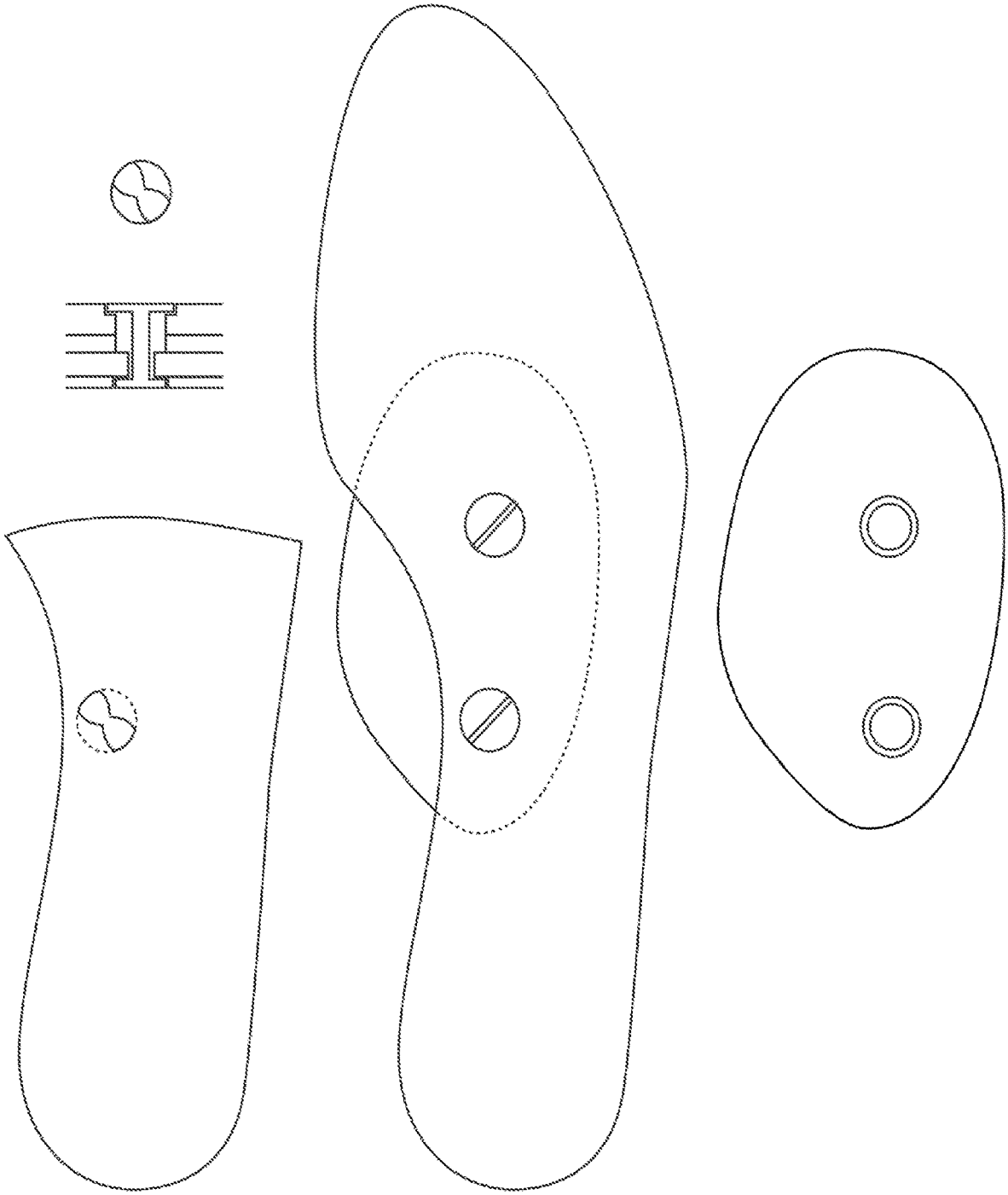
FIG. 17D illustrates an additional embodiment where a rotatable lug and keyhole shaped hardware could be used to attach or detach an insert with a variety of tooling indents shown.

In FIG. 17C ball and socket hardware with a gentle spring in the socket.

FIGS. 16A-C show a slot in the cover and insole 600 receives a tab 1410 in the insert.

FIGS. 18A-C illustrate that the polarity of the magnets (620, 621) can help the user insert the arch supports/inserts 652L, 652R in the correct orientation. FIG. 18A shows a South North polarity inversion, FIG. 18B shows a North South orientation, and FIG. 18C illustrates a polarity arrangement where only the left shoe insert can go into the left shoe and the right into the right, thus ensuring correct alignment.

Figure 19:
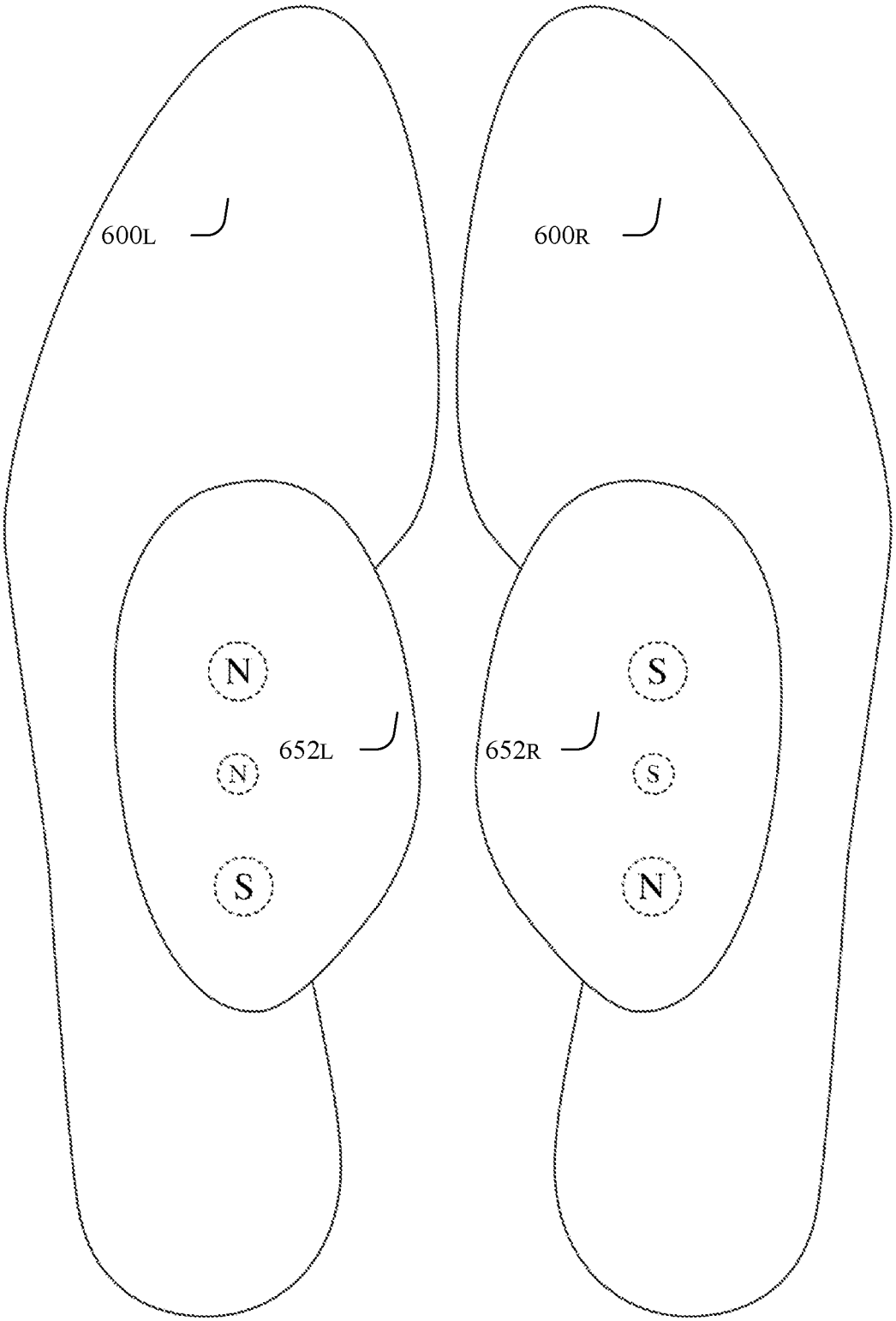
FIG. 19 shows an alternate polarity arrangement of inserts.

FIG. 19 shows an alternate polarity arrangement of inserts 652L, 652R, as viewed from a plan view of the respective left and right insoles 600L, 600R, preventing inserts from being oriented incorrectly or even inserted into the wrong (left for right, right for left) shoe for the insert.

Figure 20:
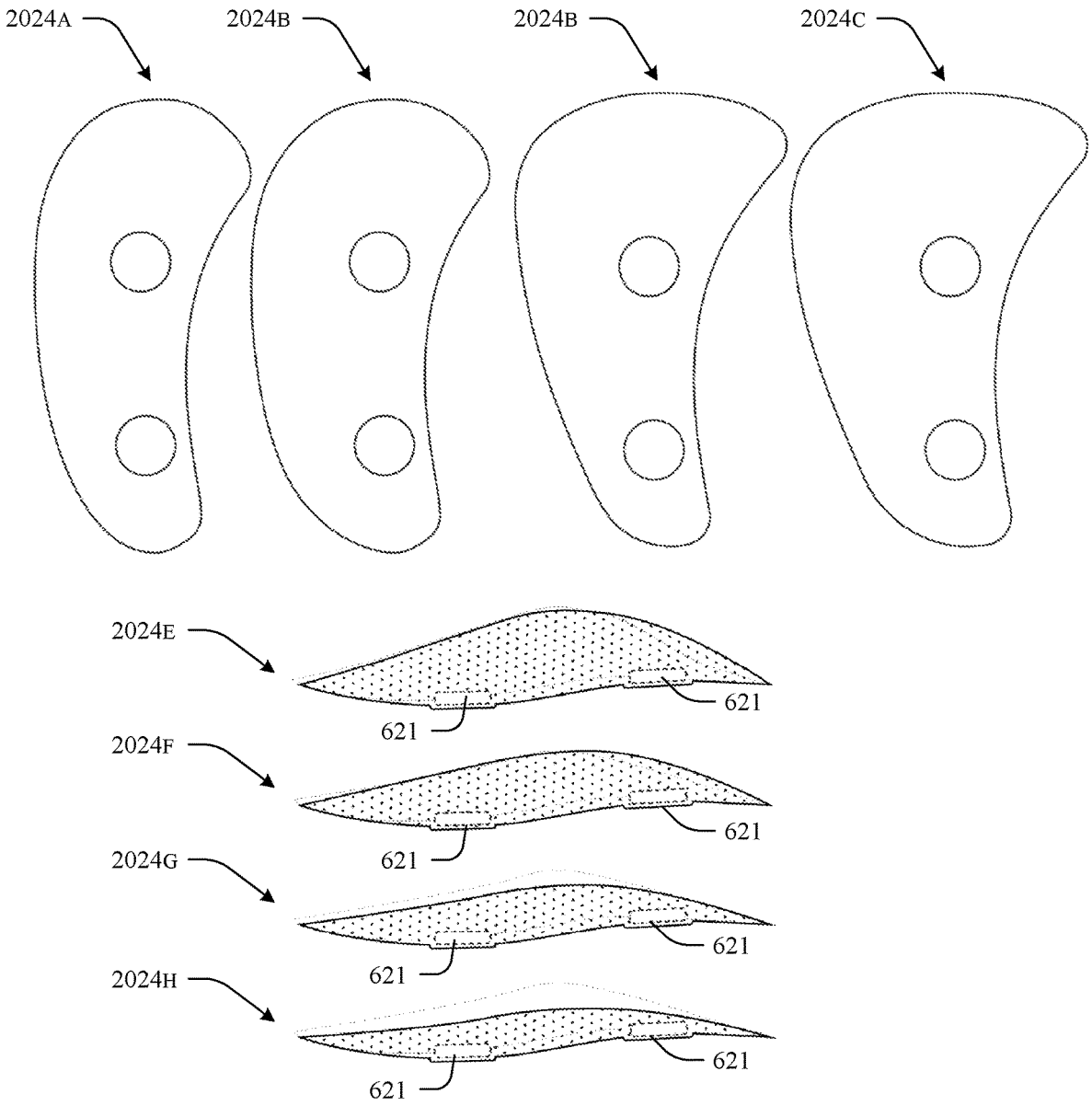
FIG. 20 shows plan views of inserts 2024A-D, for use in a sandal or other shoes with a pocket in the sock liner.

FIG. 20 shows plan views of inserts 2024A-D, for use in a sandal or other shoes with a pocket in the sock liner, the medial portion of the arch support insert can be removed and the edge can conform to the inner edge of the insole. A variety of widths is possible, as illustrated, to accommodate different width and sizes of feet. The cross sections 2024 E-H show that various height options may be used based on the desired shoe pattern and arch height. Also, insole magnets 621 may be moved to any desired location, for example closer to one another or spaced farther apart.

Figures 21A, 21B:
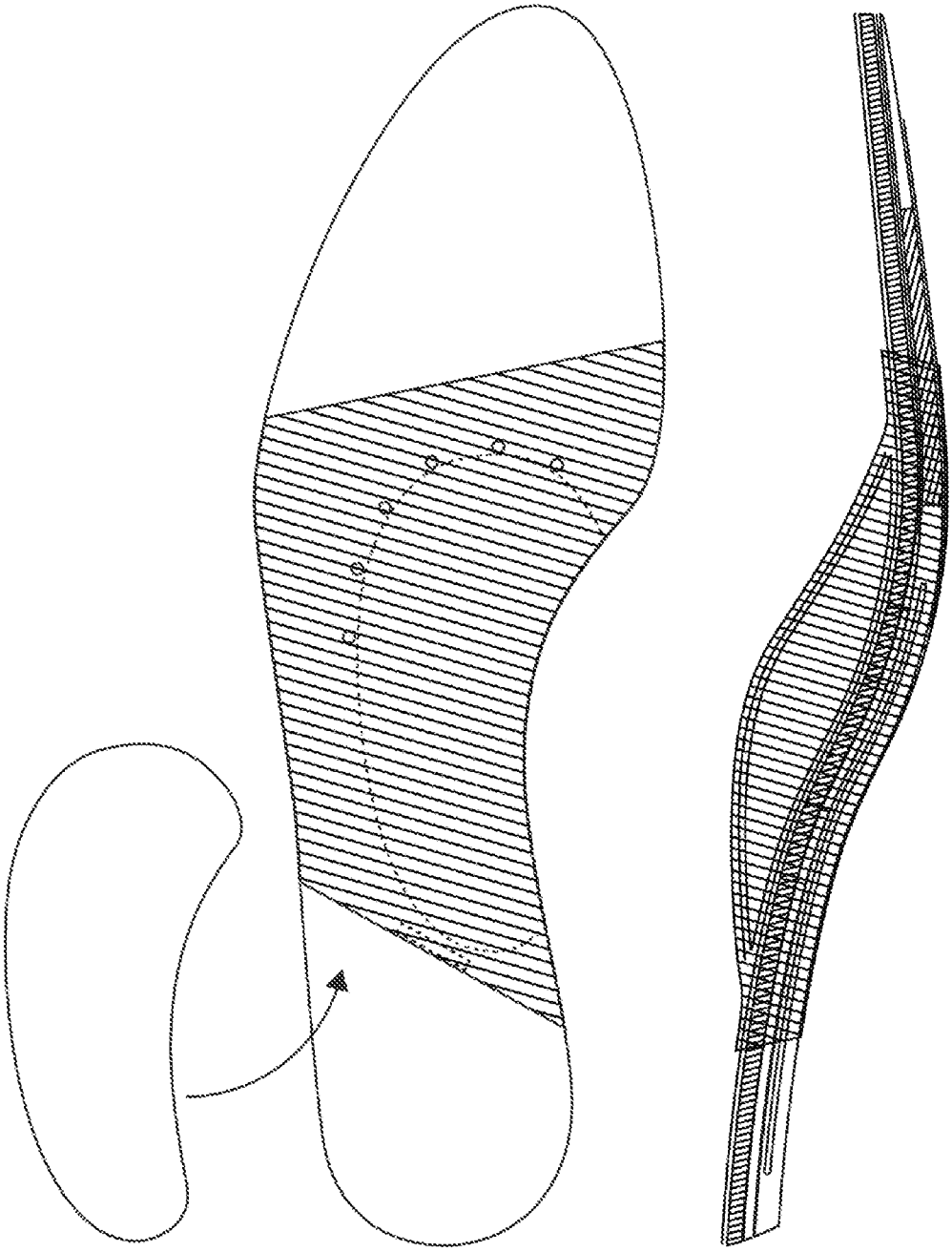
FIGS. 21A-21B illustrate alternate embodiments, where the modified arch support could be used in a shoe or sandal.

In various embodiments, not illustrated, a pair (left, right) of inserts has a bottom magnet moved up and top and/or bottom trimmed to fit in a lower volume dress shoe. The topline is trimmed (for a lower cut shoe) and the opposite side has a little material added for a wide version to fit in a wide shoe. The shape of the perimeter might be squared off a little more or less, depending on how it fits into the shoe. For example, an insert for a sneaker might have the metatarsal area elongated because the volume of the shoe is larger FIGS. 21A-21B illustrate alternate embodiments, where the modified arch support could be used in a shoe or sandal, can sit on top of the sock liner, but a more aesthetic approach is to hide it in a pocket or pouch, hidden under the foot.

In a sandal, D'orsay style of shoe, a sling back, mule or any style that exposes the lateral arch of the foot, a pocket opening of the present invention is disposed at the heel area of the sock liner, concealing the arch support, and is very useful and aesthetically pleasing. The opening of the pocket in the insole could be a simple slit, flap or separate piece, relying on the elasticity of the stretch leather, mesh, thin polymers or fabric sock covering to keep the pocket partially closed. The foot hides the opening of the pocket or pouch.

In one embodiment, an attachment method is provided by magnets in the insole and magnets or metal discs in the arch support insert to pull it in to the pocket and firmly attach the insert to the insole inside the pocket. The insole covering can be modified to form a pocket to hide the insert to make the insert appear to not be a separate piece, but part of the shoe, because the profile is hidden by the sock liner on the side of the shoe. An edge of the opening may have elastic stitched along the opening edge to keep the pocket shut or a small snap with recessed parts into the insole or recessed piece of hook and loop. The pouch could also a pocket stitched on top of the insole like a patch pocket in a garment.

The arch support insert is inserted under the sock liner through the opening in the heel area and pushed toward the toe under the sock liner covering. (It could enter through the toe in an open toed shoe, but it is easier and more functional through the heel.

Figure 22A:
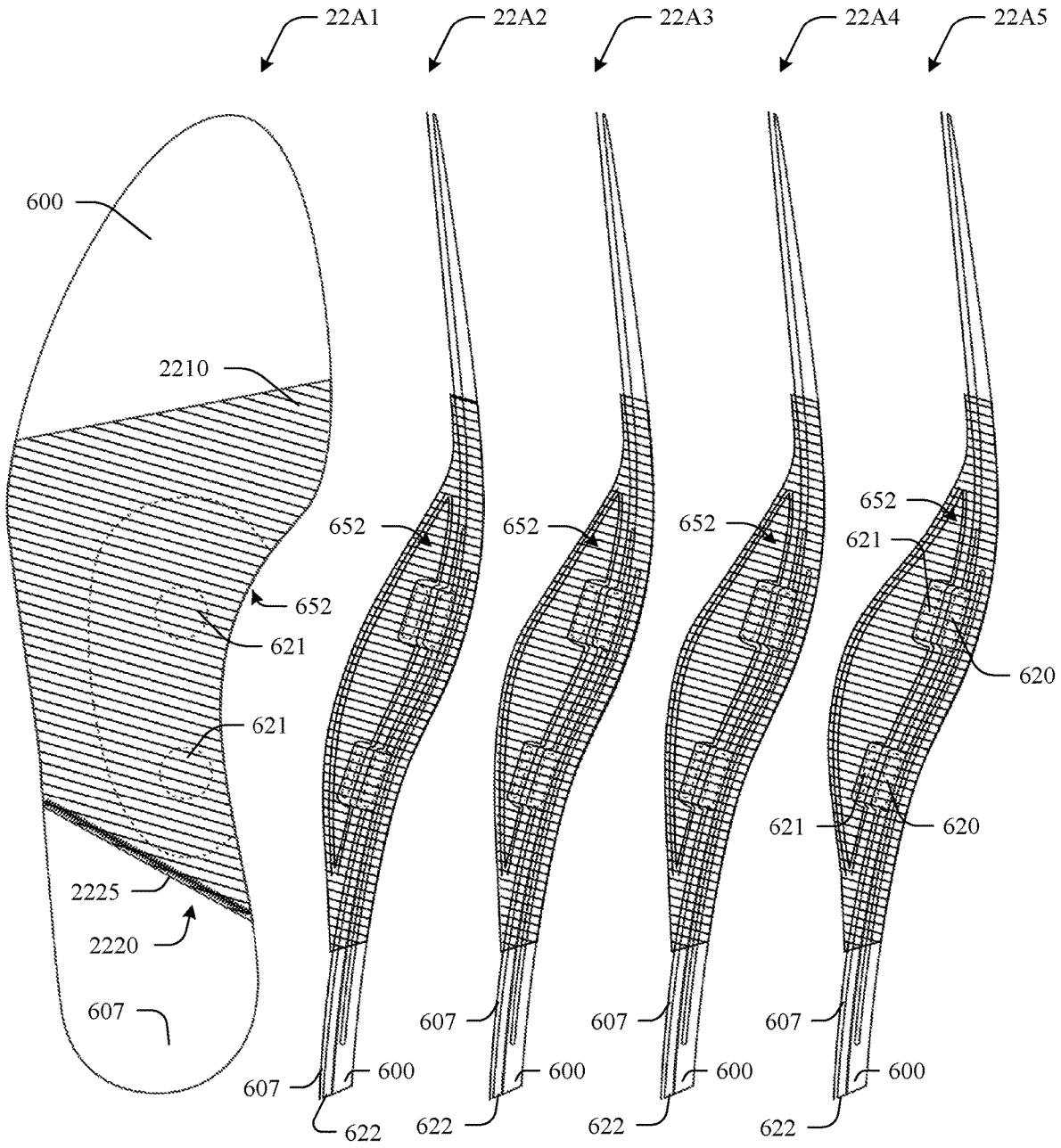
FIG. 22A shows an alternative embodiment of a sandal-type insole that is depicted in plan view and various versions provided in side views.

FIG. 22A shows an alternative embodiment of a sandal-type insole 600 that is depicted in plan view 22A1 and various versions in side views 22A2-22A5. The side views 22A2-22A5 respectively depict alternate embodiments with varying thickness of the insert 652, wrapped in pouch material 2210. Further FIG. 22A illustrates a revised insert magnet placement and method of manufacture from FIG. 22. The insole 600 includes a pouch 2210 (that may comprise, for instance, elasticized leather, synthetic leather, fabric or other elastic/stretchable material) with an opening area 2220 that may further comprise a closing mechanism 2225 such as an adhesive or hook and loop material such as VELCRO® closure between the top surface of the pouch cover 2210 and the insole 600 (optionally, closing mechanism may comprise stitched elastic). The adhesive may be covered by a removable peel strip so that the user may permanently close the pouch 2210 once the insert 652 is in place by removing the peel strip that is deployed above the adhesive and pushing down on the closing mechanism 2225 to seal. The insert 652, shown in dotted lines in plan view 22A1 includes voids where insert magnets 621 are inserted, and glued in place within the insert 652 in a preferred method of manufacture. In one embodiment, these voids are covered by the elastic leather, so that they may be secured by strong adhesive tape over the top of them to keep them from getting dislodged by the insert. An optional cover may be placed over the insert magnets on an outside surface of the insert 652. Further, insole magnets are secured, for example, to the insole 600 within voids created in the patterned material 622, and further may protrude through a sock liner 607, or optionally may be covered by the sock liner 607 after installation through the patterned material 622.

Figure 22B:
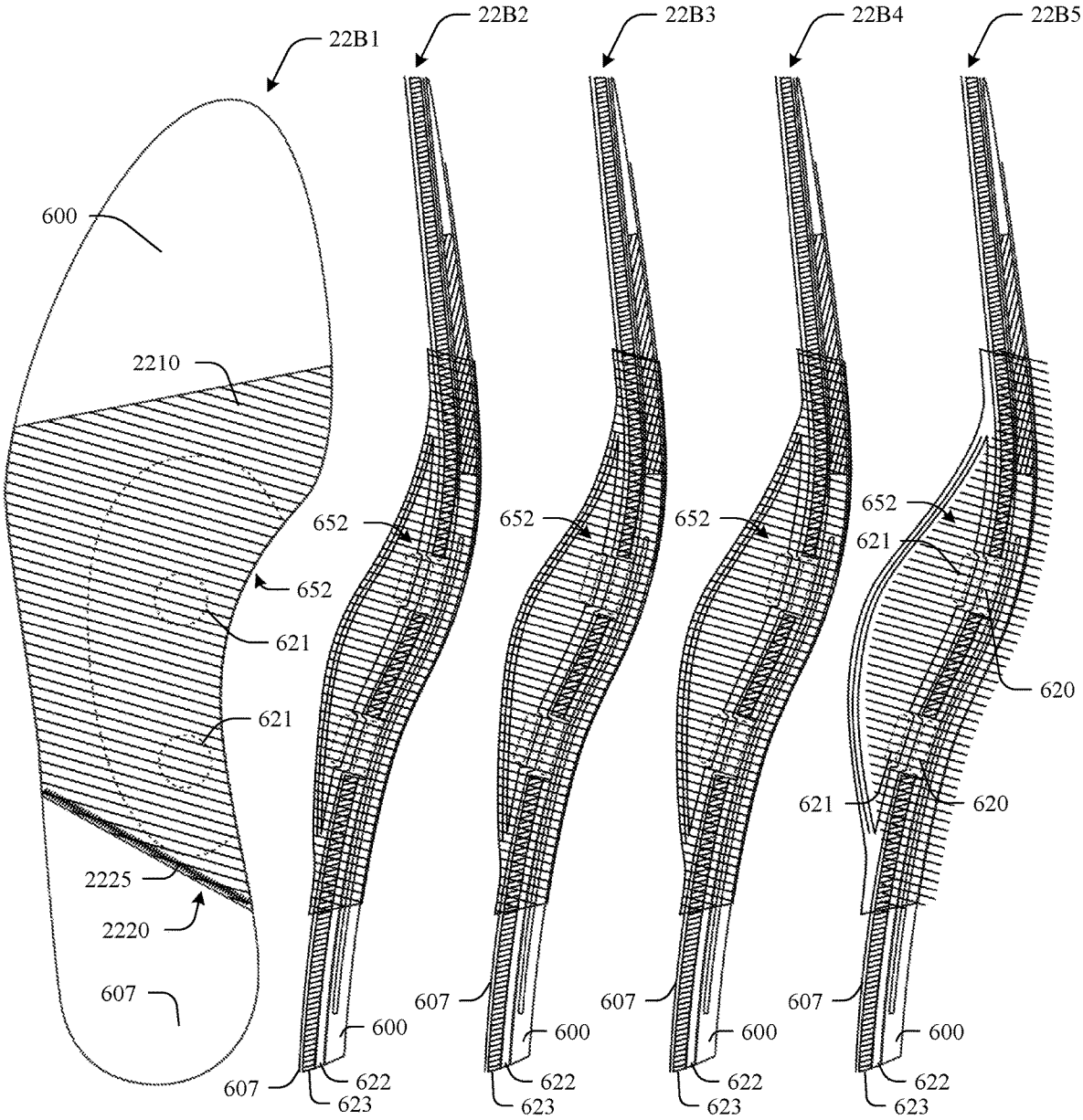
FIG. 22B illustrates an alternative embodiment of a sandal-type insole.

FIG. 22B illustrates an alternative embodiment of a sandal-type insole 600 depicted in plan view 22B1 and various versions in side views 22B2-22B5. Features are similar to those depicted in accordance with FIG. 22B, but a cushioning layer 623 has been disposed between the sock liner 607 and the insole 600. As shown, voids in the cushioning layer 623 are suitably formed to accommodate magnets 620, 621.

Figure 22:
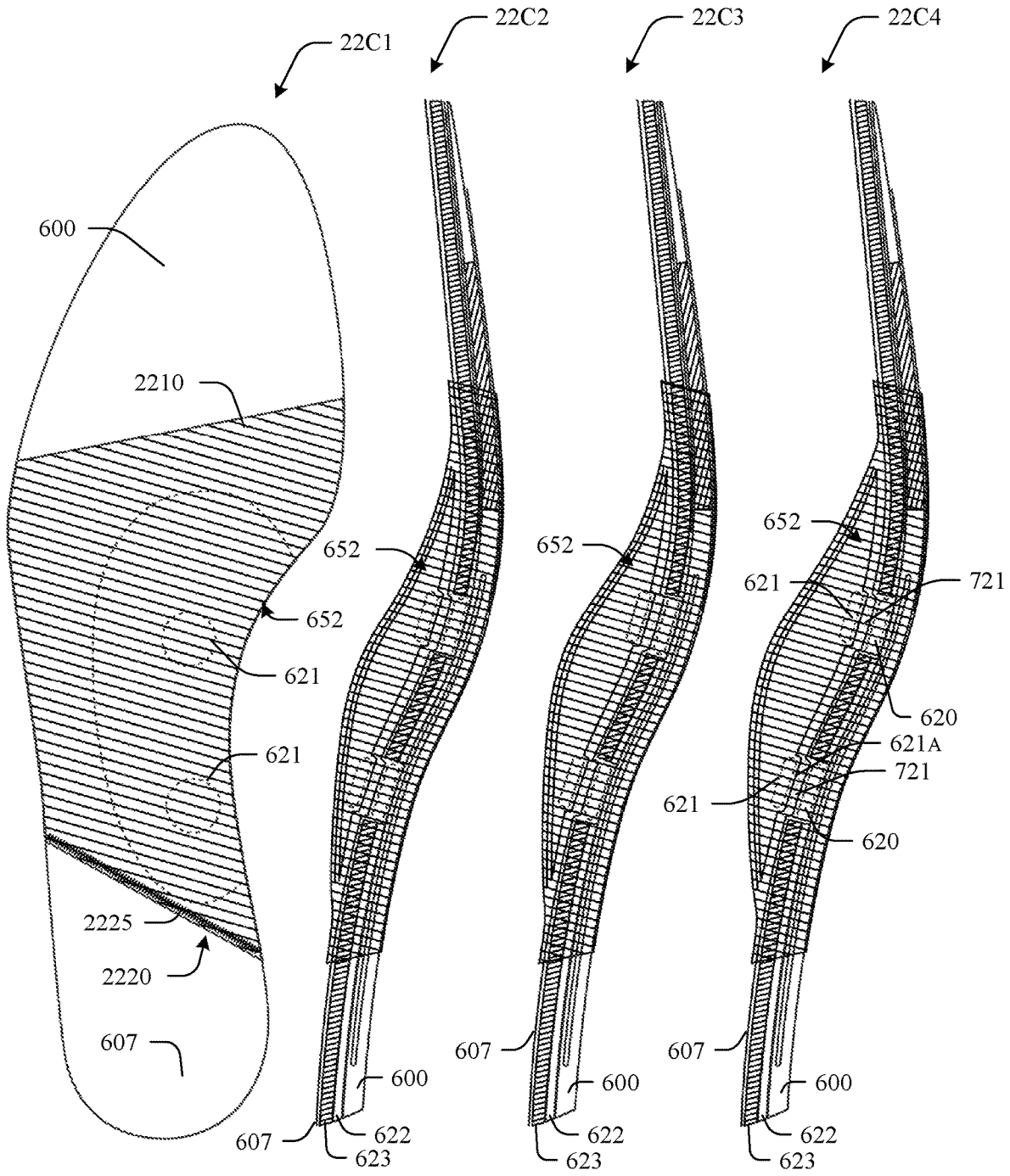
FIG. 22 illustrates yet another embodiment of a sandal-type insole.

FIG. 22 illustrates an alternative embodiment of a sandal-type insole 600 depicted in plan view 22C1 and various versions in side views 22C2-22C4 depicting a plurality of heights of arch supports illustrated as inserted under the cover of the pouch 2210. The embodiments shown in FIG. 22 presents similar features to the embodiments of the present invention illustrated in FIGS. 22A and 22B, described above. In the illustrated embodiment of FIG. 22, magnets 621 are disposed within protuberances 621A, which matably engage with voids 721 in the cushioning layer 623, allowing magnets 620 to magnetically couple to magnets 620 that are attached within the voids 721, thus securing the insert 652 within the pocket 2210. In various embodiments, a space in the pocket for the insert could be further confined by gluing the area not holding the insert or using a flat stud pattern on the periphery of insert to keep it from moving around under the covering without an attachment means. Further, a plain insert without hardware could be used in the illustrated embodiments. Further, a top and side edge of the insole may be glued to the lining where there is no insert, but decorative fastenings or studs could further confine the arch support opening.

Figure 23:
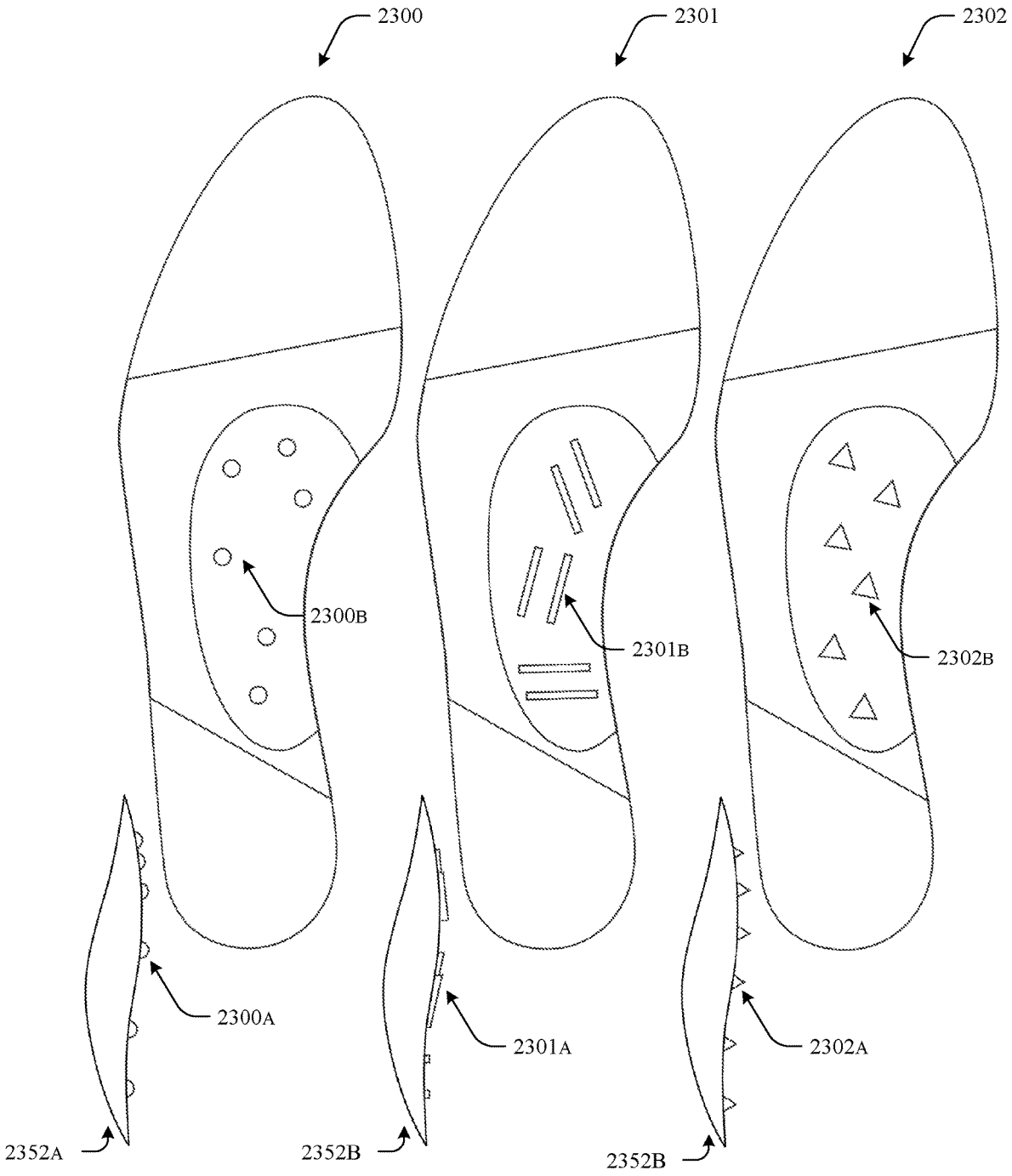
FIG. 23 shows three embodiments of the present invention where protuberances are respectively disposed on undersides of inserts.

FIG. 23 shows three embodiments 2300, 2301, and 2302 of the present invention where protuberances 2300A, 2301A, 2302A are respectively disposed on undersides of inserts 2352A, 2352B, 2352C, and such protuberances respectively mate up with openings 2300B, 2301B, 2301B to provide a mechanical interface to secure the inserts 2352A, 2352B, 2352C within the shoe. In various embodiments, the inserts could have protuberances such as molded ridges or bumps or any other shape in a pattern which helps it register and fit to the insole and hold it in place under the cover. Three suggested patterns are illustrated on three inserts and insoles, and it is understood that multiple and alternative layouts may be used depending on the desired mounting configuration. In various embodiments, the arch support/insert could also be a simple arch support wedge shape.

Figure 24:
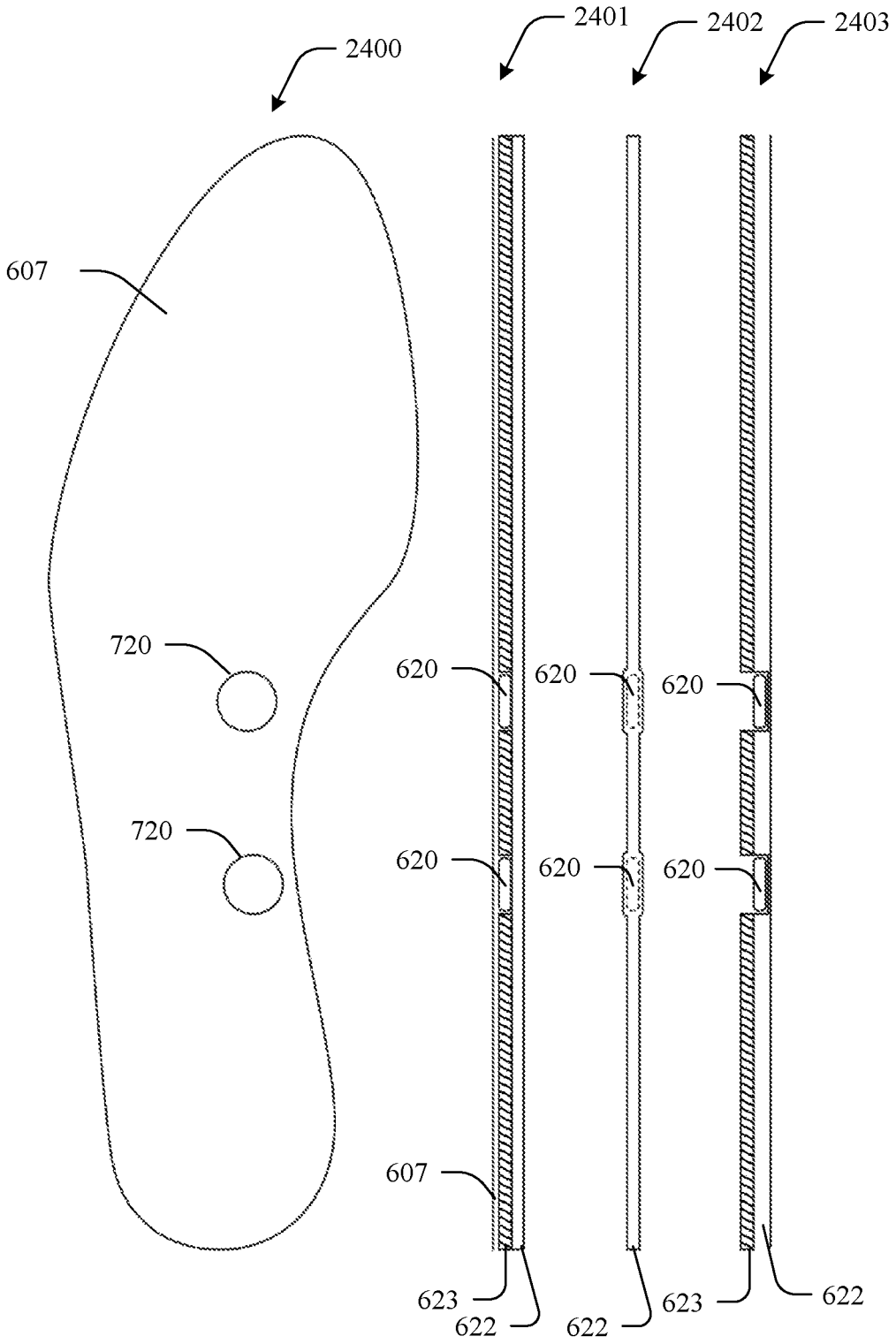
FIG. 24 illustrates embodiments of the present invention with different magnet placement configurations.

FIG. 24 illustrates embodiments of the present invention with different magnet placement configurations for the insole shown from the plan view 2400 (showing sock cover 607 on top). The various embodiments of the present invention can be used in any shoe, athletic shoe or soft constructed shoe. It can be used with a molded footbed and molded midsole and outsole built into the shoe or purchased separately with the insert to be added in the aftermarket. In view 2401, a patterned material/midsole 622 forms a base for a cushioning layer 623 covered by a sock liner 607. Insole magnets 620 are placed in voids in the foam layer 623, and as such, the sock layer 607 remains relatively planar as the magnets 620 are enclosed within the cushioning layer 623. In view 2402, a single patterned material layer 622 encases the insole magnets 620 and retains them within the patterned material layer, thus preventing them from moving. Also, in yet another alternate embodiment shown in view 2403, a cushioning layer 623 is disposed on top of the patterned layer 22, with voids created through both the cushioning layer 623 and part of the patterned material 622 to accommodate insole magnets 620. Further, a thin, thermoplastic, full length insole can be cut to size of the interior of the shoe and heated with a heat source, like a heat gun, to conform to the inside of any shoe. The magnets can be glued to various surfaces or encased in cushioning material. Any of the variations, their inverses, and length of protuberances in previous examples in drawings 9-12 can be used in this example as well. The insole may be a full length insole or a partial length insole such as a ¾ length insole. Also, regarding the partial length insoles, the form factor may be used on its own for particular brands or shoes, depending on the geometry and layout of the shoe. The various examples provided are shown as flat materials to simplify the drawings, but the components can be shaped to the insert, foot or shoe.

In additional embodiments, a soft, molded footbed with magnet holes cut out as a pattern to glue to another footbed or foam layer on top, then covered with a sock liner to conceal the magnets. The magnets may be placed within a molded footbed or two thin layers of material. Further, molded or vacuum formed thermoplastics or polymers may be used to hold the magnets with foam or footbed on top. Likewise, in another embodiment, thermoplastic is used as a sheet conforming to magnets underneath the plastic and foam or footbed on top.

Figure 24B:
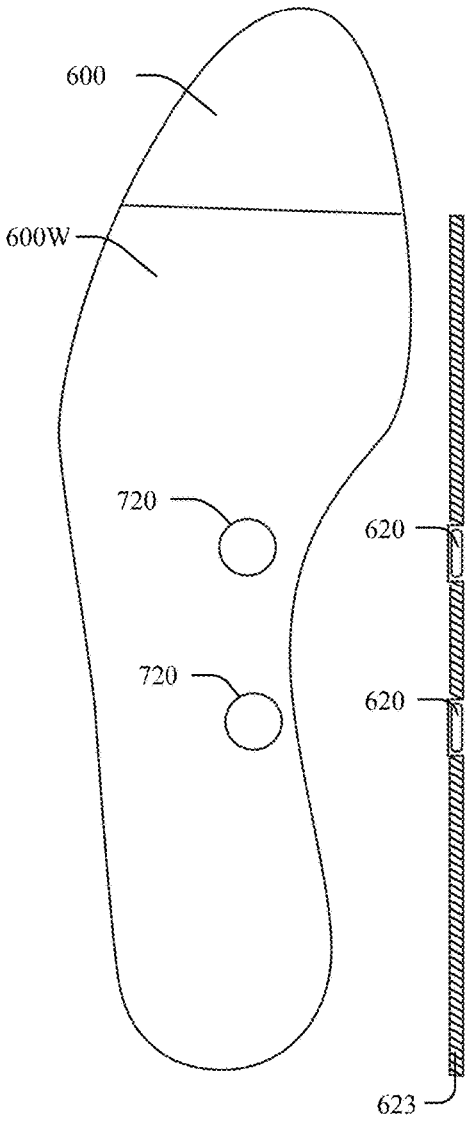
FIG. 24B depicts a ¾ thin insole 600W (for example, less that 1 mm thick) made from a sheet of material that can be molded to fit the interior curve of the shoe.

FIG. 24B depicts a ¾ thin insole 600W (for example, less that 1 mm thick) made from a sheet of material that can be molded to fit the interior curve of the shoe. Materials that can be heated with a hair dryer can form a skin over the magnets and interior of the shoe. If magnets are placed in the shoe to accept a magnetized arch support, material will conform to the shape of the magnets (or other hardware). When cooled, the sheet of material becomes firm and smooth, sometimes has an adhesive properties embedded in the material.

If it is not adhered, the firm insole will not slide into the toe of the shoe because it is customized for the shoe and the insole at the widest part of the shoe (at the ball girth) may be unable to move into the narrowing toe. An arch support insert or other cushioning, could also be glued to the top of the insole, with or without magnets or raised pegs. A sock liner and cushioning can be added.

Figure 24C:
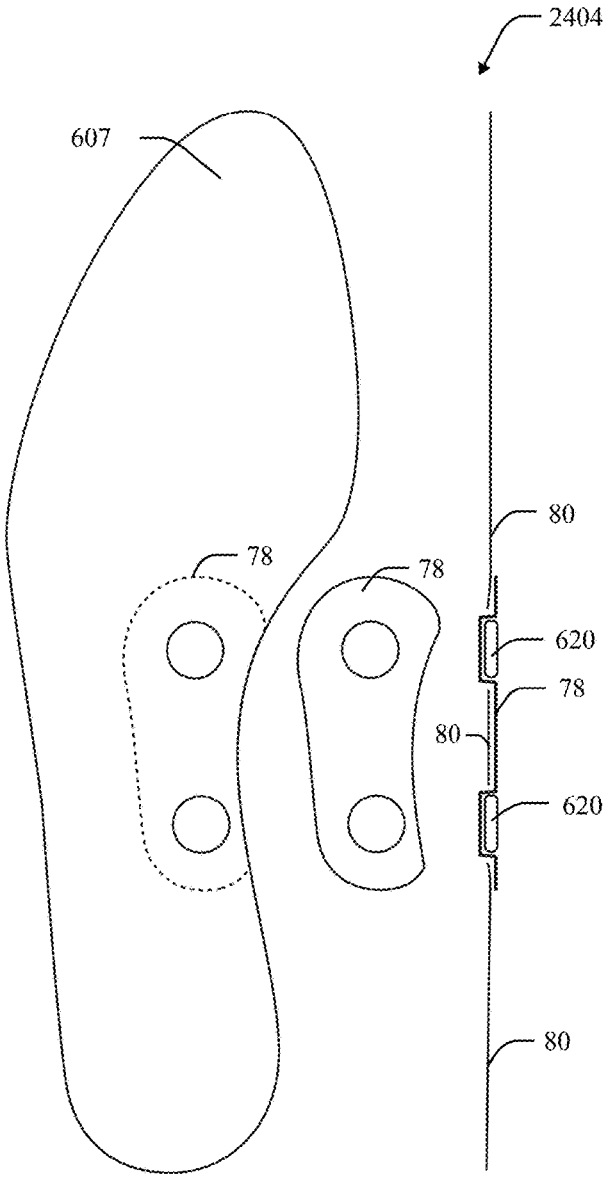
FIG. 24C depicts a small, thin cover for magnets or pegs, attached directly to the shoe under a sized sock liner.

FIG. 24C depicts a small, thin cover for magnets or pegs, attached directly to the shoe under a sized sock liner 607 (or other cushioning material). Holes in the size and shape of the magnets are cut in the cover to expose and space the magnets properly, to later attach a magnetized insert. The magnet cover 78 for the magnets, in some embodiments, will be a thin vacuum-formed or molded piece of plastic, fiber or composite paper or other durable material that does not dampen the effect of the magnet. A hole in the plastic magnet cover can be open to increase the effectiveness of the magnet. The cross-section 2404 at right shows a sock cover 80 (also shown on the magnet cover 78), which in turn includes magnets 620 that may be glued or otherwise secured within cavities in the magnet cover 78.

FIGS. 25, 25A, 26, and 26A illustrate various embodiments where magnets or hardware can be molded or glued into molded footbeds 2505, 2506 or outsole 2510, 2511 of illustrated shoe bottoms 2591, 2592 or any variety of moldable material or in combination with the traditional cellulose and shank insert.

Magnets 620, 621 can also be placed in a poured mold or injection mold to be enclosed in a midsole 2535 or outsole 2510, 2511 or glued. The midsole 2535 may comprise patterned material but also shock absorbing material in a sneaker with a full footbed. In a fashion shoe, midsole 2435 may typically be made from cardboard. Midsole 2535 may also comprise a higher density foam. Midsole 2535 may also provide a function, among other things, to precisely locate the magnet and form a brake for the magnets against the shear forces of the foot during insertion/removal and walking/running.

In the illustrations, a raised cup is formed to hold glued in magnets 2521 in protuberances 621A for the respective arch supports 652B, heel cup 652C or a variety of orthotics or footbeds 652A is shown (see also FIG. 14A and accompanying text, above). To reduce the weight of the shoe, the molded midsole 2535 or outsole 2510, 2511 can have other similar voids, but still support the foot. In one embodiment, the protuberances 621A mechanically mate with voids 721 formed in the outsole 2591, so that magnets 620, 621 may attractively attach the orthotic/footbed to the outsole 2511.

Any shape of disc magnets 620, 621 can be used. A flat platform is shown for simplicity, but curved or other shapes of the platform can be used to attach the magnet, depending on the aesthetics of the designer.

A midsole 2535 with voids 720 to expose the magnets 621, fits over the magnets in midsole/outsole to attach to magnets in an arch support, heel cup, full length, ¾ length orthotic or a variety of purchased or custom-made orthotics. A cover (not shown) on the top of the footbed 2535 conceals and secures the magnets in the footbeds 2505, 2506 or outsole 2510, 2511. Any combination or placement of magnets can be used to attach the footbed or orthotic with registering magnets or hardware to secure it to the midsole or outsole of shoe. The arch supports and a heel cup described throughout the drawings and written description can be attached on top of a sock liner as described above.

Figure 25:
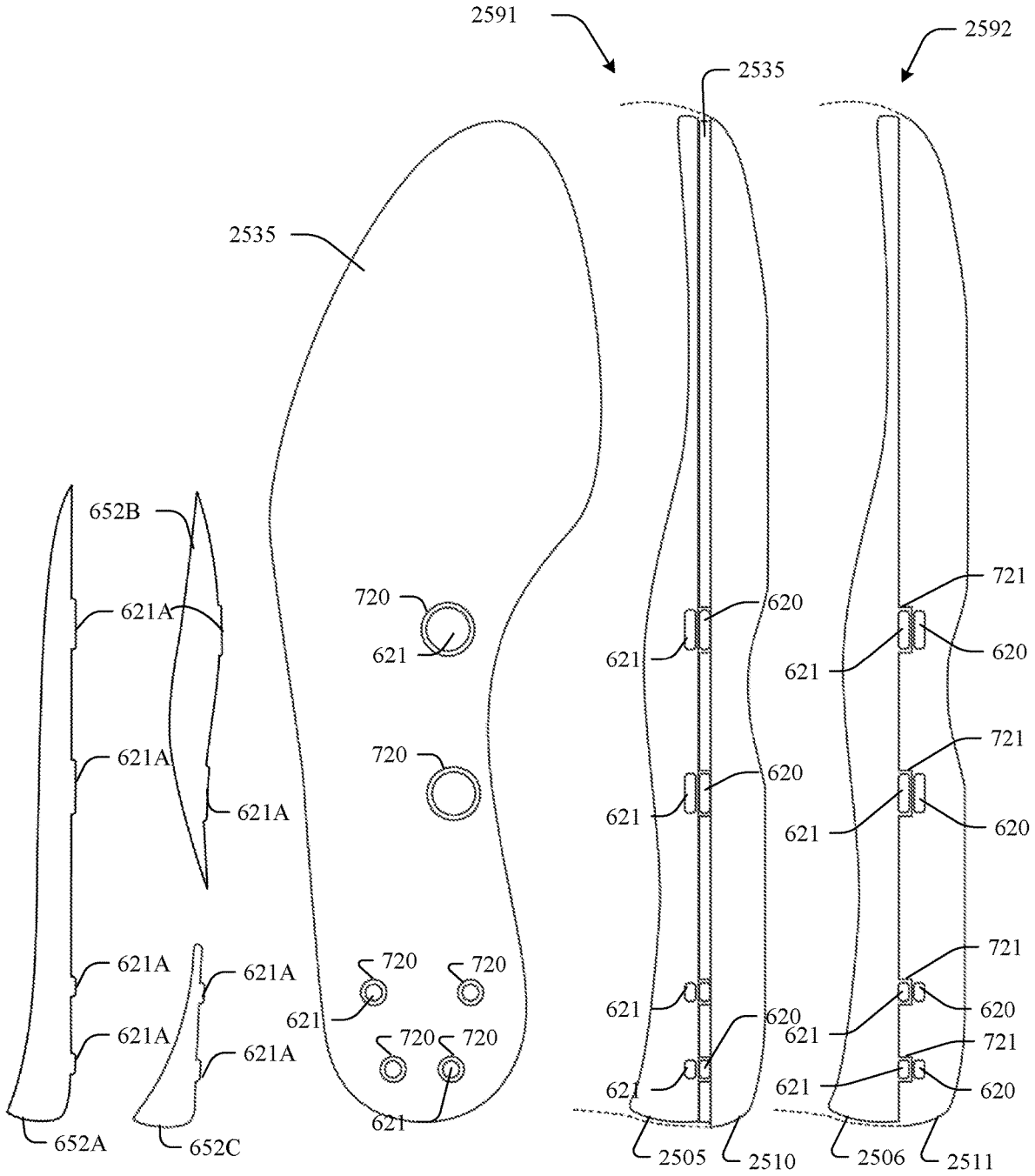
FIGS. 25 and 25A illustrate various embodiments where magnets or hardware can be molded or glued into molded footbeds or outsole of illustrated shoe bottoms.

Various other embodiments of FIG. 25 are possible. For example, if magnet cups are disposed at the footbed line, magnets could secure the footbed to the midsole, enabling footbeds to be interchanged or replaced. The hardware and attachment methods in the various illustrated embodiments also be adapted to the molded footbed, midsole and outsole. Further, a molded midsole or outsole with raised cups may assist with to holding the magnet flush with the cup edge of the cup. The footbed fits over the top with the cover thin enough for the magnets in the inserts to adhere. If magnets and cups are inversely depressed below the footbed line, a consumer could attach supplied magnets to a purchased orthotic, arch support or heel cup to adhere to the magnets inside of the shoe.

Figure 25A:
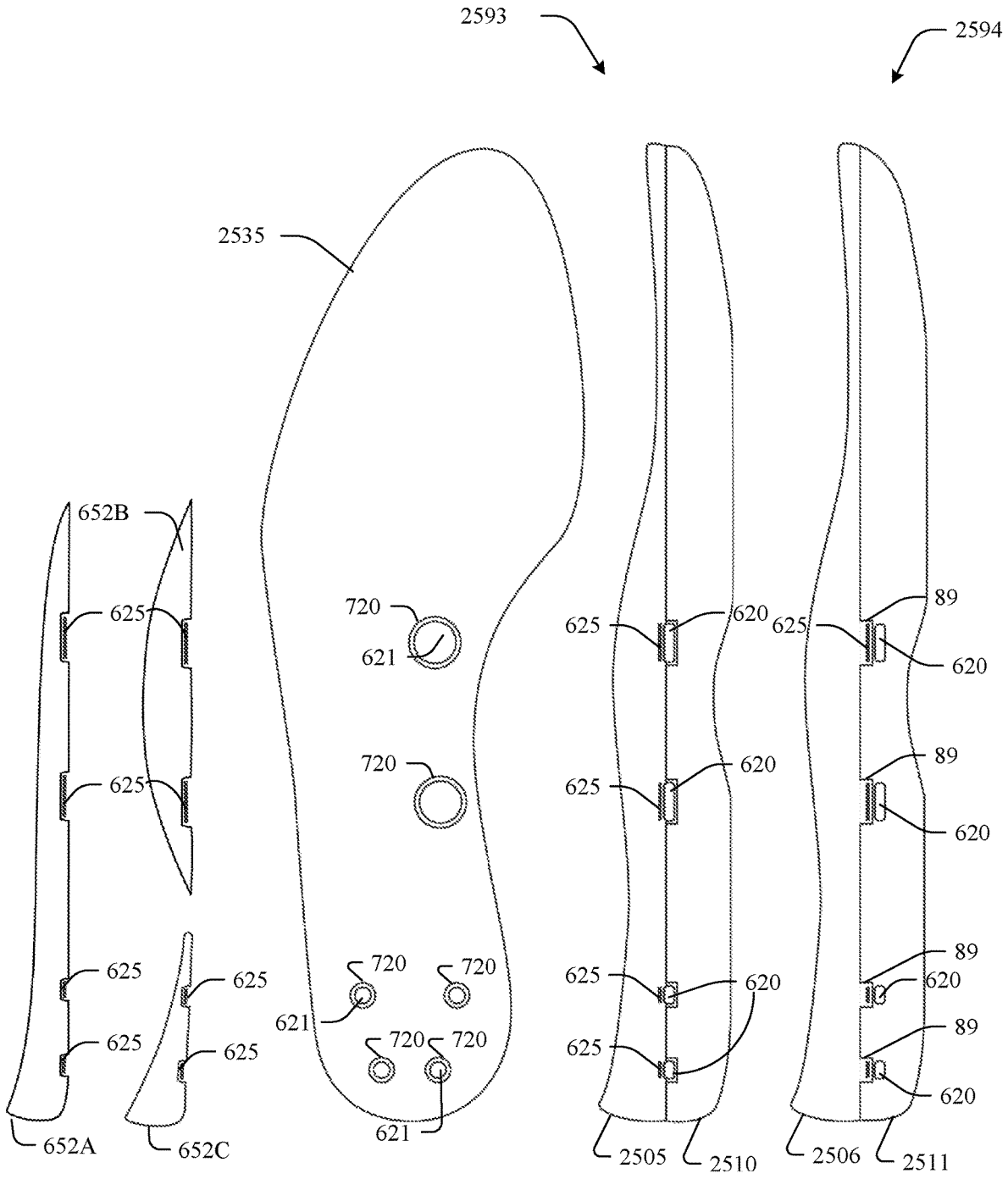

FIG. 25A shows an alternative embodiment of FIG. 25, where metallic or magnetically-attractive discs 625 are disposed in either an orthotic/footbed 652A, 652B, 652C, or 2505, or 2506. If insole magnets 620 are selected to impart sufficient magnetic force, rather than using an insert magnet 621 as shown in FIG. 25, a metallic disc 625 or other magnetically attractive substance may be used to cause the footbeds/orthotics 652A, 652B, 652C, or 2505, or 2506 to be retained approximate the outsole 2510, 2511.

Figure 26:
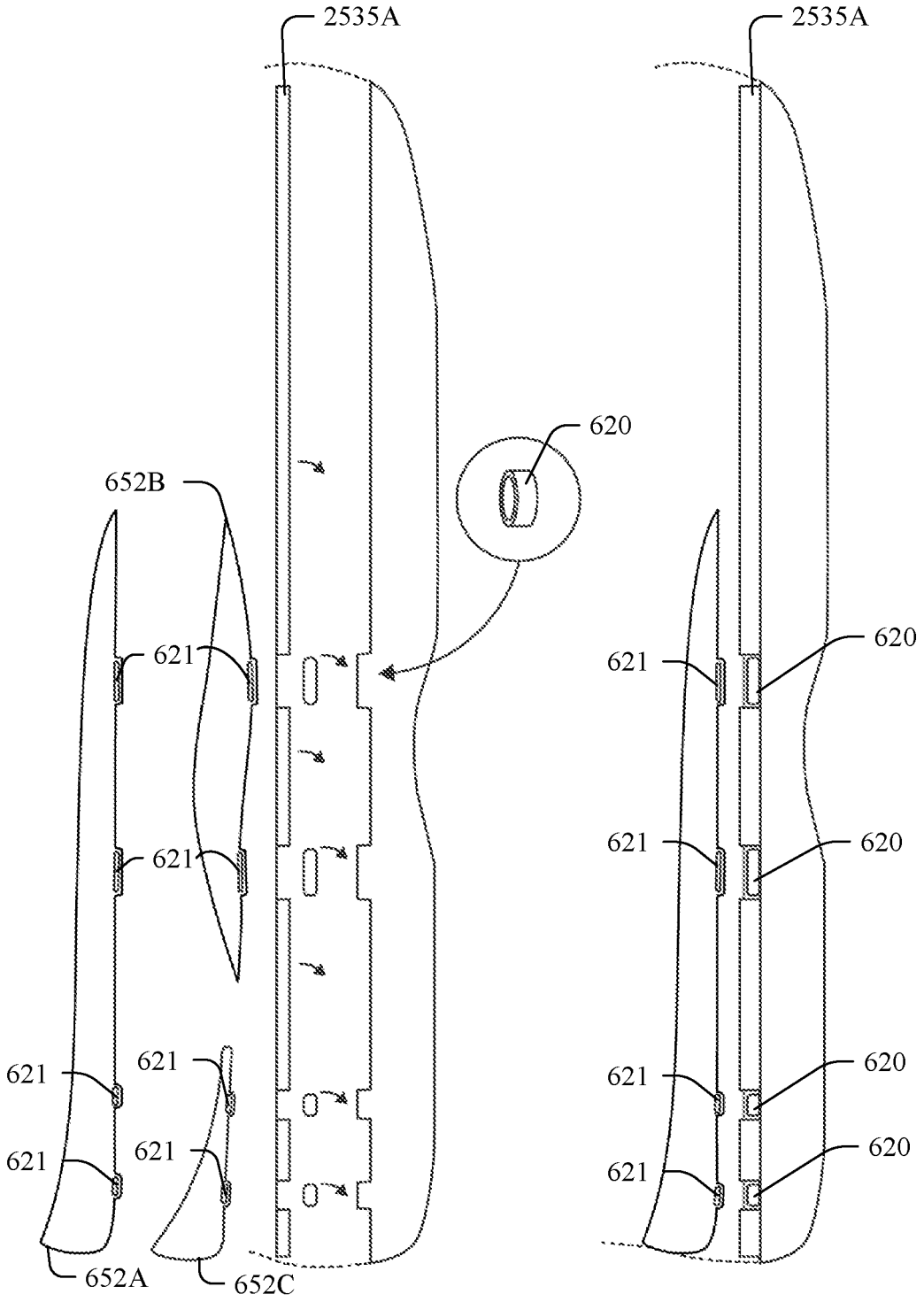
FIGS. 26 and 26A show alternate embodiments where insole magnets 620 are inserted into a voids within the outsole, or stacked and maintained alignment by a patterned section.
Figure 26A:
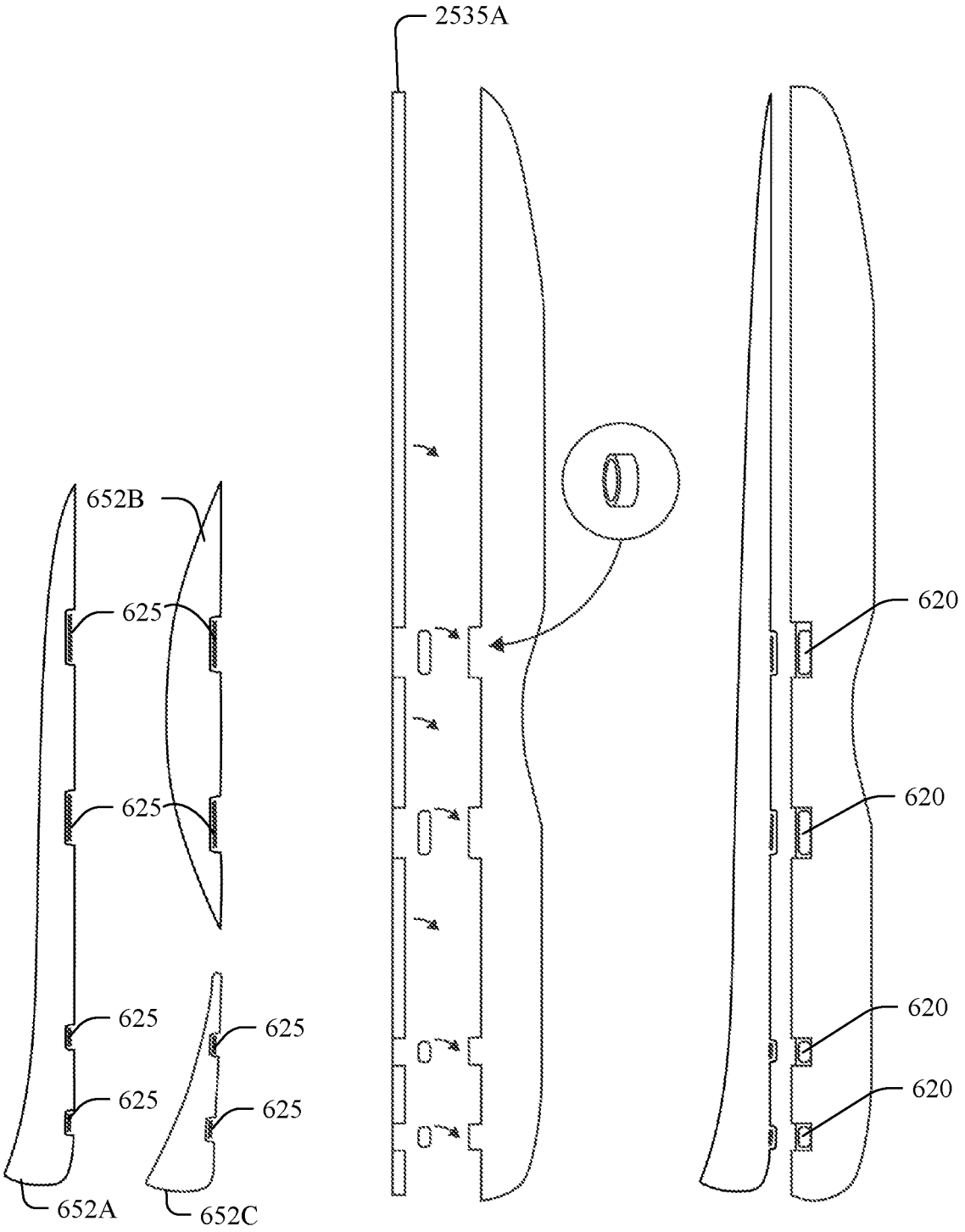

FIGS. 26 and 26A show alternate embodiments where insole magnets 620 are inserted into a voids within the outsole, or stacked and maintained alignment by a patterned section.

Figure 27:
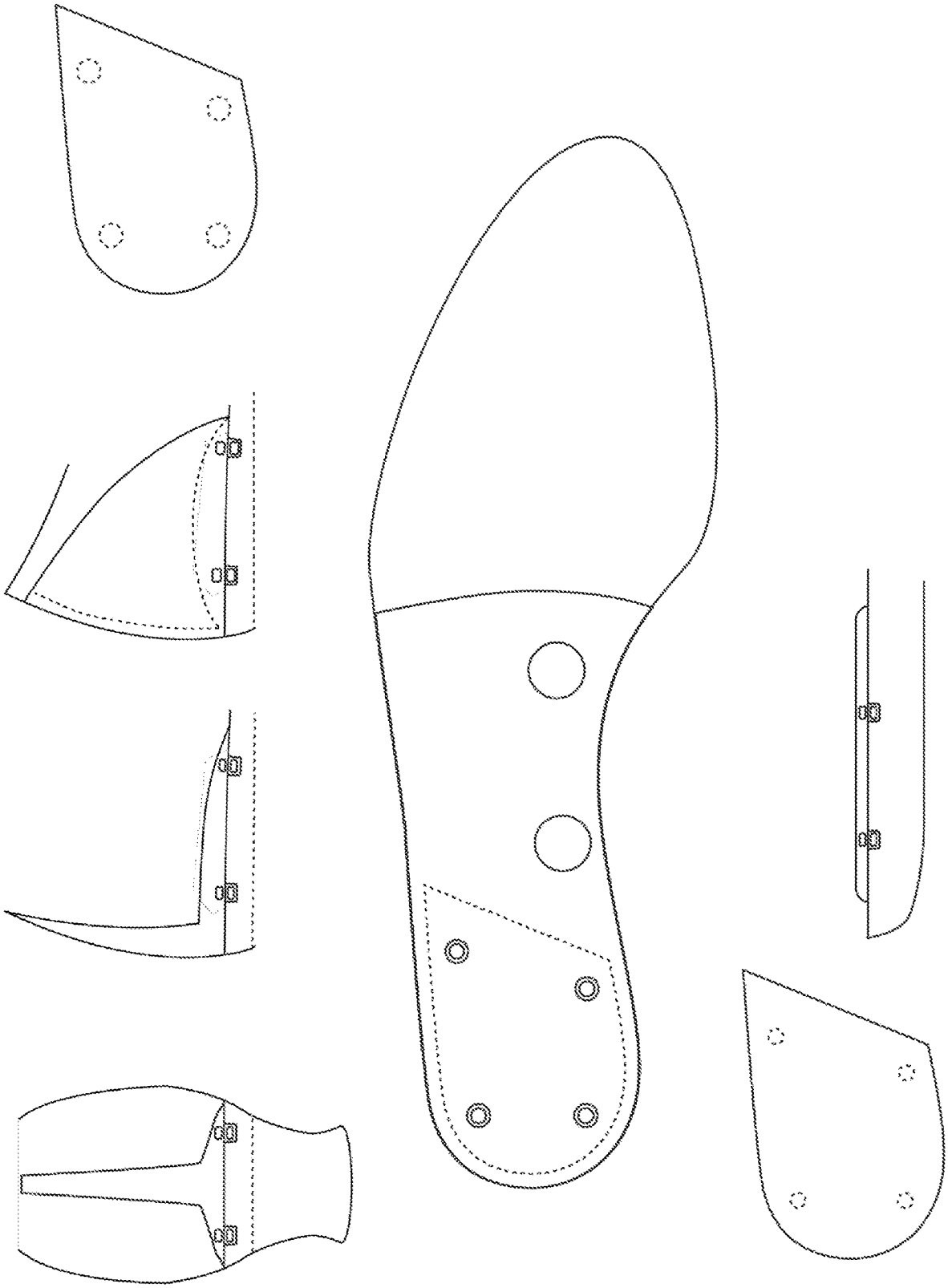
FIG. 27 shows a variety of layouts of alternate embodiments of the present invention.

FIG. 27 shows a variety of layouts of alternate embodiments of the present invention. A pattern of small recessed magnets in the heel portion of the shoe, covered by the sock liner, in the same manner as the arch support, to attach a molded heel cup, pad or heel cup for heel sizing. The heel cup will be made of the same of similar material as the arch support, but softer materials may be used like gel. It will have magnets in protuberances to attach to the magnets in the heel of the shoe. A person with a narrow heel could benefit for this appliance to reduce the volume of the heel area. Others can use a different flat cushioning pad. Any arrangement of the magnets can be used, except the area where the heel is attached with nails and screws must be avoided.

Figure 28:
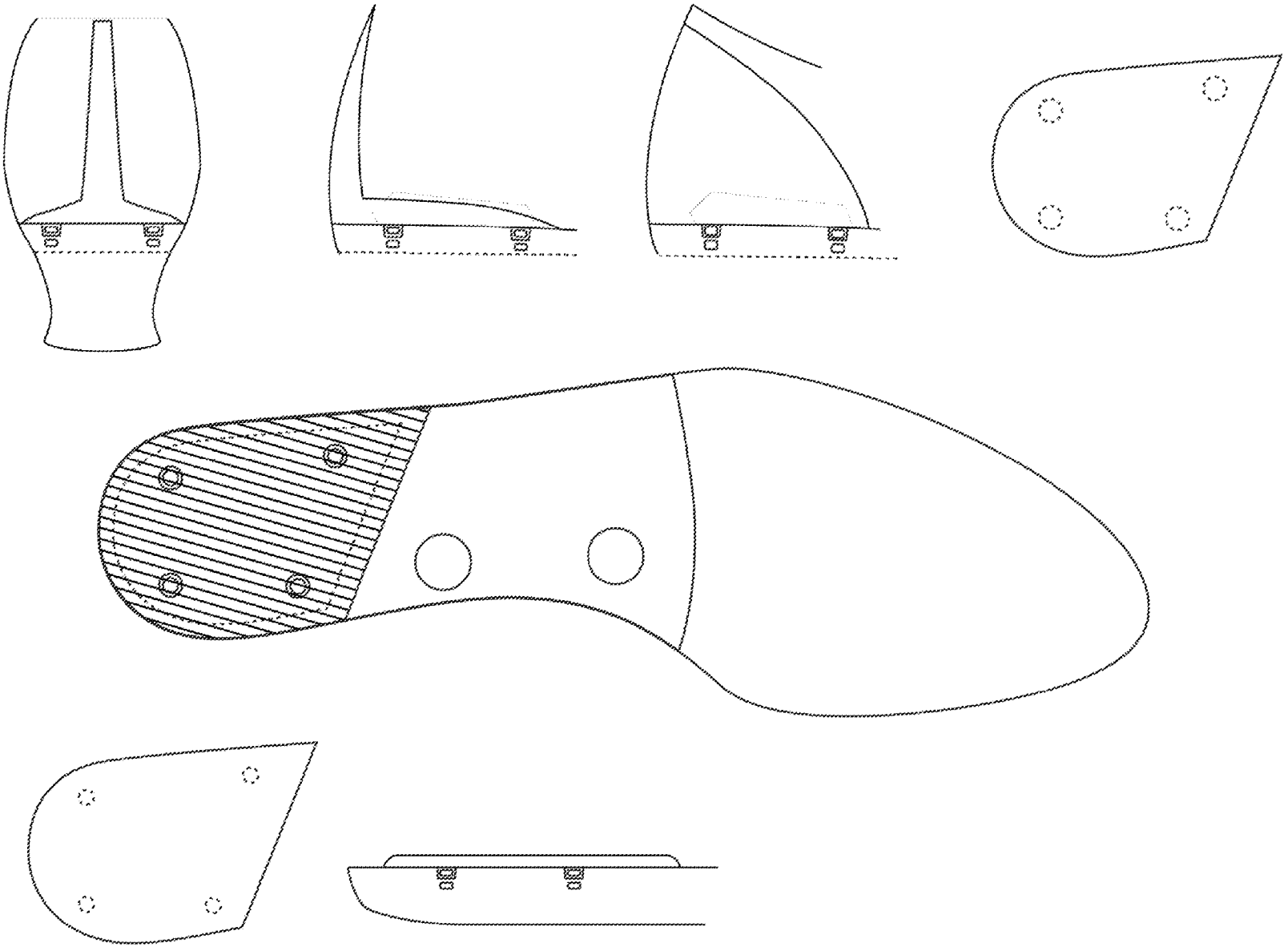
FIG. 28 depicts alternate heel appliance attachment methods with a deeper protrusion on the bottom including a pocket for the flat heel pad.

FIG. 28 depicts alternate heel appliance attachment methods with a deeper protrusion on the bottom including a pocket for the flat heel pad. In an alternative embodiment, using a stretchy sock liner as a pocket, the lateral edge is glued to the insole or footbed leaving a space for the arch support (or even a heel pad) to be inserted. The inserts could be used as an alternative to the attachment methods described previously, or be glued or attached by hook and loop. To close the pocket, hoop and loop or other flat hardware can be used to attach the lining to the inside of the shoe.

Figure 29:
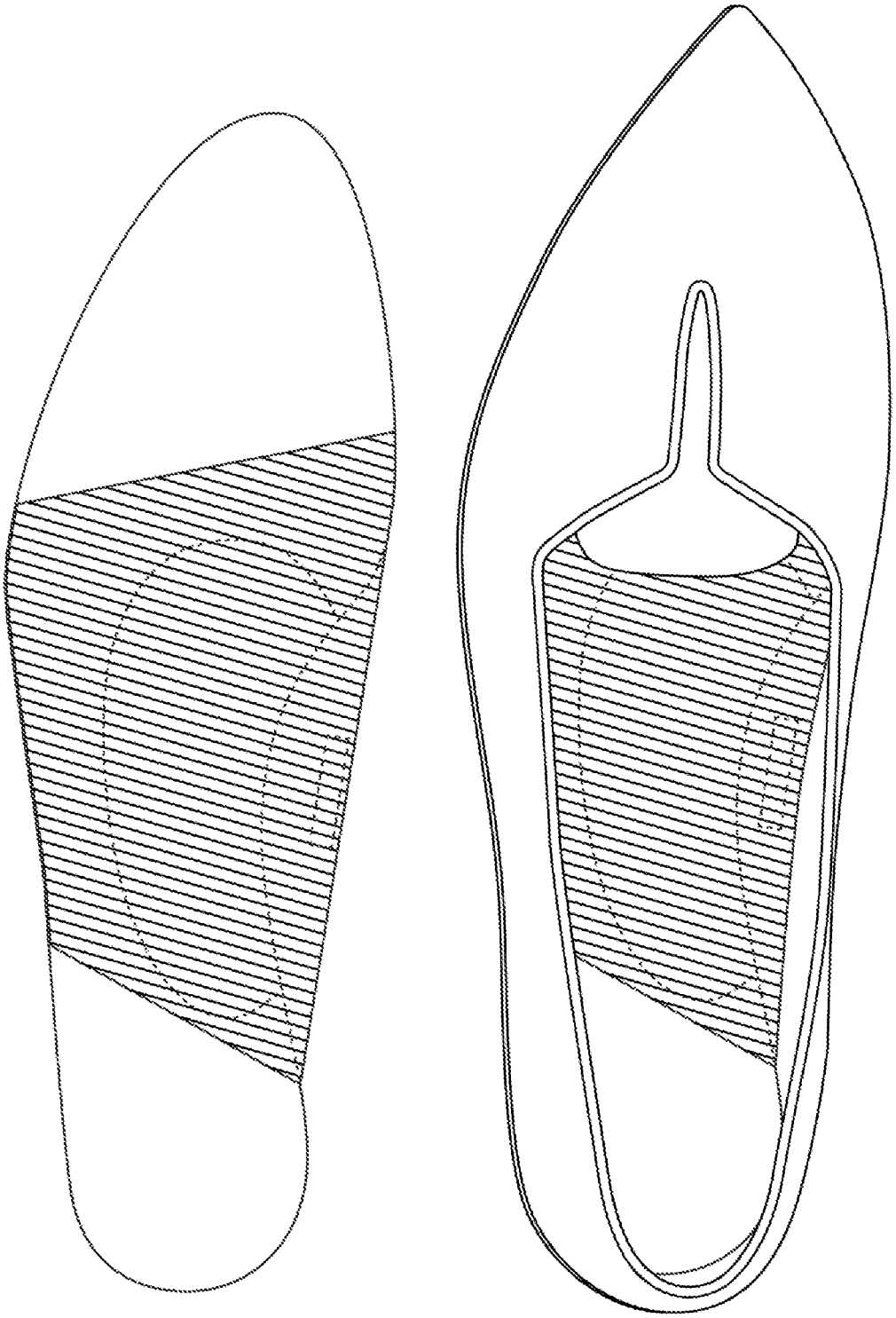
FIG. 29 shows a top view of a shoe including an insert of the present invention with a pocket.

FIG. 29 shows a top view of a shoe including an insert of the present invention with a pocket.

Figure 30:
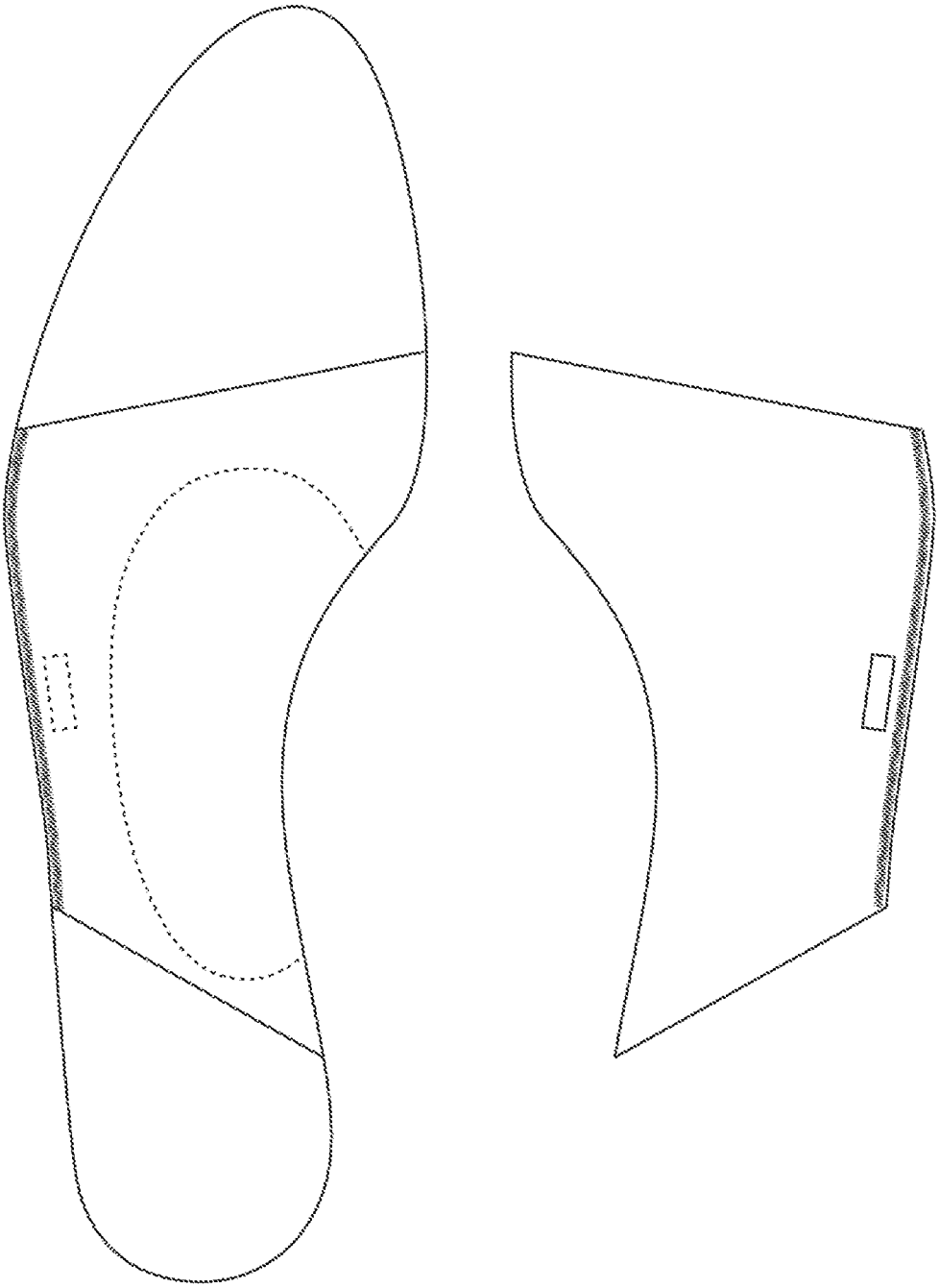
FIGS. 30-32 show an alternative embodiments of the present invention, particularly using a flap or sachetto construction.
Figure 31:
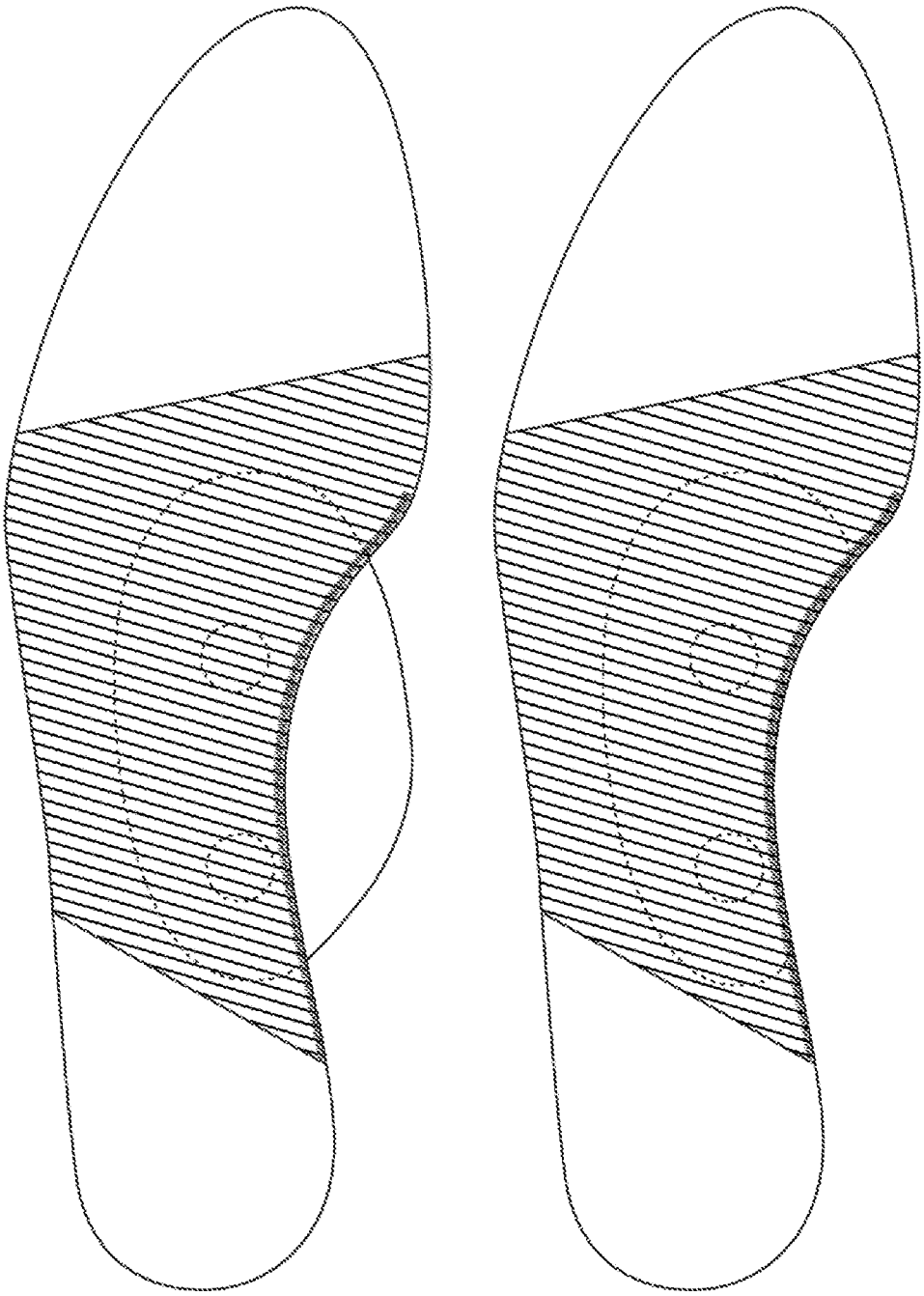

FIG. 30 shows an alternative embodiment of the present invention including a method of concealment in a sachetto (sack or bag construction where the sock liner has hidden seams under the insole). The midsection shows an extra piece of stretch lining material that covers the arch support. There could be the magnet system of attachment or most of the other methods previously described in the insole. The length of the opening depends on the space needed for the arch support to slip under the cover. A light fastening of hook and loop material such as VELCRO®, adhesive or other fastening is indicated to attach the opening of the slit or pocket to the footbed if necessary. The sock liner could be one piece with a slit to insert the magnets. The midsection material concealing the magnets could be adhered to the insole and hidden within the sachetto construction.

Figure 32:
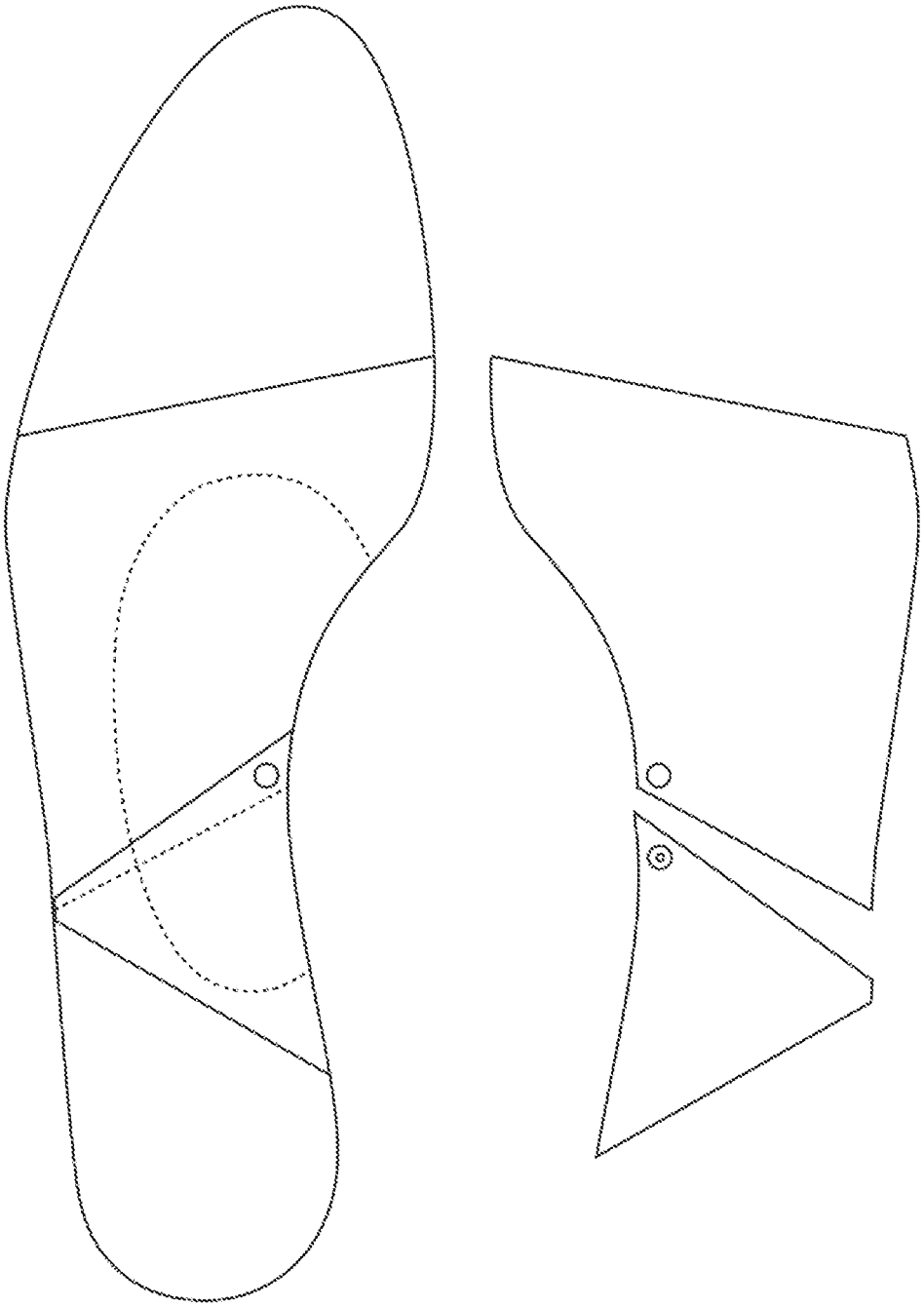

FIG. 32 illustrates another flap iteration for a sachetto construction, but open near the arch to insert and conceal the arch support, with a flat snap or a hook and loop material such as VELCRO® dot to close the opening. With a one piece sock liner open at the arch area, the arch support can simply be slipped in without a cut and fastener in the midsection area if the lining has enough stretch to lay flat over the lower height arch support.

Figure 33:
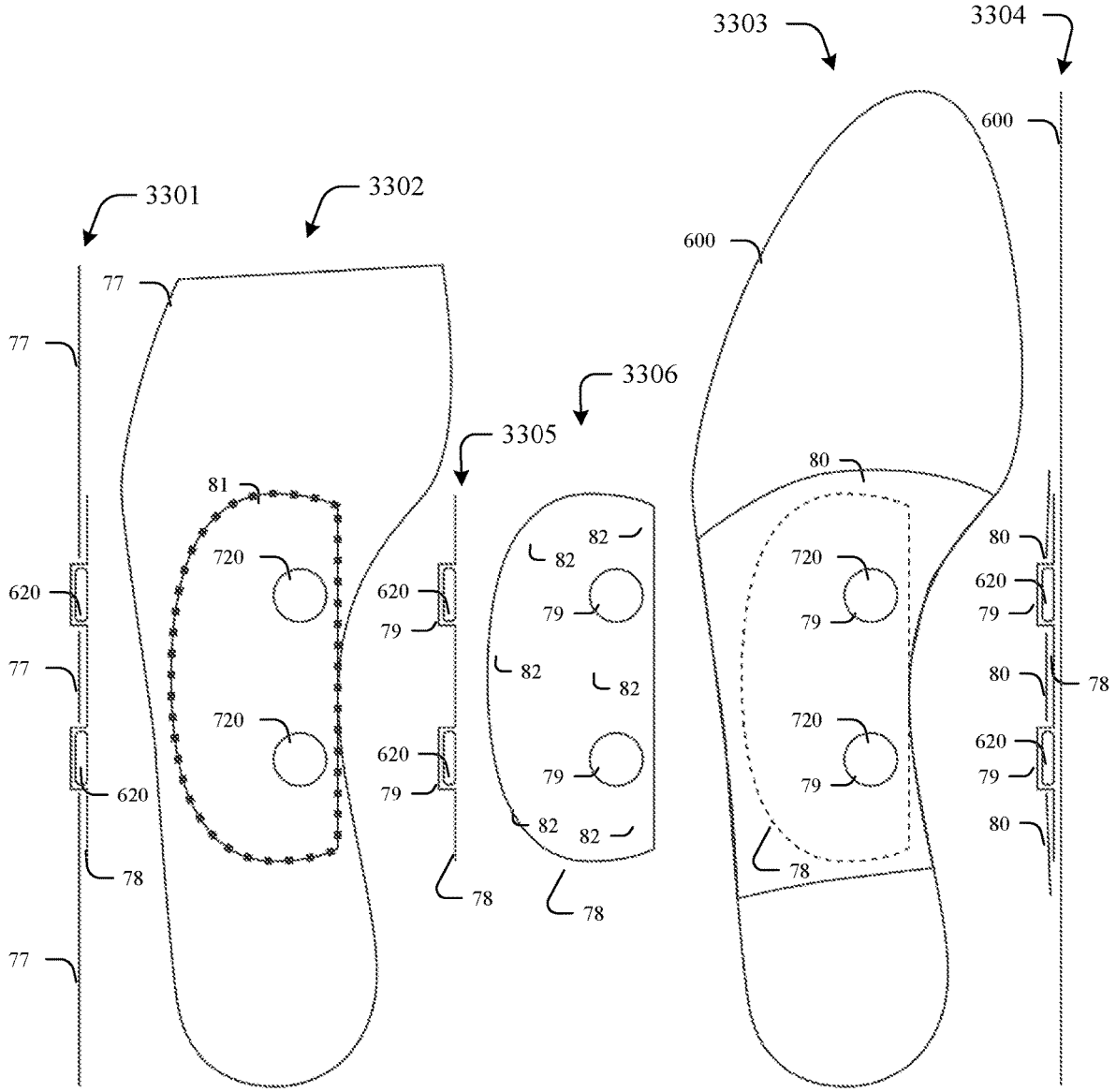
FIG. 33 illustrates one embodiment of the present invention showing a retrofit kit implementation.

FIG. 33 illustrates one embodiment of the present invention showing a retrofit kit implementation. As mentioned in the background, many shoe customers complain about conventional arch supports (or other cushioning) in that they are inherently difficult to place properly in the customer's shoe. In this embodiment of the present invention, a temporary/disposable insole 77 (shown from plan view 3302) provides alignment for the insert components 78, 620 to be temporarily placed in the shoe with temporary adhesion (affixed to a backside surface of the insole 77), allowing the consumer to try the support for comfort before adhering the parts 78, 620 to the shoe. The temporary insole 77 also provides a pattern 81 to mark where the insert components 78, 620 should be attached to the shoe; and the temporary insole 77 further comprises voids 720 allowing raised magnet cavities/protuberances 79 to pass through the temporary insole thus ensuring proper alignment. The pattern 81 approximates an outside shape of the magnet cover 78, so that when a user places marks inside the shoe after the insole 77 and magnet cover 78 are placed, the user may correctly align the magnet cover 78 after removal of the temporary insole 77.

The cross-section shown at 3301 illustrates how the magnet cover 78 fits into the temporary insole 77 and how both parts 77, 78 will be assembled for placement into a shoe. A cross-sectional view of the magnet cover 78 with insole magnets 620 shown in the magnet cavities 79 is also depicted at view 3305, and a plan view of the magnet cover 78 is shown at 3306. The cross-section 3304 at right shows a sock cover 80 (also shown in plan view at 3303) on the magnet cover 78 attached to an inside surface the shoe, such as the insole 600.

In various embodiments, the retrofit kit includes three parts, and may be packaged with the components 77, 78, 80, layered with sock liner 80 on top, temporary insole 77 and magnet cover 78 underneath with the magnet cavities 79 exposed through voids 720 in the sock liner 80 and insole 77.

The vacuum formed or molded magnet cover 78 may be formed from plastic, fiber, or any other rigid or semi-rigid substance, and is placed under the disposable insole 77. The raised magnet cavities 79 covering the insole magnets 620 fit through the voids 720 in the disposable insole 77. The peripheral and central flanges of the magnet cover 78 may include a strong peel-off permanent adhesive (or thermal melt glue) to attach to the insole/midsole 600 of a shoe in the arch area. In various embodiments, cuts may be included in the edges of the peripheral flanges 82 of the magnet cover 78 to facilitate smooth adhesion on a curved surface. The kit will have magnets 620 already glued into the magnet cover 78.

A full length or ¾ insole 77 made of a thin, pliable material, (plastic, fabric, fiber, paper, etc.) that is graded for size, may be placed in the shoe (on top of the magnet cover). In one embodiment, it has peel-off double sided tape on the underside to easily re-position the parts to the sock liner 80 in the shoe.

Sock liner 80 (also called a "midsole cover"), also with and adhesive back, is shown with voids 720 cut out to allow magnet cavities 79 to penetrate there through, and fits over the magnet cover 78. (In one embodiment, the sock liner 80 could also be a solid cover with no holes cut out.) The sock liner 80 is added after the magnet cover part is firmly attached to the shoe.

To attach the aforementioned components to the shoe, the insole 77 is placed in the shoe with the magnet cover 78 underneath next to the sock liner 80 with double sided tape. The magnet cavities 79 in the magnet cover 78 are exposed through circular void cuts 720 in the insole 77. A desired height of the magnetic arch supports/inserts 652 can be attached to make sure the system is comfortable before the components are attached permanently to the shoe.

Once a preferred position of the magnet cover 78 is determined, small holes in the shape of the perimeter of the magnet holder (shown at outline 81) that were previously cut in the temporary insole 77 are used to trace with a pencil or marker a desirable position the magnet cover 78 on the sock liner. Holes in the insole in the shape of the sock liner perimeter could also be added if it is deemed necessary to properly align the sock liner over the magnet cover 78. The user then peels off a paper backing from a rear surface of the magnet cover, exposing the permanent adhesive. The magnet is attached to the shoe, using the position the user marked within the shoe as a guide. Then an arch support/insert 652, previously described, for example in regards to FIG. 6, may be attached to the exposed magnet cavities 79 on top of the sock liner, and magnets 621 disposed within the insert 652 attract magnetically to the insole magnets 620, thus securing the insert 652 into position within the shoe. Further, as placement of the arch support/insert 652 and other cushioning, like a metatarsal pad, is difficult for the consumer, the described marking technique that uses a temporary insole as a sized pattern can be used for adhering an arch support insert or other cushioning with adhesive backing, hook and loop material such as VELCRO®, or other means.

In various embodiments, the top cover, or sock liner 80, is made from leather, fabric or other material with peel-off adhesive backing. The sock liner 80 is attached on top of the magnet cover 78 to the inside of the shoe after the magnet cover 78 is permanently attached. In one aspect, the sock liner 80 may add another layer of adhesive in the shoe to help further retain the magnet cover 78 and help prevent the adhesive on the magnet cover from failing from shear forces.

The shape and size of the sock liner 80 can just cover the midsole/insole 600 as in the drawing, or can be any desired length. The sock liner 80 may have additional backing (plastic, fiber, paper, or any other rigid or flexible backing) with peel-off adhesive to attach to inside of the shoe if the reinforcement facilitates cutting, durability, and adhesion. The temporary insole 77 itself could be scored in the shape of the sock liner/cover 80 to be used as reinforcement. Further, in one embodiment, a layer of foam cushioning (not shown) with voids similar to those shown at 720 may be added on top of the magnet cover, and a cut away may also be added under a full length or ¾ length cover, as in other iterations described above.

The particular implementations shown and described above are illustrative of the invention and its best mode and are not intended to otherwise limit the scope of the present invention in any way. Indeed, for the sake of brevity, conventional data storage, data transmission, and other functional aspects of the systems may not be described in detail. Methods illustrated in the various figures may include more, fewer, or other steps. Additionally, steps may be performed in any suitable order without departing from the scope of the invention. Furthermore, the connecting lines shown in the various figures are intended to represent exemplary functional relationships and/or physical couplings between the various elements. Many alternative or additional functional relationships or physical connections may be present in a practical system.

Changes and modifications may be made to the disclosed embodiments without departing from the scope of the present invention. These and other changes or modifications are intended to be included within the scope of the present invention, as expressed in the following claims.

What is claimed is:

1. A customizable arch support system integrated into a shoe comprising:

at least one shoe insole, at least one arch support insert, a plurality of protrusions formed on an underside of the at least one arch support insert; and a plurality of recesses formed within the at least one shoe insole;

wherein the at least one arch support insert is removably attached within the shoe proximate to a top surface of the at least one shoe insole using a first plurality of magnets disposed in the plurality of protrusions formed in the at least one arch support insert that are disposed proximate a bottom surface of the at least one arch support insert and configured to respectively magnetically couple to a second plurality of magnets disposed in the plurality of recesses formed in the at least one shoe insole, the second plurality of magnets in the at least one shoe insole disposed in an area of the at least one shoe insole configured to reside underneath a wearer's foot arch so as to respectively magnetically couple to and align the at least one arch support insert under the wearer's foot arch area.

2. A customizable arch support system integrated into a shoe as in claim 1, further comprising a hook and loop fastening system.

3. A customizable arch support system integrated into a shoe as in claim 1, further comprising: at least one shank, wherein the shank is encompassed within the at least one shoe insole.

4. A customizable arch support system integrated into a shoe as in claim 3, wherein the shank is comprised of a rectangular metal bar.

5. A customizable arch support system integrated into a shoe as in claim 1, further comprising: at least one cover, wherein the at least one cover is placed directly over the at least one arch support insert to one of cover or envelop the at least one arch support insert.

6. A customizable arch support system integrated into a shoe as in claim 5, wherein the at least one cover is comprised of a sheet of leather.

7. A customizable arch support system integrated into a shoe as in claim 5, wherein the at least one cover is comprised of a sheet of synthetic fabric.

8. A customizable arch support system integrated into a shoe as in claim 1, further comprising: at least one cupped portion configured to be located under the wearer's heel.

9. A customizable arch support system integrated into a shoe as in claim 8, wherein the at least one cupped portion is comprised of a polymer material.

10. A customizable arch support system integrated into a shoe as in claim 8, wherein the at least one cupped portion is comprised of a gel material.

11. A customizable arch support system integrated into a shoe as in claim 1, further comprising at least one cushioning section configured to be disposed under a ball of the wearer's foot.

12. The customizable arch support system integrated into a shoe as in claim 11, wherein the at least one cushioning section is comprised of a gel material.

13. A customizable arch support system integrated into a shoe as in claim 12, wherein the at least one cushioning section is comprised of a urethane foam material.

14. A customizable arch support system integrated into a shoe as in claim 12, wherein the at least one cushioning section is comprised of a combination of a gel material and a urethane foam material.

15. A customizable arch support system integrated into a shoe comprising:

at least one shoe insole, at least one arch support insert, wherein the at least one arch support insert is removably attached within the shoe proximate to a top surface of the at least one shoe insole using a first plurality of magnets disposed in the at least one arch support insert that are disposed proximate a bottom surface of the at least one arch support insert and configured to respectively magnetically couple to a second plurality of magnets disposed in the at least one shoe insole, the second plurality of magnets in the at least one shoe insole disposed in an area of the at least one shoe insole configured to reside underneath a wearer's foot arch so as to respectively magnetically couple to and align the at least one arch support insert under the wearer's foot arch area; and wherein the second plurality of magnets are covered with a foam layer disposed between the second plurality of magnets and the first plurality of magnets, and a sock liner is disposed over the foam layer and between the second plurality of magnets and the first plurality of magnets.

16. A customizable arch support system integrated into a shoe as in claim 15, further comprising: at least one cover, wherein the at least one cover is placed directly over the at least one arch support insert to one of cover or envelop the at least one arch support insert and the first plurality of magnets.

17. A customizable arch support system integrated into a shoe as in claim 15, wherein the first plurality of magnets are respectively disposed within a respective plurality of protrusions formed on an underside of the insert.

18. A customizable arch support system integrated into a shoe comprising:

at least one shoe insole, at least one arch support insert, and a plurality of gel injection openings formed in the at least one shoe insole;

wherein the at least one arch support insert is removably attached within the shoe proximate to a top surface of the at least one shoe insole using a first plurality of magnets disposed in the at least one arch support insert that are disposed proximate a bottom surface of the at least one arch support insert and configured to respectively magnetically couple to a second plurality of magnets disposed in the at least one shoe insole, the second plurality of magnets in the at least one shoe insole disposed in an area of the at least one shoe insole configured to reside underneath a wearer's foot arch so as to respectively magnetically couple to and align the at least one arch support insert under the wearer's foot arch area; and further comprising at least one cover, wherein the at least one cover is placed directly over the at least one arch support insert to one of cover or envelop the at least one arch support insert and the first plurality of magnets; and wherein the plurality of gel injection openings are configured to receive a foam that bonds the at least one cover to the at least one shoe insole.

19. A customizable arch support system integrated into a shoe as in claim 18, wherein the second plurality of magnets a covered with a sock liner disposed between the second plurality of magnets and the first plurality of magnets.

20. A customizable arch support system integrated into a shoe as in claim 18, wherein the first plurality of magnets are respectively disposed within a respective plurality of protrusions formed on an underside of the insert.

* * * * *